US009549866B2

(12) United States Patent
Weisz et al.

(10) Patent No.: US 9,549,866 B2
(45) Date of Patent: Jan. 24, 2017

(54) REHABILITATIVE TRAINING DEVICES FOR USE BY STROKE PATIENTS

(71) Applicant: Mirrored Motion Works LLC, Cary, NC (US)

(72) Inventors: Donald J. Weisz, Cary, NC (US); Preeti Raghavan, Brooklyn, NY (US)

(73) Assignee: MIRRORED MOTION WORKS INC, Cary, NC (US)

( * ) Notice: Subject to any disclaimer, the term of this patent is extended or adjusted under 35 U.S.C. 154(b) by 724 days.

(21) Appl. No.: 13/967,226

(22) Filed: Aug. 14, 2013

(65) Prior Publication Data

US 2014/0046226 A1 Feb. 13, 2014

Related U.S. Application Data

(63) Continuation of application No. 12/888,003, filed on Sep. 22, 2010, now Pat. No. 8,523,792.

(60) Provisional application No. 61/375,817, filed on Aug. 21, 2010, provisional application No. 61/244,708, filed on Sep. 22, 2009.

(51) Int. Cl.

| | |
|---|---|
| ***A61H 1/00*** | (2006.01) |
| ***A63B 23/12*** | (2006.01) |
| ***A61H 1/02*** | (2006.01) |

(52) U.S. Cl.

CPC ..... *A61H 1/008* (2013.01); *A61H 1/0237* (2013.01); *A61H 1/0274* (2013.01); *A61H 1/0288* (2013.01); *A61H 1/0262* (2013.01); *A61H 2201/1269* (2013.01); *A61H 2201/1276* (2013.01); *A61H 2201/14* (2013.01); *A63B 23/12* (2013.01)

(58) Field of Classification Search

CPC .... A61H 1/008; A61H 1/0288; A61H 1/0237; A61H 1/0274; A61H 1/0285; A63B 21/1438; A63B 21/1442; A63B 23/14; A63B 23/035; A63B 23/03516; A63B 22/0002; A63B 22/0005

USPC ..... 434/247

See application file for complete search history.

(56) References Cited

U.S. PATENT DOCUMENTS

| | | | |
|---|---|---|---|
| 3,782,719 | A | 1/1974 | Kuhlman |
| 4,679,548 | A | 7/1987 | Pecheux |
| 4,945,902 | A | 8/1990 | Dorer et al. |
| 5,137,504 | A | 8/1992 | Mangini |
| 5,303,696 | A | 4/1994 | Boice |
| 5,451,191 | A | 9/1995 | Beenken |

(Continued)

FOREIGN PATENT DOCUMENTS

| | | |
|---|---|---|
| DE | 100 53 976 | 5/2002 |
| DE | 102006024942 | 12/2007 |
| WO | WO 2009/070042 | 6/2009 |

*Primary Examiner* — Justine Yu
*Assistant Examiner* — Timothy Stanis
(74) *Attorney, Agent, or Firm* — Leason Ellis LLP

(57) ABSTRACT

According to one embodiment, a rehabilitative training device for use with a stroke patient includes a first component that is operatively coupled to a first body part (unaffected body part) of the patient and a second component that is operatively coupled to a second body part (affected body part) of the patient. The first component and second component are operatively coupled to one another such that motion of the first component as a result of movement of the first body part by the user causes the second component and second body part to move in a symmetrical motion.

13 Claims, 37 Drawing Sheets

TOP VIEW

(56) References Cited

U.S. PATENT DOCUMENTS

| | | | | |
|---|---|---|---|---|
| 5,738,613 | A | 4/1998 | Clayton | |
| 5,820,519 | A | 10/1998 | Slenker | |
| 5,876,362 | A | 3/1999 | Root | |
| 6,149,612 | A | 11/2000 | Schnapp et al. | |
| 6,402,665 | B1 | 6/2002 | Edward | |
| 7,137,959 | B2 | 11/2006 | Phillips | |
| 7,850,579 | B2 | 12/2010 | Whitall et al. | |
| 2003/0073939 | A1 | 4/2003 | Taylor et al. | |
| 2011/0300994 | A1* | 12/2011 | Verkaaik ..... | A61H 1/0274 482/51 |
| 2014/0287390 | A1 | 9/2014 | Byblow et al. | |

* cited by examiner

TOP VIEW

BACK VIEW

FRONT VIEW

FRONT VIEW ART

TOP VIEW OF BASE FOR MODULAR ASSEMBLY OF ALL DEVICES

REHABILITATIVE TRAINING DEVICES FOR USE BY STROKE PATIENTS

CROSS-REFERENCE TO RELATED APPLICATION

The present application is a continuation of U.S. patent application Ser. No. 12/888,003, filed Sep. 22, 2010, which claims the benefit of U.S. patent application Nos. 61/244,708, filed Sep. 22, 2009 and 61/375,817, filed Aug. 21, 2010, each of which are hereby incorporated by reference in their entirety.

TECHNICAL FIELD

The present invention relates to rehabilitative devices and in particular, the present invention relates to rehabilitative devices that are configured to use the motion of an unaffected (or less affected) body part to "train" the affected body part and thereby incorporate the brain motor system in the rehabilitation process.

BACKGROUND

While technology continues to make rapid advancements in the medical field, there are still a number of diseases and ailments that strike a vast number of adults and can lead to death. For example, a stroke is currently the third leading cause of death in American and is also unfortunately a leading cause of adult disability. A stroke, which also referred to as a "brain attack," occurs when a blood clot blocks an artery (a blood vessel that carries blood from the heart to the body) or a blood vessel (a conduit through which blood moves throughout the body) ruptures and thereby interrupts blood flow an area of the brain. When either of these events occurs, brain cells begin to die and brain damage occurs.

As a result of the interruption in blood flow and brain cells dying during a stroke, the affected area of the brain is unable to function and abilities controlled by that area of the brain are lost. These abilities include but are not limited to movement (ability to move one or more limbs on one side of the body), speech (ability to understand or formulate speech), memory, and sight (ability to see one side of the visual field). How a stroke patient is affected depends on where the stroke occurs in the brain and how much of the brain is damaged. For example, an individual who has a small stroke may experience only minor problems such as weakness of an arm or leg. Individuals who have larger strokes may be paralyzed on one side or lose their ability to speak. Some people recover completely from strokes, but more than ⅔ of survivors will have some type of disability for the rest of their lives. More specifically, many survivors suffer from residual neurological deficits that persistently impair function. In particular, dysfunction from upper extremity (UE) hemiparesis impairs performance of many daily activities such as dressing, bathing, self-care, and writing and as a result, functional independence is greatly reduced. In fact, studies show that only 5% of adults regain full arm function after stroke and unfortunately, 20% regain no functional use.

For a person that survives a stroke, the person will most likely undergo stroke rehabilitation which is the process by which patients with disabling strokes undergo treatment to help the patients return to a normal life as much as possible by regaining and relearning the skills of everyday living. This can be a very long and difficult process and therefore is very challenging and difficult for the patient and all loved ones. As a result, stroke rehabilitation also aims to help the survivor understand and adapt to the difficulties ahead, prevent secondary complications and educate family members to play a supporting role and assist the survivor as much as possible and where needed.

Depending upon the severity of the stroke, the rehabilitation program will vary and thus the makeup of the rehabilitation team will also vary. In any event, a rehabilitation team is usually multidisciplinary since it involves staff with different skills that are all working together to help the patient recover and relearn and develop old skills and abilities. The rehabilitation staff can include but is not limited to nursing staff, physiotherapy, occupational therapy, speech and language therapy, and usually a physician trained in rehabilitation medicine. Other rehabilitation programs will include assist from psychologists, social workers, and pharmacists since unfortunately, a large number of patients manifest post-stroke depression, and other social problems related to their disability. However, most stroke patients undergo physical therapy (PT) and occupational therapy (OT) and therefore, these are considered cornerstones of the rehabilitation process. During the rehabilitative process, assistive technology, such as a wheelchair, walkers, canes and orthosis are commonly used to assist the patient and to compensate for impairments. Speech and language therapy is provided for patients with problems understanding speech or written words, problems forming speech and problems with swallowing. While PT and OT have overlapping areas of working, their main attention fields are different in that PT involves re-learning functions such as transferring, walking and other gross motor functions. In contrast, OT focuses on exercises and training to help relearn everyday activities known as the activities of daily independent living, such as eating, drinking, dressing, bathing, cooking, reading and writing, and toileting, etc.

It is generally accepted in the medical community that there is an important treatment window for beginning the rehabilitative process. Traditionally, methods of stroke rehabilitation have been focused on the first three months after stroke and consist largely of passive (nonspecific) movement approaches or compensatory training of the nonparetic arm. This time window is in part based on and consistent with natural history studies of stroke recovery that show a plateau after three months, although it has been demonstrated that recovery can occur well beyond this window into the late chronic phase several years post-stroke. Features of the motor impairment are however different in the period immediately after stroke (i.e. the first 3 months or so) and in the later post-stroke period (after 3 months). In the beginning there is predominantly weakness, but later muscular overactivity develops in certain muscle groups that leads to abnormal posturing and masks strength gains in the non-overactive muscle groups.

Much of the therapy provided by PTs and OTs in the first 3 months is hands-on, and is spent in passively maintaining range-of-motion in the joints of the affected side so as to prevent deformity and in teaching compensatory strategies to preserve functional independence to the extent possible using the unaffected limb, assistive devices and the like. Little time and effort is expended in trying to restore muscle activation/strength in the paralyzed affected limb. With respect to rehabilitative treatment for people suffering with chronic hemiparetic arm dysfunction, there are a number of new devices for upper arm rehabilitation and training. Most of these devices concentrate on the affected arm and use mechanical devices/robotics and electrical stimulation to controllably move the affected arm. For example, there are robotic devices that facilitate movement of the targeted muscle group or groups by using a robot to sense and then stimulate appropriately if the patient is not able to complete the intended movement. These new rehabilitation devices were introduced to allow increased amounts of 'practice' to train the affected limb while reducing the burden on the therapist. However, these devices are overly complex, expensive (since they use computers (virtuals) and robotics), and "train" the affected limb by producing passive movements in one or more joints using an external source of energy. The complexity and costs of these devices prevent them from being used in a number of settings, including a home or remote clinic that does not have sufficient resources for purchase of expensive equipment, etc.

A number of recent studies have shown that recovery is an "active" rather than a "passive" process where it is the brain that needs to be trained in conjunction with movements of the limb. Over the last few decades it has been shown that there is a complex interaction between the two sides of the brain in the control of movement of one limb. Both sides of the brain contribute to the control of each limb, but one side is usually "inhibited" in a healthy individual. However this inhibition is removed when one side is damaged, and as a result the undamaged side of the brain may play a greater role in the recovery of the affected limb. Existing rehabilitation devices are not focused on harnessing the already available brain activity from the unaffected side to train affected arm movements.

Therefore there is a need for alternative forms of rehabilitative devices that can be used in more settings such as the ones mentioned above and can be offered in a more cost effective manner and in a more user friendly (less complex) manner.

SUMMARY

In accordance with the present invention, a number of rehabilitative devices intended for use by stroke patients are provided that are specifically configured to harness brain activity from the unaffected side to "train" affected arm movements by using the motion of the unaffected (or less affected) limb. Using the healthy limb to train the affected limb is known as "mirroring." Although the brain control of the muscular system is almost entirely contralateral, there is approximately a 10% contribution of the ipsilateral brain to individual muscles. By using the unaffected brain to move both body parts (limbs) in the same manner, the recovery from stroke is facilitated by increasing control of the muscles by the ipsilateral brain.

According to one embodiment, a rehabilitative training device for use with a stroke patient includes a first component that is operatively coupled to a first body part (unaffected body part) of the patient and a second component that is operatively coupled to a second body part (affected body part) of the patient. The first component and second component are operatively coupled to one another such that motion of the first component as a result of movement of the first body part by the user causes the second component and second body part to move in a symmetrical motion.

The devices described herein also enable patients to conduct range-of-motion therapy within their own homes. Restricted range of motion, which typically occurs after a stroke, can cause pain, impair function, and increase the risk of skin breakdown leading to open sores. In order to reduce these complications of stroke, range-of-motion exercises are prescribed for almost all patients. The inexpensive devices described herein could be used to supplement range-of-motion therapy that patients initially receive in hospital or other therapeutic settings when still covered by insurance, but more importantly enable them to continue this important therapy at home long after insurance no longer covers it.

In one embodiment, the body parts can be selected from the group consisting of: arms, legs, ankles, wrists, shoulders, fingers, and thumbs.

These and other aspects, features and advantages shall be apparent from the accompanying Drawings and description of certain embodiments of the invention.

DETAILED DESCRIPTION OF CERTAIN EMBODIMENTS OF THE INVENTION

In accordance with the present invention, a number of rehabilitative devices intended for use by stroke patients are provided that are specifically configured to harness brain activity from the unaffected side to "train" affected arm movements by using the motion of the unaffected (or less affected) limb to "train" symmetrical motions of the affected one. Using the healthy limb to train the affected limb is known as "mirroring." Although the brain control of the muscular system is almost entirely contralateral, there is approximately a 10% contribution of the ipsilateral brain to individual muscles. By using the unaffected brain to move both body parts (limbs) in the same manner, the recovery from stroke is facilitated by increasing control of the muscles by the ipsilateral brain.

The devices described herein also enable patients to conduct range-of-motion therapy within their own homes. Restricted range of motion, which typically occurs after a stroke, can cause pain, impair function, and increase the risk of skin breakdown leading to open sores. In order to reduce these complications of stroke, range-of-motion exercises are prescribed for almost all patients. The inexpensive devices described herein could be used to supplement range-of-motion therapy that patients initially receive in hospital or other therapeutic settings when still covered by insurance, but more importantly enable them to continue this important therapy at home long after insurance no longer covers it.

The devices, indicated by the headings below, are all based on one body part "training" the other and the active use of the patient's brain motor system to facilitate the rehabilitation.

Upper Limb Rehabilitative Device (Bilateral Arm Trainer)

Figure 1:
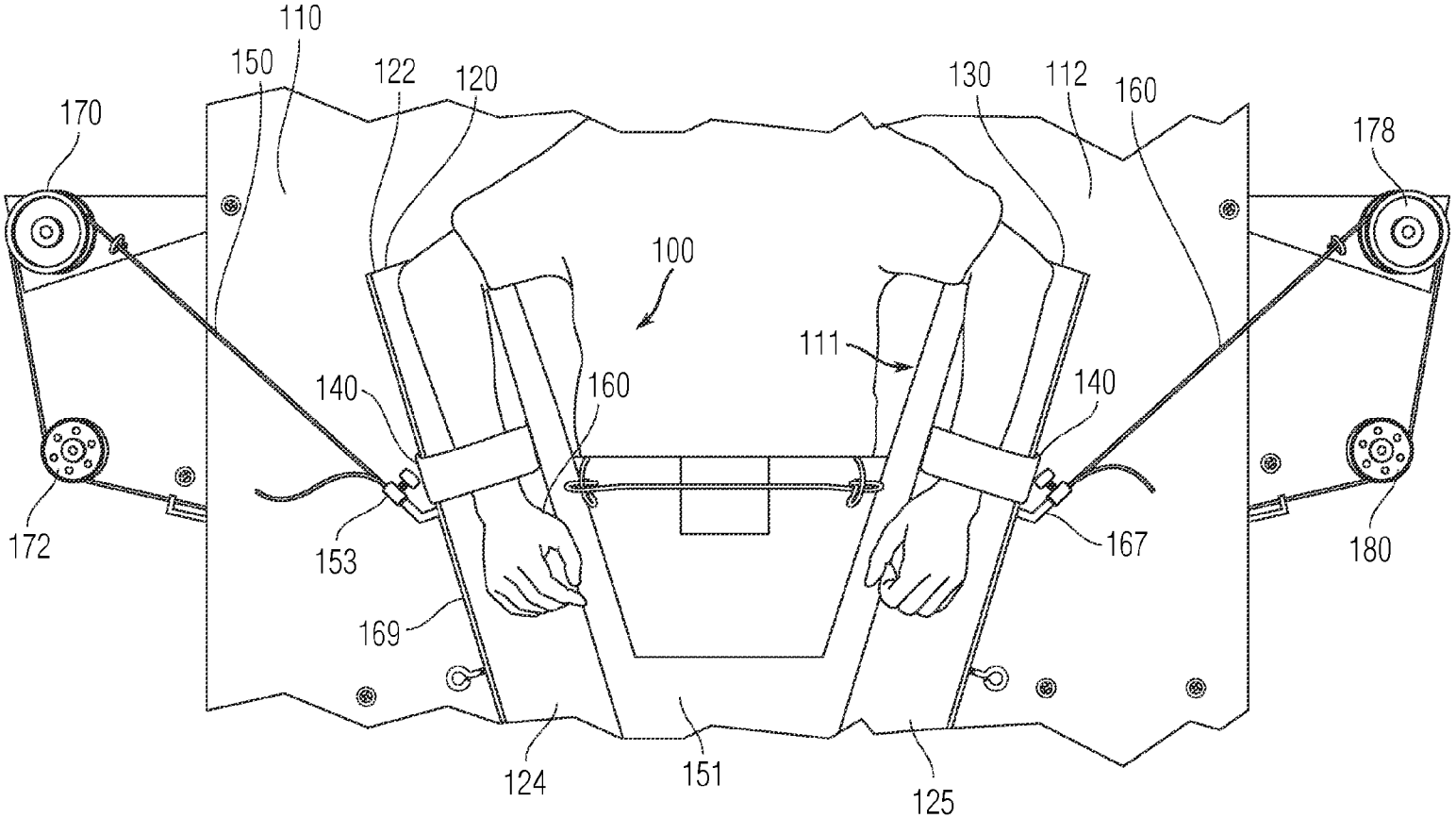
FIG. 1 is a top plan view of an upper limb rehabilitative device according to one embodiment of the present invention.
Figure 2:
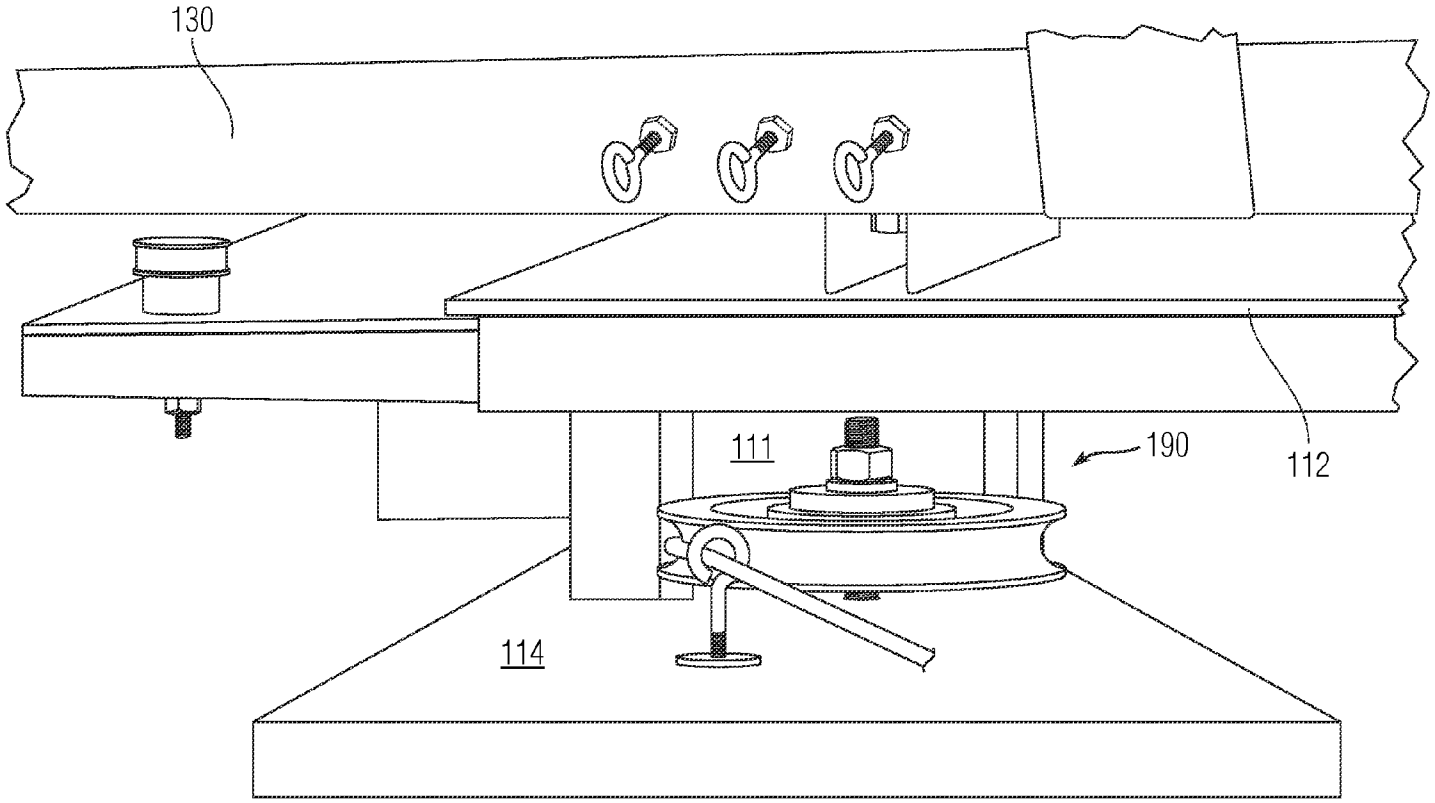
FIG. 2 is side perspective view of a portion of the device of FIG. 1.
Figure 3:
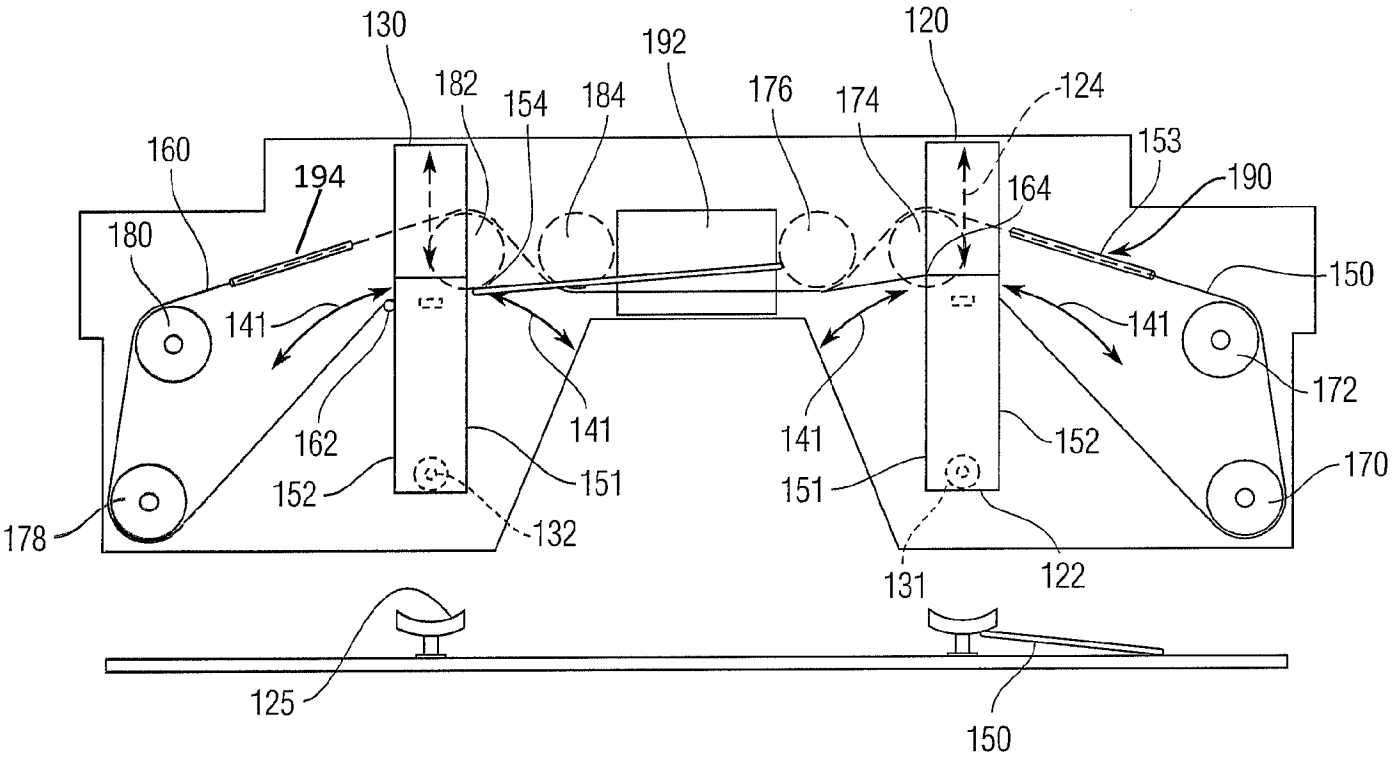
FIG. 3 is a top plan view of a mechanical coupling and motion mechanism of the device of FIG. 1.

Now referring to FIGS. 1-3 and in accordance with one embodiment of the present invention, an upper limb rehabilitative device 100 is configured to enable a stroke patient with motor weakness in the upper limb to use her/his unaffected arm (and unaffected brain) to facilitate almost symmetrical movements with the affected arm. The underlying principle for the device 100, as well as other devices described herein, is that rehabilitation of an affected muscle group can be facilitated by increasing the participation of the brain's motor systems in causing the affected muscle group to move. By using the unaffected brain to move both arms in the same manner, recovery from stroke is facilitated either by increasing the participation of any surviving neurons on the affected side of the brain or by increasing control of the muscles by the ipsilateral brain. Moreover, as described herein, studies performed by the present applicant shows that important information regarding the planning and preparation phase of hand movement can transfer from one hemisphere to the other but only if the movement to be performed by one hand is the same as the one performed by the other.

The rehabilitative device 100 includes a base or support member 110 which supports the working components of the device 100 and the patient interacts with during the rehabilitative process. The base 110 includes an upper surface or first face 112 and a bottom surface or second face 114. The base 110 is generally rectangular shaped or square shaped with a wedge cut-out to partially surround the user (patient); however, other shapes can be possible so long as all of the working components are sufficiently contained within the base 110.

In one embodiment, the base 110 is a table-like structure that includes legs that extend down therefrom to support the base 110 at an elevated height. To permit storage and foldability, the legs of the base 110 can be folded. Alternatively, the base 110 can be constructed so that it can be securely, yet releasably mounted to a surface of another object. For example, the base 110 can have a plurality of pivotable clamp members (e.g., along edges or in corners of the base 110) that are constructed to lockingly secure the base 110 to the surface of the other object. The other surface can be in the form of a planar surface of a table or the like. In this manner, the device 100 can be supported by and secured to the table (e.g., a dining room or kitchen table, etc.) by simply placing the device 100 on the table and then securing the device 100 to the table by extending the pivotable clamps, opening the clamps and then positioning the clamps such that the table is at least partially received between jaws of the clamp. The clamp jaws are then locked in place with the table being securely gripped therebetween. This design permits the device 100 to be highly transportable and also facilitates storage since there are no leg members or the like to elevate the base 110.

While the device 100 can be formed of any number of different materials, including wood, plastics, etc., advantages are obtained when light weight materials, such as plastics, are used. The base 110 can be a molded plastic article that has hollow compartments to store some of the working components of the device 100 as described below. In particular and as described below, the base 110 can include one or more compartments 111 that contain some of the working components of the device.

The device 100 includes a first arm holder/restraint 120 and a second arm holder/restraint 130. The first arm holder 120 and the second arm holder 130 are each intended to hold (cradle) the extended arm of the user (patient) and therefore, each of the first and second arm holders 120, 130 is an elongated structure that includes a first end 122 and an opposing second end 124. The holders 120, 130 can have any number of different shapes so long as they are anatomically correct and comfortable and can cradle the arm of a user. For example and as shown, each of the holders 120, 130 has a contoured upper surface 125 on which the extended arm is placed. Padding and the like can be provided on the upper surface to provide greater comfort to the user. In the illustrated embodiment, the holders 120, 130 are semi-circular shaped members. Since the arm lengths of different patients vary, the holders 120,130 can be configured so that the second end 124, which represents a distal end of the holder, can be extended/retracted to either make greater or reduce the overall length of the holder. For example, the second end 124 can include a telescoping end which provides the aforementioned feature. Other designs are equally possible.

In order for the arm to be held in position in the holders 120,130, and prevent slippage of the arm during movement, an adjustable member 140 that holds the forearm in position is provided. In the illustrated embodiment, the adjustable member 140 is a strap that is made of hook and loop type material. The strap 140 is coupled to the respective holder 120, 130 so that the arm is secured in place by wrapping the strap about the forearm and attaching the two ends of the strap 140 to one another. Other means for securing the arm in place along the concave upper surface 125 is equally possible.

The first arm holder 120 is pivotally attached to the base 110 at a first pivot 131 and similarly, the second arm holder 120 is pivotally attached to the base 110 at a second pivot 132. For example, the holders 120, 130 can pivot about respective shafts that are coupled to the base 110.

In one embodiment, the pivot point 131, 132 of each holder 120, 130 can be adjusted to accommodate for different sized patients. For example, smaller patients will require the holders 120, 130 to be spaced closer to one another and therefore adjustment of the pivot points 131, 132 may be needed. The pivot point can be adjusted in any number of different ways including having the pivot point be defined by an axial shaft about which the holder pivots, with the shaft being adjustable along a guide channel or track. For example, the guide channel can include different locking locations or settings into which the shaft is disposed and locked. In this manner, both holders 120, 130 can be adjusted in the same manner to ensure that the two pivot points mirror one another. Alternatively, the pivot can be moved by disengaging the pivot shaft from one opening in the base 110 and disposing it within another opening, thereby defining a new pivot.

In order to glide smoothly across the top face 112, each of the holders 120, 130 can have a pivotable (rotatable) roller (wheel) disposed along its underside closer to the second end 124 that not only elevates the second end 124 relative to the face 112 but also allows the holder to move in a pivoting motion across the top face 112 as described below.

Each holder 120, 130 includes a first (inner) edge 151 and an opposing second (outer) edge 152. When arranged on the base 110 in a spaced relationship, the first edges 150 face one another, while the second edges 152 face in opposite directions. Each holder 120, 130 has a number of coupling members that permit the holder 120, 130 to be coupled to another member. For example, the first edge 151 of each holder 120, 130 includes at least one first coupling member 160, while the second edge 152 includes at least one second coupling member 169. The coupling members 160, 170 are configured to allow attachment between a separate member and the respective holder. In the illustrated embodiment, the coupling members 160, 170 are structures which permit mechanical attachment thereto. For example and as illustrated, the coupling members 160, 170 can be in the form of eyelets that permit an object to be attached to the holder 120, 130.

In the illustrated embodiment, there is a plurality of first coupling members 160 that are arranged linearly along the first edge 151. The first coupling members 160 provide adjustment capability in the event that the pivot point is adjusted by moving the holder 120, 130 along the base 110. This feature is discussed in more detail below.

The device 100 is constructed such that movement of the first holder 120 or second holder 130 is mirrored in the corresponding second holder 130 or first holder 120 and therefore movement of the unaffected forearm is mimicked by an identical or similar movement in the affected forearm. The respective pivoting movements of the holders 120, 130 are identified by arrows 141 in FIG. 3. In other words, as a result of the mechanical coupling between first holder 120 and the second holder 130, one of the first and second holders 120, 130 acts as a driven member since movement thereof is caused by movement of the unaffected arm that is supported thereby and the other of the first and second holders 120, 140 acts as a slave member since movement (a driving action) in one holder is translated into movement of the other holder.

The mechanical coupling between the first holder 120 and the second holder 130 can be accomplished in a number of different ways. For example and as shown in FIG. 3, a first type of mechanical coupling can be in the form of a series of pulleys and cables (cords) that link the first holder 120 to the second holder 130 in such a way that the above described desired movements result.

More specifically, the mechanical coupling mechanism includes a first set of pulleys and a first cable 150 that is routed along the first set of pulleys and a second set of pulleys and a second cable 160 that is routed along the second set of pulleys. As shown in FIG. 1, the first set of pulleys includes four pulleys, namely, a first pulley 170, a second pulley 172, a third pulley 174 and a fourth pulley 176 that are located on different levels (planes) of the base 110 as described below. The first cable 150 has a first end 152 and an opposing second end 154. The first cable 150 can be formed of any number of different materials, including synthetic materials, such as nylons, etc., or it can be formed as a thin metal wire, etc.

Similarly, the second set of pulleys includes four pulleys, namely, a fifth pulley 178, a sixth pulley 180, a seventh pulley 182 and an eighth pulley 184 that are located on different levels (planes) of the base 110 as described below. The second cable 160 has a first end 162 and an opposing second end 164. The second cable 160 is typically formed of the same material as the first cable 150.

The two planes in which the pulleys are located can be thought of as an upper plane that lies along the upper surface of the base 110 and a lower plane that passes through the inner hollow compartment 111 that is formed in the base 110 and is located below the upper surface of the base 110.

The first and second pulleys 170, 172 are rotatably mounted to the upper surface of the base 110 in a spaced relationship relative to the outer edge 152 of the first holder 120, while the third and fourth pulleys 174, 176 are located within the inner hollow compartment 111 of the base and are rotatably mounted to a floor of the base 110 and thus are located in the second plane. The first and second pulleys 170, 172 can be located along one end of the base 110 and the third and fourth pulleys 174, 176 can be located side-by-side within the inner compartment 111 proximate the first arm holder 120 that overlies them. Similarly, the fifth and sixth pulleys 178, 180 are rotatably mounted to the upper surface of the base 110 in a spaced relationship relative to the outer edge 152 of the second holder 130, while the seventh and eighth pulleys 182, 184 are located within the inner hollow compartment 111 of the base and are rotatably mounted to a floor of the base 110 and thus are located in the second plane. The fifth and sixth pulleys 178, 180 can be located along one end of the base 110 and the seventh and eighth pulleys 182, 184 can be located side-by-side within the inner compartment 111.

In order to route the first and second cables 150, 160 along the respective pulleys in two different planes, the base 110 has several slots or openings to permit routing of the cable between the upper surface (first plane) of the base 110 and the inner compartment 111 (second plane) of the base 110. For example, the base 110 can have a first opening 190 that receives the first cable 150 and permits communication between the two planes and a second opening 192 that also receives the first cable 150 and permits communication between the two planes. A third opening 194 is provided for receiving the second cable 160 and, as described below, the second cable 160 is also routed within the second opening 192. As shown in the figure, the first and third openings 190, 194 can be thought of as lateral or side openings, while the second opening 192 can be thought of as a center opening due to its formation between the first and second arm holders 120, 130.

The routing of each of the cables 150, 160 is now described with reference to FIGS. 1 and 3. The first end 153 of the first cable 150 is attached to the outer edge 152 of the first holder 120 and is routed into engagement with the first pulley 170 and then the second pulley 172. The first cable 150 passes down through the first opening 190 into the inner compartment 111 where it engages the third pulley 174 and then the fourth pulley 176 before passing up through the second (center) opening 192 where it extends across the upper surface and terminates with the second end 154 being attached to the inner edge 151 of the second arm holder 130. Thus, the first cable 160 can be thought of as being attached between the outer edge of the first arm holder 120 and the inner edge of the second arm holder 130.

The second cable 160 is routed in a similar manner in that the first end 162 of the second cable 160 is attached to the outer edge 152 of the second holder 130 and is routed into engagement with the fifth pulley 178 and then the sixth pulley 180. The second cable 160 passes down through the third opening 194 into the inner compartment 111 where it engages the seventh pulley 182 and then the eighth pulley 184 before passing up through the second (center) opening 192 where it extends across the upper surface and terminates with the second end 164 being attached to the inner edge 151 of the first arm holder 150. Thus, the first cable 160 can be thought of as being attached between the outer edge of the first arm holder 120 and the inner edge of the second arm holder 130. In FIG. 3, it will be appreciated that the portion of the cable 150, 160 that is located within the inner compartment 111 is shown in broken lines.

The attachment between a respective end of one of the cables and the corresponding edge of the arm holder can be accomplished in any number of different ways including the use of different types of fasteners. For example, each end of the cable can include a cable clamp that mates with a snap hook that is located along the edge. This permits quick and easy attachment and detachment between the two members.

It will be appreciated that device 100 can be thought of as including a first side and a second side that is a mirror image with the first side being the side at which the unaffected arm is positioned and the second side being the side at which the affected arm is positioned.

As a result of the aforementioned arrangement, the dorsal connection to the left forearm is attached to the ventral side of the right forearm by one cable, and the ventral connection to the left forearm is attached to the dorsal side of the right forearm by the other cable.

After placing and securing the patient's arms within the respective arm holders 120, 130, the seated patient is instructed to attempt to move both arms in the same manner. If, for example, the right arm is the unaffected arm, then movement of the right arm in a direction toward the side edge (away from the first arm holder 120) causes the second arm holder 130 to pivot about the pivot 132. This movement of the arm holder 130 causes a pulling of the first cable 120 and since the other end of the first cable 120 is attached to the outer edge of the first arm holder 120, the first aim holder 120 likewise moves in a direction toward the other side edge of the device away from the second arm holder 130. Similarly, when the second arm holder 130 moves in an opposite direction (i.e., in a direction toward the first arm holder 120), the second cable is pulled and since the second cable 130 is attached at its opposite end to the inner edge of the first arm holder 120, the first arm holder 120 likewise moves in a direction toward the second arm holder 130.

Thus, the movements of the unaffected arm are mimicked (mirrored) in the affected arm. A number of advantages are obtained by using the motion of the unaffected (or less affected) limb to train the affected one including that the brain motor system is an integral apart of the rehabilitation process as compared to other systems, such as the robotic ones described above, where a robotic arm moves the affected limb. In addition, the device 100 is configured for ease of use and importantly may be used in a patient's home, and/or as a modular part of the complete workstation (see description below) in a therapeutic facility or gymnasium. This is in direct contrast to the complicated robotic systems or devices that use electrical stimulation to induce muscle contractions in an affected arm or when compared to visits to a physical or occupational therapist who must manually perform repeated movements on the affected limb alone. The large size and high cost of the above-mentioned devices required them to be stationed at a hospital, clinic or the like. Also, stroke patients have only a limited amount of therapy that is covered by a typical insurance policy and therefore since the present device is relatively inexpensive, patients can continue home-based rehabilitation without a worry or concern about insurance coverage. This and the other devices described herein also enable patients to conduct range-of-motion therapy within their own homes. Restricted range of motion, which typically occurs after a stroke, can cause pain, impair function, and increase the risk of skin breakdown and skin sores. In order to reduce these complications of stroke, range-of-motion exercises are performed on almost all stroke patients by physical therapists in the therapeutic setting. The inexpensive devices described herein could be used to supplement range-of-motion therapy patients initially receive when still covered by insurance, but more importantly enable them to continue this important therapy at home long after they are forced to leave the therapeutic setting. It will also be appreciated that the unaffected arm can equally be the left arm and the same movements described above result when the patient moves his or her unaffected arm in either a direction toward the right arm or in a direction away therefrom.

It will be appreciated that the device 100 is not limited to being based on a cable/pulley system to cause the desired movements described herein and in particular, to cause the driven movement of one arm by means of an active device cause a mirrored movement in the other arm by means of a passive (slave) device. For example, a system based on gears can be provided to accomplish the aforementioned motions.

More specifically, the device 100 is merely an exemplary embodiment that discloses a mechanism to create mirrored motions in both the unaffected arm and the affected arm. In other words the present invention is directed to a device in which a first support or holder on which an unaffected arm is placed is operatively coupled to another second support or holder on which an affected arm is placed such that when the patient moves the first support under his or her own action, the second support is driven in the same manner as a result of it being operatively coupled to the first support as opposed to being moved under the patient's action.

Figure 19:
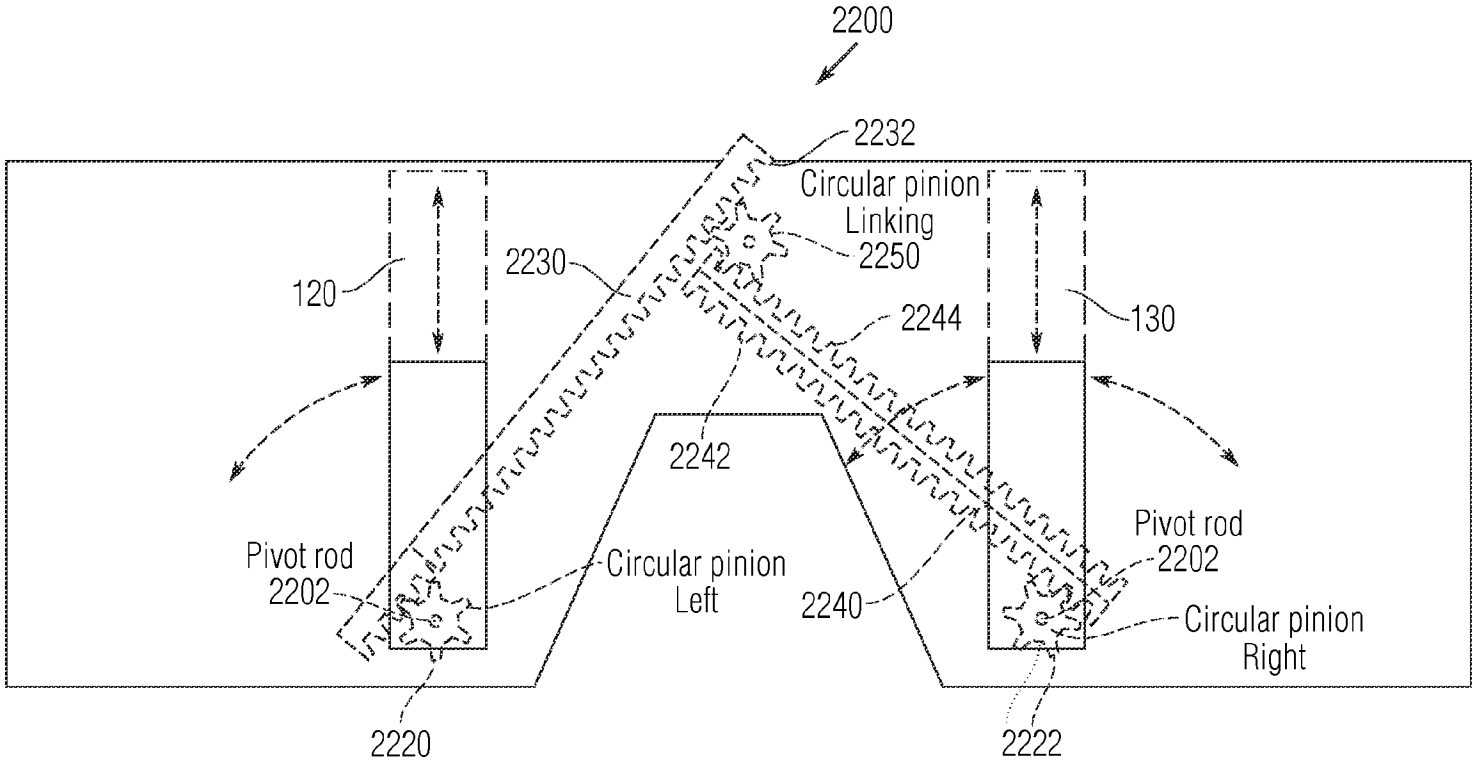
FIG. 19 is a top plan view of an upper limb rehabilitative device according to one embodiment of the present invention.

FIG. 19 shows another mechanism for generating the mirrored movement of the unaffected arm and affected arm and in particular, the mechanism is based on a rack and pinion system as described below. The embodiment of FIG. 19 shares many components of the device 100 and therefore, like components are numbered alike.

In FIG. 19, a device 2200 is disclosed and includes the base 110 which has one or more interior compartments (spaces) 111 formed therein. The device 2200 includes the first arm holder 120 and the second arm holder 130 with each holder being pivotally attached to the base 110 via a pivot shaft (rod) 2202. The holders 120, 130 thus rotate in an arc across the top surface of the base 110 as shown by the arrows in FIG. 19. The user's elbows are placed above the pivot rods 2202 and the forearms are preferably secured with straps 2210 formed of hook and loop material.

Each pivot rod is secured in the center hole of a circular pinion 2220, 2222, with the pinion 2220 being associated with the left (first) pivoting holder 120 and the pinion 2222 being associated with the right (second) pivoting holder 130.

The device 2200 includes a pair of racks that engage the teeth of the pinions 2220, 2222 and in particular, the device 2200 includes a first rack 2230 and a second rack 2240 (all pinions and racks are located within the interior space 111). The racks 2230, 2240 are elongated racks with the rack 2230 including a first set of teeth 2232 that are formed along one face or edge of the rack, while the rack 2240 includes first and second sets of teeth 2242, 2244 formed on opposite faces/edges. Each pinion 2220, 2222 engages the teeth of a rack that slides linearly in a track. In other words, the racks 2230, 2240 slide linearly within respective tracks. The distance between the left and right pivot shafts (rods) 2202 and therefore, the angles of the racks 2230, 2240 are adjusted according to the shoulder width of the user. The pivot shafts 2202 can be secured anywhere a along a guide channel or groove (e.g., a 5" groove) that angles away from the user and is cut through the top face of the device 2200.

A circular linking pinion 2250 is rotationally disposed within the interior compartment 111 at a location between the holders 120, 130. The first set of teeth 2242 engages the teeth of the pinion 2222, while the second set of teeth 2244 engages the teeth of the linking pinion 2250. The teeth of the linking pinion 2250 engage teeth of both racks in that the circular linking pinion teeth engages the teeth 2232 and the teeth 2244. In particular, the second rack 2240 engages the teeth of the linking circular pinion 2250 on the pinion's top half, while the first rack 2230 engages the linking pinion 2250 on the bottom half. As a result, all pinions 2220, 2222, 2250 move simultaneously. Clockwise rotation of one pivoting arm 120, 130 produced counterclockwise rotation of the other 120, 130. Similarly, counterclockwise rotation one arm 120, 130 produces clockwise rotation of the other.

The result is that the motion of the unaffected arm causes a mirrored motion in the affected arm. Thus, the unaffected arm "trains" the affected arm.

It will be appreciated that other types of mechanical mechanism for linking the two holders 120, 130 can be provided to ensure the desired motions result.

Finger and Thumb Extension/Flexion Trainer

Now referring to FIGS. 4-10, a finger and thumb extension/flexion training device (trainer) 200 is illustrated. As described in more detail below, the device 200 is designed to train individual fingers (and thumb) during a rehabilitation session and therefore is a form of isolation treatment. However, the same device 200 can be used to rehabilitate all fingers and the thumb of an affected hand. Similar to the device 100 described above, the device 200 is predicated on the unaffected fingers and thumb "training" the affected fingers and thumb.

The device 200 includes a first unit 210 for use with the paretic (affected) forearm and a second unit 300 for use with the unaffected forearm. For reasons discussed below, the first unit 210 can be thought of as the trainer (slave device), while the second unit 300 can be thought of as the facilitator or driven device.

The second unit 300 is simpler in terms of its construction and therefore, will be described first. The second unit 300 includes a box-like structure or housing 310 that includes a base or floor 312 and a pair of upstanding, spaced side walls 320, 330 that are coupled to side edges of the base 312. The base 312 is generally rectangular in shape to accommodate the forearm of a patient. As shown in the figures, the side walls 320, 330 do not extend completely to a front edge 314 of the base 312. The second unit 300 also includes a platform 316 that is elevated relative to the base 312 and extends thereover. In particular, the platform 316 is spaced above the base 312 and between the side walls 320, 330 so to define an interior compartment 315 that is located below the platform 316.

A front edge 317 of platform 316 extends to or approximately to a front edge 322 of the side walls 320, 330. Similarly, a rear edge 319 of the platform 316 extends to or approximately to a rear edge 323 of the side walls 320, 330. The platform 316 can be adjustable to accommodate forearms of differing dimensions.

Each of the side walls 320, 330 includes an arm 340 that extends forwardly. The arm 340 can be an integral part of the side wall. A distal end 342 of the arm 340 is located between a front edge 311 of the base 312 and the front edges 317, 322 of the platform 316 and side walls 320, 330, respectively. The arms 320, 330 are disposed at an elevated height relative to the platform 316.

The unit 300 includes a cross bar 350 on which a palm of the unaffected hand is placed. In particular, the cross bar 350 extends between the side walls 320, 330 at a location that is near the front edge 317 of the platform 316. The cross bar 350 can be mounted to lower edges of the arms 340 and therefore, the cross bar 350 is elevated and spaced above the platform 316. The cross bar 350 is at an angle so that the palm rests at an approximately 45° on the cross bar 350.

The flat face 352 of the cross bar 350 that receives the hand's palm can be coated with a foam or some other padded member for comfort.

On an underside of the cross bar 350 that faces the upper surface of the platform 316, a plurality of cable routing members 360 can be provided. The cable routing members 360 can be in the form of eyelets or the like and include bounded openings that can receive and route a cable (cord) or the like as discussed below.

Each of the arms 340 can include a slot 370 for adjustment of the cross bar 350 to accommodate different sized patients. For example, the slots 370 are spaced across from one another and extend completely through the arm from the upper edge to the lower edge. The slots 370 can thus be elongated slots that receive fastening members that are coupled to the cross bar 350 such that the cross bar 350 can be moved forward and rearward within the slots 370 and thereby adjust the location of the cross bar 350 relative to the platform 316.

Figure 4:
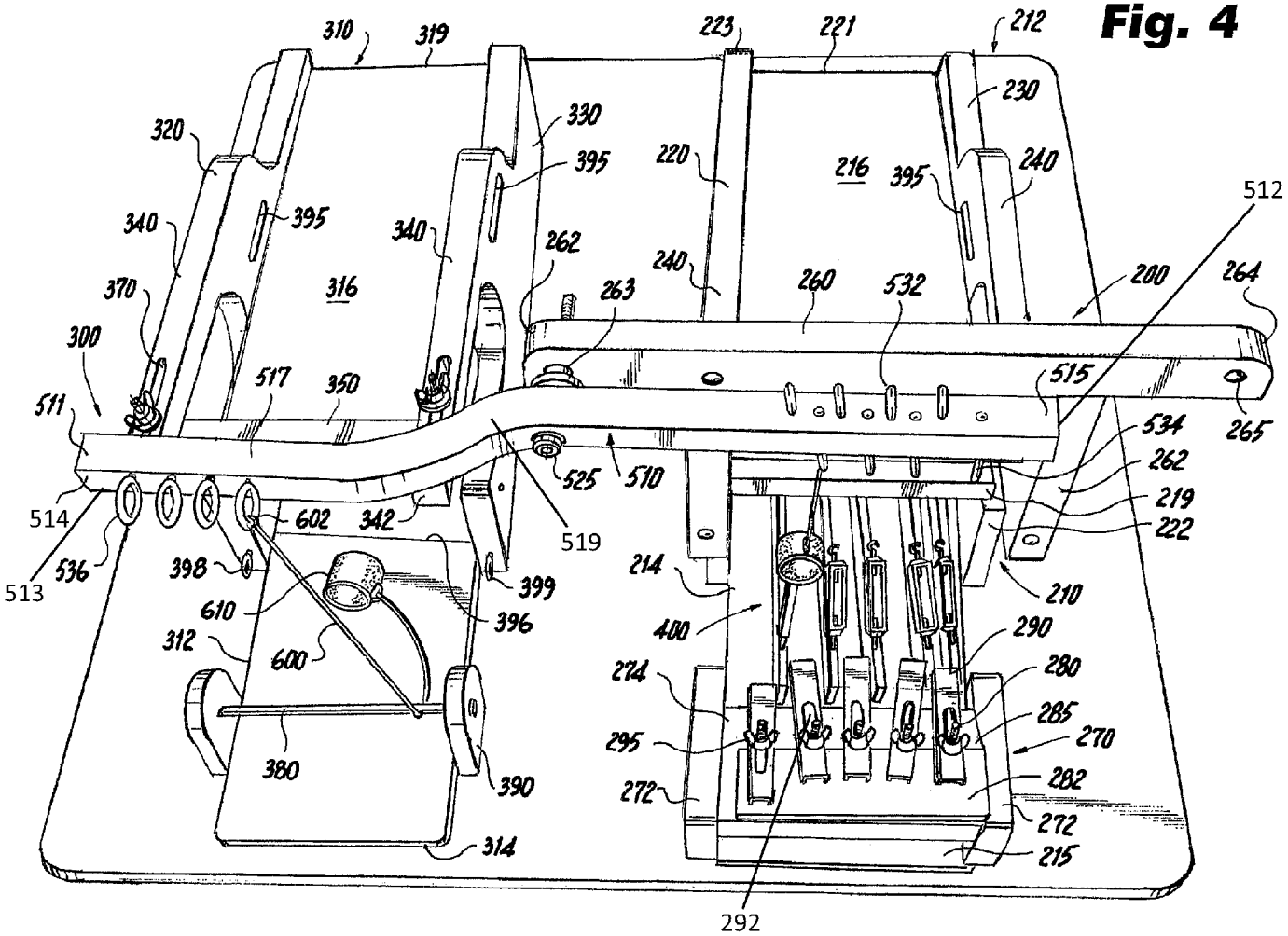
FIG. 4 is a front and top perspective view of a finger extension/flexion training device according to one embodiment of the present invention and being configured for use with an affected left hand.
Figure 5:
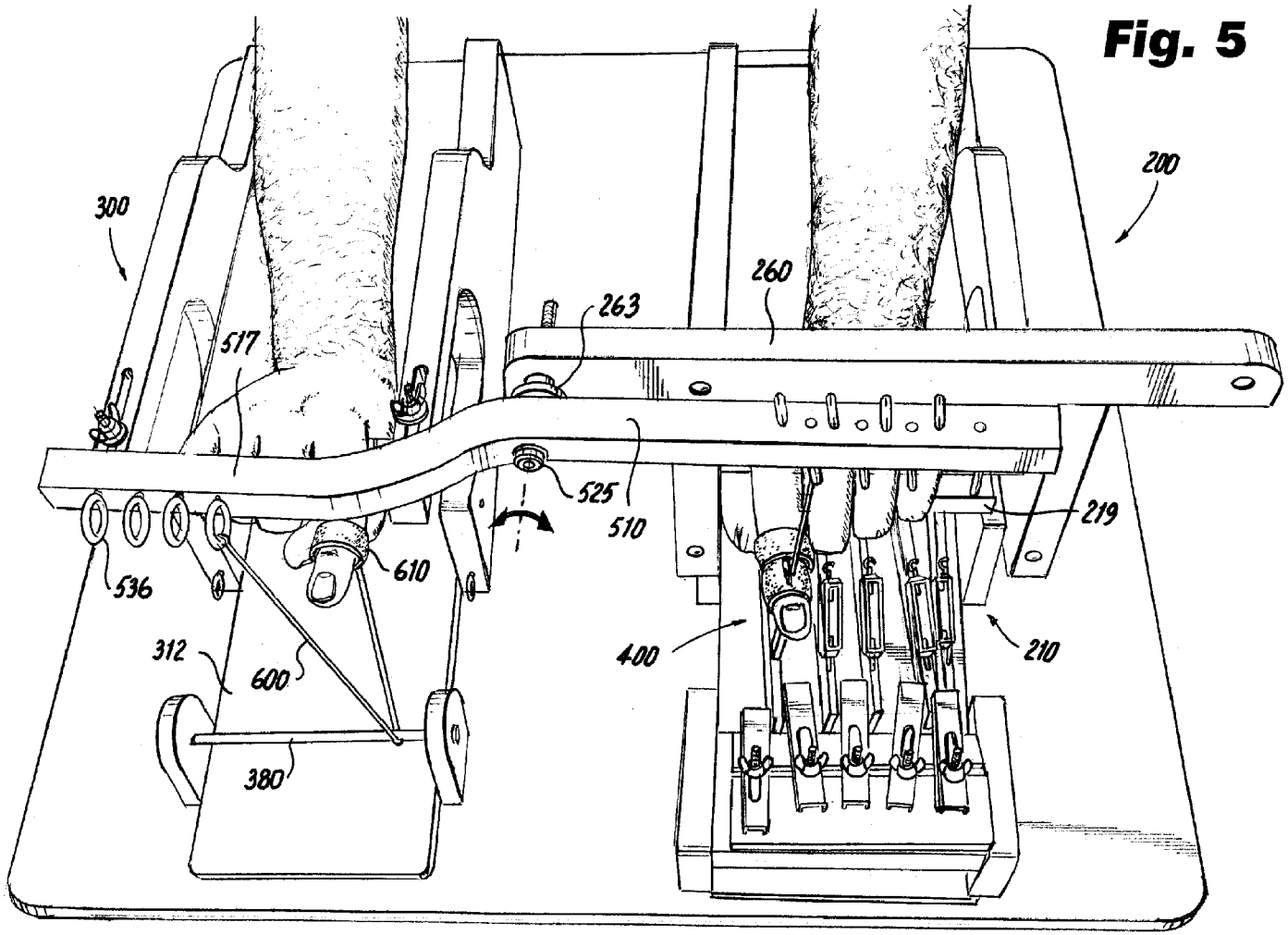
FIG. 5 is a front and top perspective view of the device of FIG. 4 with the index fingers of a unaffected and affected hand being shown in the starting, rest position.
Figure 6:
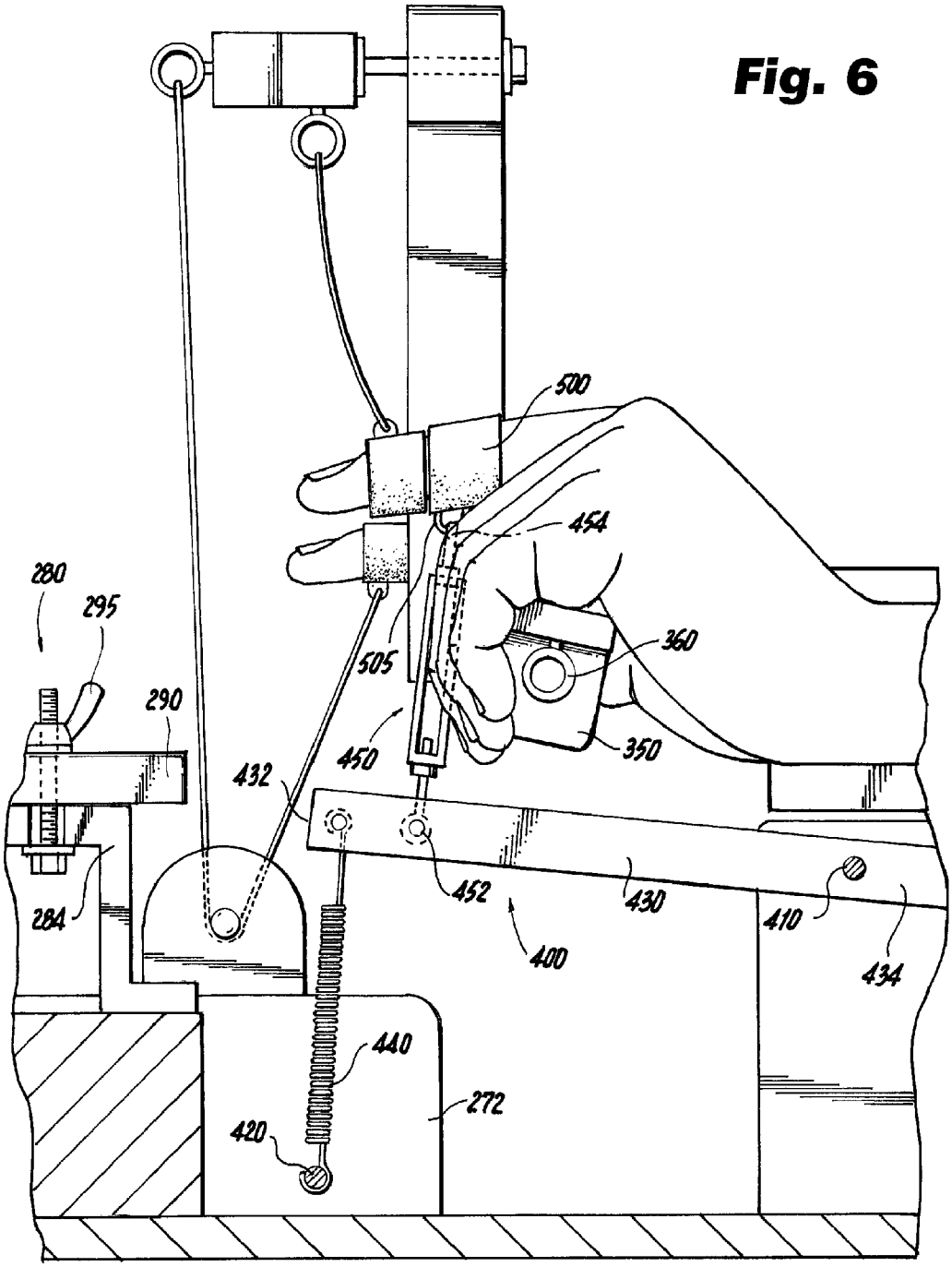
FIG. 6 is a side elevation view of a portion of the device of FIG. 4 showing the rest position of FIG. 5.

The base 312 includes a front pin or shaft 380 that extends across the base 312 near the front edge of the base 312. The front shaft 380 extends between two upstanding support members 390 that can be integral to the base 312. In one embodiment, the front shaft 380 is a metal pin; however, it can also be formed as a plastic pin or from some other suitable material. As shown in FIG. 4, the front shaft 380 is slightly elevated above the upper surface of the base 312 to permit routing of the cable (cord) as described below. The front shaft 380 can be fixed relative to the support members 390.

A securing feature is provided for making sure that the forearm is maintained along the platform 316. For example, a pair of slots 395 can be formed in the side walls 320, 330 above the platform 316 to allow a strap, such as a hook and loop strap, to be routed through one slot across the top of the forearm and then through the other slot 395. The strap can securely anchor the forearm within the unit 300 and more specifically, the forearm is maintained along the platform 316 between the side walls 320, 330 and arms 340 thereof.

The unit 300 can also have additional cable routing features and in particular, the unit 300 can have a lower shaft 396 that extends between the side walls 320, 330 near the front edges thereof and at a location that is forward to the front edge of the platform 316. As with the front shaft 380, the lower shaft 396 can be a metal pin or it can be a plastic pin, etc., and it can be fixed relative to the sidewalls 320, 330. The unit 300 can also have a first lower cable routing member 398 and a second lower cable routing member 399. The first lower cable routing member 398 is located at a lower portion of the front edge of side wall 320, while the second lower cable routing member 399 is located at a lower portion of the front edge of the side wall 330.

The first unit 210 will now be discussed in detail. As previously mentioned, the first unit 210 is for use with the paretic (affected) forearm. The first unit 210 can share a number of components and be constructed similar to the second unit 300 as will be appreciated by the drawing figures.

More specifically, the first unit 210 has a box-like structure or housing 212 that includes a base or floor 214 and a pair of upstanding, spaced side walls 220, 230 that are coupled to side edges of the base 214. The base 214 is generally rectangular in shape to accommodate the forearm of a patient. As shown in the figures, the side walls 220, 230 do not extend completely to a front edge 215 of the base 214. The first unit 210 also includes a platform 216 that is elevated relative to the base 214 and extends thereover. In particular, the platform 216 is spaced above the base 214 and between the side walls 220, 230 so to define an interior compartment 217 that is located below the platform 216.

A front edge 219 of platform 216 extends to or approximately to a front edge 222 of the side walls 220, 230. Similarly, a rear edge 221 of the platform 216 extends to or approximately to a rear edge 223 of the side walls 220, 230. The platform 216 can be adjustable to accommodate forearms of differing dimensions.

Each of the side walls 220, 230 includes an arm 240 that extends forwardly. The arm 240 can be an integral part of the side wall. A distal end 242 of the arm 240 is located between the front edge 215 of the base 214 and the front edges 219, 222 of the platform 216 and side walls 220, 230, respectively. The aims 220, 230 are disposed at an elevated height relative to the platform 216.

The unit 210 includes cross bar 350 on which a palm of the unaffected hand is placed. In particular, the cross bar 350 extends between the side walls 220, 230 at a location that is near the front edge 219 of the platform 216. The cross bar 350 can be mounted to lower edges of the arms 240 and therefore, the cross bar 350 is elevated and spaced above the platform 216. The cross bar 250 is at an angle so that the palm rests at an approximately 45° on the cross bar 250 relative to the platform.

The flat face of the cross bar 350 that receives the hand's palm can be coated with a foam or some other padded member for comfort.

On an underside of the cross bar 350 that faces the upper surface of the platform 216, a plurality of cable routing members 360 can be provided. The cable routing members 360 can be in the form of eyelets or the like and include bounded openings that can receive and route a cable (cord) or the like as discussed below.

Each of the arms 240 can include slot 370 for adjustment of the cross bar 350 to accommodate different sized patients. For example, the slots 370 are spaced across from one another and extend completely through the arm from the upper edge to the lower edge. The slots 370 can thus be elongated slots that receive fastening members that are coupled to the cross bar 350 such that the cross bar 350 can be moved forward and rearward within the slots 370 and thereby adjust the location of the cross bar 350 relative to the platform 216.

Securing feature is provided for making sure that the forearm is maintained along the platform 216. For example, slots 395 can be formed in the side walls 220, 230 above the platform 216 to allow a strap, such as a hook and loop strap, to be routed through one slot across the top of the forearm and then through the other slot 395. The strap can securely anchor the forearm within the unit 300 and more specifically, the forearm is maintained along the platform 216 between the side walls 220, 230 and arms 240 thereof.

The first unit 210 includes a horizontal support member 260 in the form of a cross bar that extends between the distal ends 242 of the arms 240. The horizontal support member 260 is elevated relative to the arms 240 in that a pair of upstanding vertical support members or legs 262 is provided and are attached to the distal ends 242 of the arms 240. The horizontal support member 260 extends between the upper ends of the vertical support members 262 and is fixed thereto. As shown in the figures, the length of the horizontal support member 260 is greater than the distance between the outer faces of the side walls 220, 230 and therefore, first and second ends 262, 264, respectively, of the horizontal support member 260 extend beyond the side walls 220, 230 and are accessible. At the first end 262, a first opening or bore 263 is formed, while at the second end 264, a second opening or bore 265 is formed.

At and near the front edge 215 of the base 214, a second housing 270 is provided and includes a pair of upstanding walls 272 that are coupled to the sides of the base 214. A ceiling member 274 extends between the upstanding walls 272 and is elevated and spaced above the base 214. The ceiling member 274 is a planar member that is disposed parallel to the base 214. The width of the ceiling member 274 is not as great as the lengths of the upstanding walls 272 and therefore, it terminates prior thereto.

A locking mechanism 280 is also provided as part of the second housing 270. The locking mechanism 280 includes a first bracket or wall 282 and a second bracket or wall 284 that is spaced from the first bracket 282 so as to define a gap or space 285. The brackets 282, 284 extend across the ceiling member 274 and are disposed parallel to one another with the bracket 282 being located along one edge (front edge) of the ceiling member 274 and the other bracket 284 being located along the other edge (rear edge) of the ceiling member 274. The space 285 thus extends across the ceiling member 274 and can be thought of as a guide channel. The locking mechanism 280 includes a plurality of restraining bars 290 that are adjustable mounted to the brackets 282, 284. As shown in the figure, there are five (5) restraining bars 290 that each is independently adjustable and in particular, each, when in an unlocked position, can slide between an engaged position and a retracted position. More specifically, each restraining bar 290 is in the form of an elongated bar 290 (e.g., a rectangular shaped bar) that has a slot 292 formed therein to permit such sliding motion. A fastener 295 is disposed through the slot 292 and through the space 285 for locking the restraining bar 290 in either the engaged position or the retracted position. The fastener 295 can be any number of different types of fasteners that offer quick release characteristics in that the fastener 295 can be easily manipulated (loosened) to permit the sliding adjustment of the restraining bar 290 to its desired position.

In the engaged position, the restraining bar 290 is moved rearwardly toward the platform 216 as described below. Conversely, in the retracted position, the restraining bar 290 is moved forwardly away from the platform 216.

Unlike the second unit 300, the first unit 210 has a counter force or biasing mechanism 400 to provide resistance and to provide a return force as described in detail below with regard to the discussion of the operation of device 200. The mechanism 400 includes a number of components that are pivotally coupled to one another. In particular, the mechanism 400 includes a first pin or shaft 410 that extends between the side walls 220, 230 near the front edges thereof. The shaft 410 can be fixed relative to the side walls 220, 230 and is located slightly below the underside of the platform 216. The mechanism 400 also includes a second pin or shaft 420 that is coupled at its ends to the upstanding walls 272 and extends across the base 214. The second shaft 420 is slightly spaced above the upper surface of the base 214.

The mechanism 400 further includes a plurality of levers 430 are provided. Each lever 430 includes a first end 432 and an opposing second end 434, with the second end 434 being pivotally coupled to the first shaft 410. The lever 430 is an elongated bar like structure, such as a thin metal bar. The first end 432 is coupled to the second shaft 420 by means of a biasing member 440. More particularly, the biasing member 440 is in the form of a coil spring that is rotatably attached at one of its ends to the second shaft 420 and is rotatably attached at its other end to the second end 434 of the lever 430.

There are five (5) levers 430 that are spaced across the base 214.

The mechanism 400 also includes a plurality of mechanical linkages 450 with there being one linkage 450 for each lever 430. Each linkage 450 has a first end 452 that is pivotally coupled to a pivot point formed along the length of a respective lever 430. The pivot point is located closer to the first end 432 of the lever. A second end 454 of the linkage 450 is pivotally coupled to a finger restrainer 500 that is intended to securely hold a finger. For example, the finger restrainer 500 can be in the form of an adjustable strap that has a loop shape and is formed of hook and loop material. The finger restrainer 500 can be pivotally coupled to linkage 450 using a ring 505, as shown, that can freely move relative to both the linkage 450 and finger restrainer 500.

Unlike the second unit 300, the first unit 210 includes a pivotable facilitator cross bar 510. The facilitator cross bar 510 has a first end 512 and an opposing second end 514 and can have a non-linear shape as shown. More specifically, the facilitator cross bar 510 can have a first portion 515 that terminates in the first end 512 and is intended for coupling to the first unit 210 and a second portion 517 that terminates in the second end 514. The first and second portions 515, 517 are not collinear but rather there is a curved center transition region 519 there between which causes the first and second portions 515, 517 to lie in different planes. The facilitator cross bar 510 includes a top surface or edge 511 and an opposing bottom surface or edge 513. The facilitator cross bar 510 generally has a stretched (elongated) S shape.

The facilitator cross bar 510 is rotatably coupled to the horizontal support member 260 at the center transition region 519. In particular, a fastener 525 can be passed through a bore formed through the center transition region 519 and then through the first opening 263 formed at the end 262 of the horizontal support member 260. The fastener 525 can be in the form of a bolt or the like or some other type of fastener that can be easily loosened and removed and also easily tightened.

In one embodiment where the left hand is the affected hand, the facilitator cross bar 510 is oriented so that the first portion 515 is located adjacent the horizontal support member 260 that is part of the first unit 210.

The facilitator cross bar 510 includes a number of cable routing members 530 to assist in cable routing as described below. For example, the first portion 515 can include a first set of cable routing members 532 that extend along the top surface 511 and a second set of cable routing members 534 that extend along the bottom surface 513. In contrast, the second portion 517 only includes a single set of cable routing members 536 that unlike the first portion 515, these set of cable routing members 536 are not located along the top surface 511 and bottom surface 513 but rather they are located along a front edge of the second portion 517. The cable routing members can be in the form of eyelets or other structures that have bounded openings to permit a cable or the like to pass therethrough. Each of the sets of cable routing members 532, 534, 536 includes 4 cable routing members that are spaced apart form one another across the respective edge of the cross bar 510.

The second unit 300 includes at least one second cable (cord) 600 that includes a first end 602 and an opposing second end 604. In one embodiment, there are at least four second cables 600 with each finger of the unaffected hand having an associated second cable 600. Each second cable 600 is connected to the second unit 300 by attaching the first end 602 to one of the cable routing members 536 and then routing the cable 600 downward to the front shaft 380 where the cable 600 is looped therearound and then optionally routed to the rear shaft 396 where it is looped therearound and then extends upwardly toward the platform 316. When the cable 600 does not engage the rear shaft 380, the cable 600 simply is routed upwardly from the front shaft 380 toward the platform 316. The second end 604 is connected to a finger restrainer 610 that is intended to securely hold a finger. For example, the finger restrainer 610 can be in the form of an adjustable strap that has a loop shape and is formed of hook and loop material that permits attachment of the finger restrainer 610 to one finger.

It will be appreciated that there are four cable routing members 536 that are spaced apart with each cable routing member 536 being associated with one finger of the hand. Thus, in use, there are four second cables 600 that are attached at first ends thereof to the cable routing members 536 and are routed about the front shaft 380 to allow each finger to have a finger restrainer 610 attached thereto.

It will be appreciated that up and down movement of one finger will cause the second portion 517 of the facilitator cross bar 510 to move since the cross bar 510 pivots about the pivot pin (fastener 525). For example, when a finger is raised by the patient, the second cable 600 is pulled upward due to the routing of the second cable 600 and since the first end of the second cable 600 is directly attached to the second portion 517 of the facilitator cross bar 510 (i.e., the cross bar 510 pivots in a clockwise direction). As described below, this pivoting motion of the facilitator cross bar 510 results in actuation of the second unit 300 which acts as a training unit.

More specifically and similar to the second unit 300, the first unit 210 includes at least one and preferably a plurality of cables (cords) 700 each of which is associated with one finger. More specifically, there are four cables 700, one for each of the four fingers of the affected hand. Each of the cable 700 has a first end 702 that is attached to a corresponding cable routing member 534 (formed along the bottom surface 513) of the first portion 515. An opposite second end 704 is connected to a finger restrainer 710 that is intended to securely hold a finger. For example, the finger restrainer 710 can be in the form of an adjustable strap that has a loop shape and is formed of hook and loop material that permits attachment of the finger restrainer 710 to one finger.

It will be appreciated that there are four cable routing members 534 that are spaced apart with each cable routing member 534 being associated with one finger of the hand.

The cables 700 thus directly attach each finger to the first portion 515 of the cross bar 510.

When the second portion 517 is pulled downwardly as described above due to a healthy (unaffected) finger being raised (extended), the first portion 515 is pivoted upward (clockwise motion of the bar 510), thereby raising the individual finger that is being rehabilitated (affected finger) since the cable 700 is attached therebetween. As a result, the finger motion of the unaffected hand is mirrored in the finger motion of the affected hand since the raising of unaffected finger causing extension of the affected finger.

Figure 7:
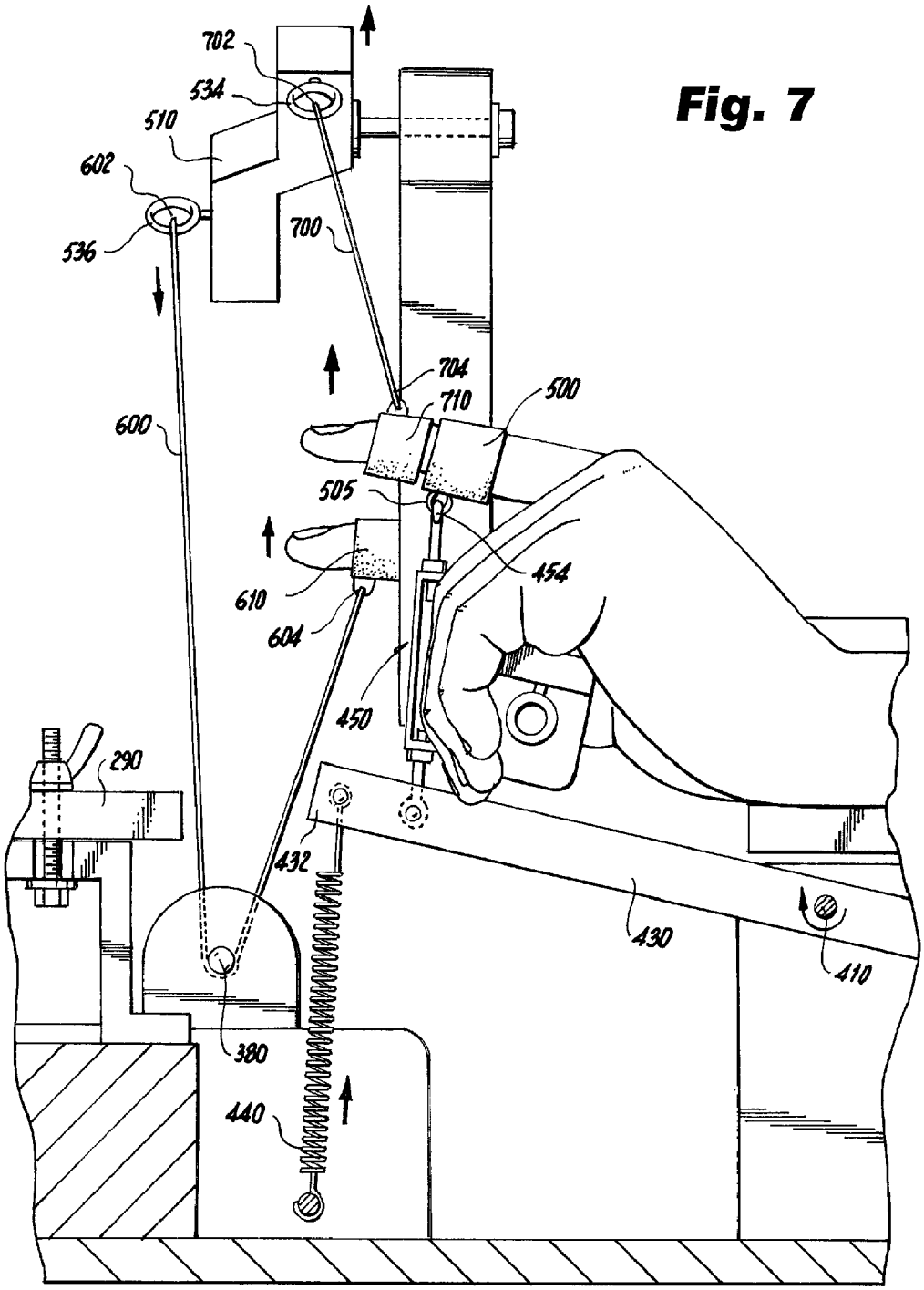
FIG. 7 is a side elevation view of the portion of the device of FIG. 4 showing the index fingers in an extended position.

As the finger of the affected hand is raised (a motion from the rest position of FIG. 6 to the extended position of FIG. 7), the mechanism 400 is actuated due to the same raised finger being coupled to the finger restrainer 500. In particular, the raising of the affected finger causes the linkage 450 to pivot upward about the pivot point defined along the lever 430 and assume a more vertical position. As the affected finger is continually raised, the linkage 450 is likewise raised causing the lever 430 to pivot upward about the first shaft 410. Since the lever 430 is connected to the biasing member 440 at its other end (that is being raised), the biasing member 440 begins to store energy as shown in FIG. 7. This continues until the extension of the unaffected finger is completed (and the extension of the affected finger is completed).

As the unaffected finger is lowered back down toward a rest position (FIGS. 5 and 6), the force applied by the cable 700 is decreased due to the pivoting of the cross bar in an opposite direction (counter clockwise); however, a return force is generated by the mechanism 400 due to release of the stored energy of the biasing member 440. In particular as the cross bar 510 pivot counterclockwise, the biasing member 440 releases its stored energy and biases "pulls" the lever 430 downward and since the linkage 450 is pivotally coupled to the lever 430, the linkage 450 and finger restrainer 500 are also drawn downward. The relationship between the decrease of the force applied by the cable 700 and the release of stored energy causes a mirroring between the lowering motion of the unaffected finger and the affected finger. In other words, in both the raising and lowering of the unaffected and affected finger, the actions in both fingers are smooth and mirror one another and in effect, the unaffected finger trains the affected one.

As described above, any given lever 430 can be prevented from moving (and thereby prevent finger extension) by sliding the restraining bar 290 over the distal end (second end 432). The present device thus allows for finger isolation since one finger can be rehabilitated at one time by moving the respective restraining bar 290 to the retracted position for that one finger and leaving the other restraining bars 290 in the extended position. It also allows for flexibility in training a few or all of the fingers, if desired, by releasing the restraining bars of more than one finger.

Figure 8:
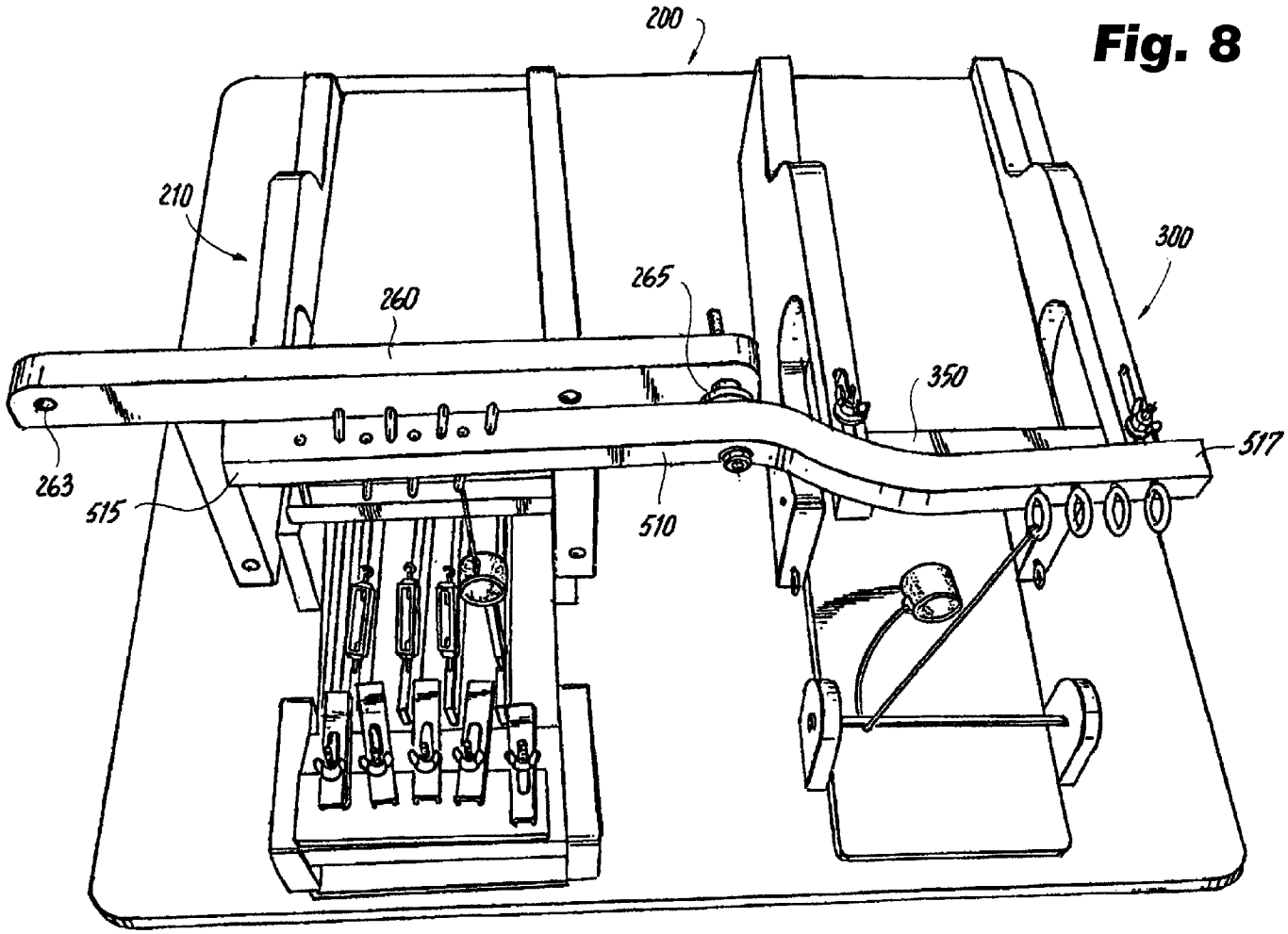
FIG. 8 is a front and top perspective view of the device of FIG. 4 with the exception that the components thereof are arranged to accommodate an affected right hand.

FIGS. 4 and 8 show another aspect of the device 200 and in particular, these figures show that the device 200 can be used to train either the left hand or the right hand. FIG. 8 shows the units 210 and 300 arranged where the right hand is the affected hand, while FIG. 4 shows the units 210, 300 arranged where the left hand is the affected hand. The device 200 easily converts and changes between these two setups by simply removing the horizontal cross bar 510 from the first opening 263 and then pivoting the horizontal cross bar 510 to thereby change (reverse) the locations of the first and second portions 515, 517 before inserting the fastener 525 into the second opening 265 as shown. The operation of the device 200 remains the same.

Figure 9:
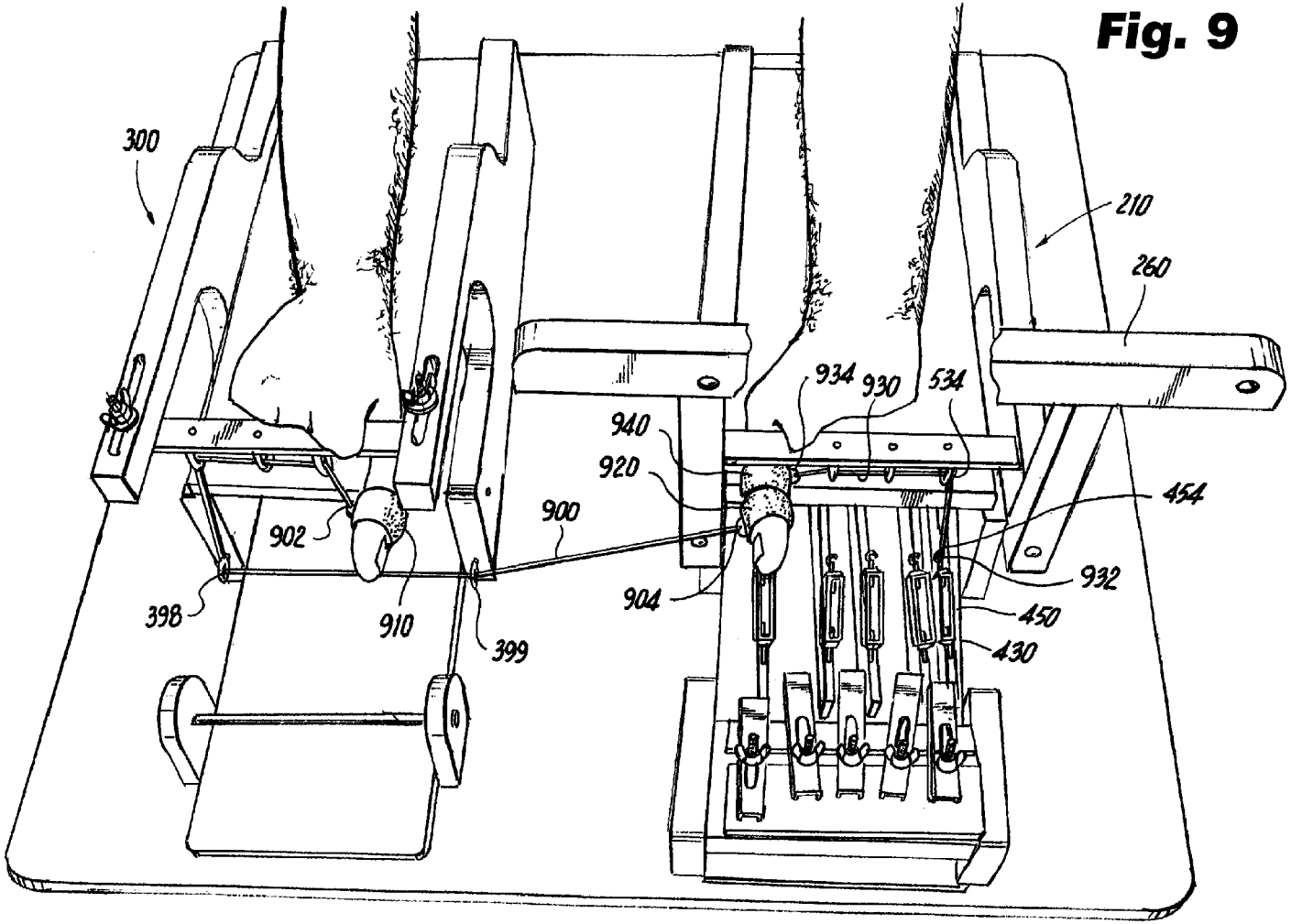
FIG. 9 is a front and top perspective view of the device of FIG. 4 being configured to train a left affected thumb, the unaffected and affected thumbs being shown in a rest position.
Figure 10:
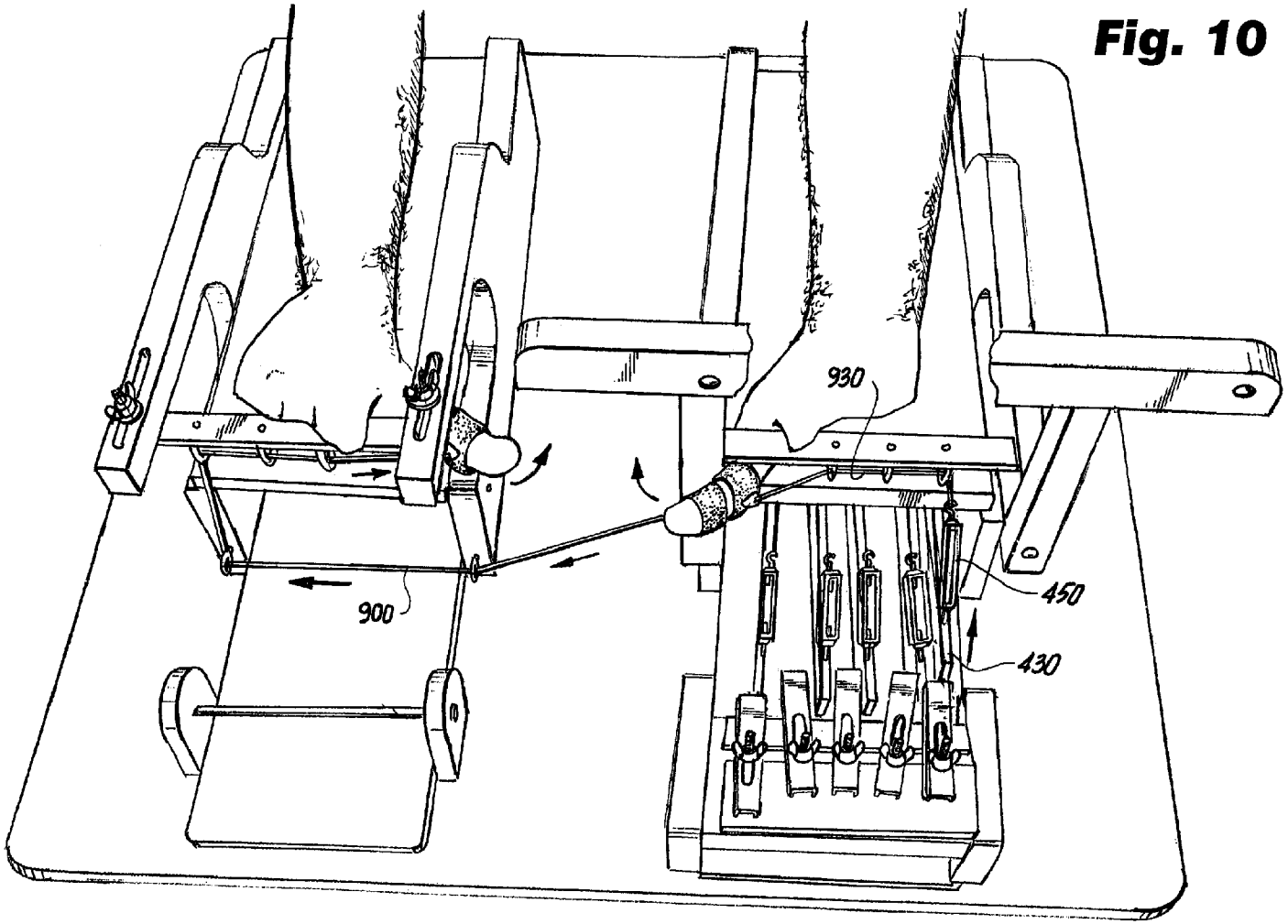
FIG. 10 is a front and top perspective view of the device of FIG. 9 with the thumbs being shown in the extended position.

The affected thumb can also be rehabilitated with the device 200. Referring to FIGS. 9 and 10, in order to rehabilitate an affected thumb, a cable (cord) 900 is provided and includes a first end 902 and an opposing second end 904. Unlike the other cables, cable 900 has a first thumb restrainer 910 (e.g., adjustable strap of hook and loop material) disposed at the first end 902 and a second thumb restrainer 920 (e.g., adjustable strap of hook and loop material) disposed at the second end 904. The first thumb restrainer 910 is attached to the thumb of the unaffected hand and the cable 900 is routed across the cable routing members 360, down through the cable routing member 398 across the cable routing member 399 and is then routed upwardly toward the first unit 210 where the second thumb restrainer 920 is attached to the affected thumb.

As with rehabilitation of the fingers, there is a counter-force/return force mechanism for the thumb that includes some of the components of mechanism 400. In particular, the lever 430 that is closes to the wall 230 is designated as the lever for use with the thumb. Instead of having the second end 454 directly attached to a restrainer, the second end 454 is attached to a first end 932 of a cable (cord) 930 that is routed upwardly into and through the cable routing members 534 across toward the affected thumb. An opposite second end 934 of the cable (cord) 930 is attached to a third thumb restrainer 940 that is attached to the affected thumb and is located adjacent the second thumb restrainer 920.

FIG. 9 shows a rest position of the thumbs prior to extension thereof, while FIG. 10 shows the thumbs in the extended positions. In operation, the unaffected thumb is extended in the direction indicated in FIG. 10 and this causes the cable 900 to be pulled across the cable routing members 536. As a result of the routing of the cable 900, this motion causes the affected thumb to be extended in a direction toward the unit 300 (toward the other thumb). The extension of the affected thumb also causes the cable 930 to be moved along the cable routing members 534 and the linkage 450 and lever 430 are raised thereby causing the biasing member 440 to store energy.

Once the extension motion is completed, the return force mechanism causes controlled movement of the thumb as the unaffected thumb is moved in the same direction back towards the index finger (flexion). The release of the stored energy is smooth and causes the flexion of the affected thumb to mirror the unaffected thumb.

As with the previous embodiment, the rehabilitation of an affected thumb using the device 200 is grounded in the principle that there are a number of advantages in having the unaffected thumb "train" the affected thumb.

The above thumb motions can be continued in a successive manner as part of the rehabilitation process and the mechanisms described above will ensure a smooth controlled movement of the affected thumb that mirrors and is caused by the same motion of the unaffected thumb.

Now referring to FIGS. 35-40, a finger and thumb extension/flexion training device (trainer) 4000 is illustrated and is similar to the device 200 described previously. As described in more detail below, the device 4000 is designed to train individual fingers (and thumb) during a rehabilitation session and therefore is a form of isolation treatment. Similar to the device 200 described above, the device 4000 is predicated on the unaffected fingers and thumb "training" the affected fingers and thumb.

The members that are present in both devices 200 and 4000 are numbered alike and are not described in great detail again. Reference is made to the description of those members in the description of the device 200.

The device 4000 includes a first unit 4010 and a second unit 4020 that unlike the units of the device 200 are preferably the same or similar in term of its construction. At the ends of the spaced arms 340 of each unit, a number of cross members are provided and extend across the arms 340. First, a hand grip bar 4030 is coupled at its ends to the arms 340. The bar 4030 can be a round bar on which the hand of the patient is rested above the platform 319. The bar 4030 can be fixedly attached to the arms 340 or it can be rotatably mounted to the arms 340.

The device 4000 includes a finger clamp frame 4100 that is pivotally mounted to the ends of the arms 340. The finger clamp frame 4100 has a front frame member 4102 and a rear frame member 4104 and two side frame members 4106 that connect the members 4104, 4102 at ends thereof. As illustrated, the finger clamp frame 4100 has a rectangular shape with a hollow center. Each of the front and rear frame members 4102, 4104 includes a slot 4110. The slot 4110 can be a linear slot and the two slots 4110 of the frame members 4102, 4104 are spaced across from one another and axially aligned with one another.

The side frame members 4106 are pivotally mounted to the ends of the arms 340 using with a pair of rotatable links (elongated brackets) 4120. The links 4120 can be attached to the side frame members 4106 using conventional techniques, such as the use of fasteners, and preferably, the links 4120 are attached in a manner that permits the finger clamp frame 4100 to be easily removed (detached from the arms 340). For example, a thumb nut of the like can be used to attach the frame 4100 to the links 4120. The links 4120 are mounted to the arms 340 about pivot points such that the entire finger clamp frame 4100 can pivot about the axis that extends through the pivots formed at ends of arms 340. This permits the finger clamp frame 4100 to be raised and lowered during operation of the device 4000 as described herein.

Figure 39:
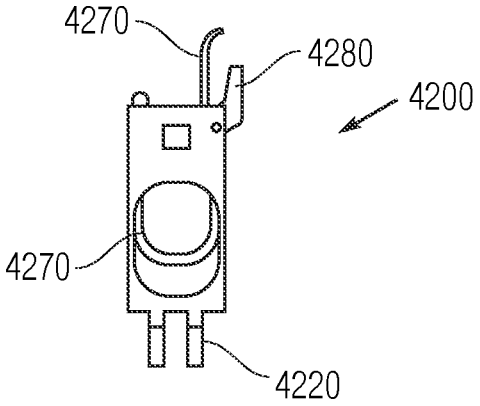
FIG. 39 is a side view of the finger clamp.
Figure 40:
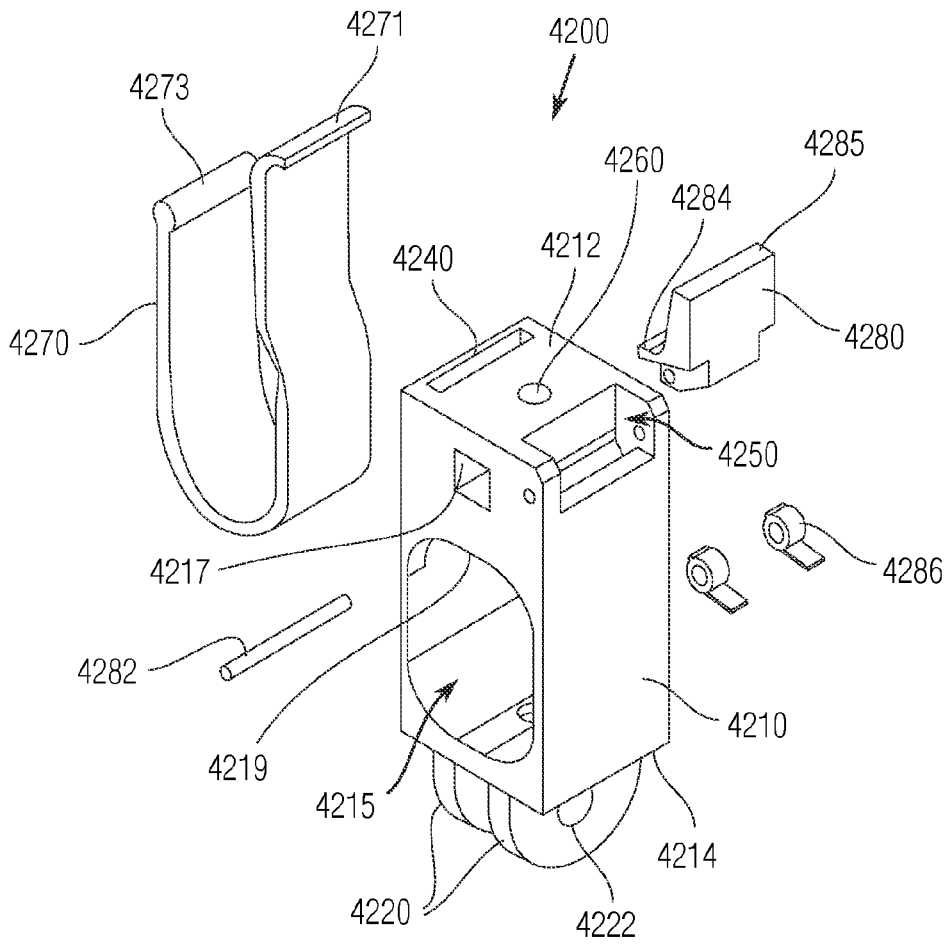
FIG. 40 is an exploded perspective view of the finger clamp.

Unlike the device 200, the device 4000 includes a plurality of finger clamps 4200 that is best shown in FIGS. 39-40. The finger clamp 4200 includes a body 4210 that has a first end 4212 (top end) and a second end 4214 (bottom end). The body 4210 has an opening 4215 formed therein. The opening 4215 can have an oval or circular shape and is configured to receive and hold a finger. The body 4210 also includes a second through opening 4217 that is closer to the top end 4212. The illustrated opening 4217 has a square shape.

At the top end 4212, a first slot 4240 is formed and is in communication with the opening 4215 and a notched opening or slot 4250 is formed and is likewise in communication with the opening 4215. The first slot 4240 is formed near one side and the notched opening 4250 is formed near the other side. The slot 4240 and notched opening 4250 are on opposite sides of the opening 4217. In addition, a thru bore 4260 is formed and is in communication with the opening 4217. The thru bore 4260 receives a set screw (fastener) that can enter the opening 4217.

The slot 4240 and the notched opening 4250 are designed to receive an adjustable strap 4270 that is designed to be tightened so as to capture the patient's finger. More specifically, the patient's finger is captured between the strap 4270 and an upper wall (curved wall) 4219 of the opening 4215. As the strap 4270 is tightened, the space between the strap 4270 and the upper wall 4219 decreases and conversely, as the strap 4270 is loosened, the space increases. The upper wall 4219 can include padding.

The strap 4270 can be formed of any number of different materials so long as the strap 4270 can flex and one end 4271 of the strap can be routed through the clamp by being inserted into the slot 4240 and pass into and through the opening 4215 and then up into and through the notched opening 4217. The other end 4273 of the strap 4270 has an enlarged thickness that prevents it from passing into the slot 4240. When installed, the strap 4270 has a U-shape.

The finger clamp 4200 has a means for releasably locking the strap 4270 in a desired position. More particularly, the means can be in the form of a pivotable lock member 4280 that is disposed within the notched opening 4217. The lock member 4280 pivots about a pin or shaft 4282 that extends across the notched opening 4217. The lock member 4280 has a locking edge 4284 and another edge 4285 that is freely accessible to the operator and can be pressed to cause an unlocking of the lock member 4280. The lock member 4280 is biased to the closed position by biasing members 4286 (e.g., springs) and therefore, the locking edge 4284 is biased against the strap 4270 that passes through the notched opening 4217. The lock member 4280 can thus be thought of as a release button since the operator manipulates the lock member 4280 to cause a release of the strap 4270.

To adjust the position of the strap 4270, the edge 4285 of the lock member 4280 is pressed to cause a pivoting of the lock member 4280 and the locking edge 4284 is removed from contact with the strap 4270. The strap 4270 is now free to move and the operator can adjust the strap 4270 by either pulling the strap 4270 up (to tighten) or by pulling the strap 4270 down (to loosen).

Figure 38:
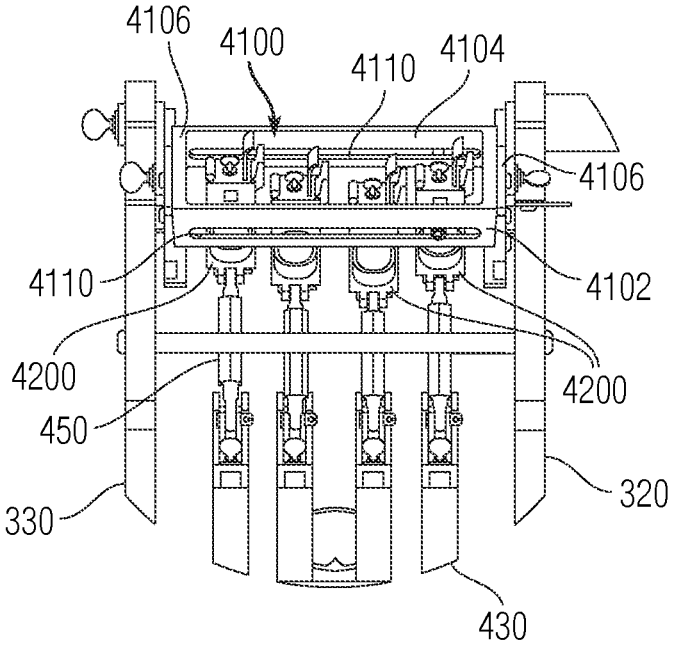
FIG. 38 is a top view of a finger clamp frame and finger clamps that are part of the training device of FIG. 35.

As shown in FIG. 38, at the second end 4214, a pair of spaced tabs or fingers 4220 is formed and each includes an opening 4222. The two openings 4222 are axially aligned with one another. The spaced fingers 4220 permit each finger clamp 4200 to be coupled to a respective mechanical linkage 450 that is connected to one lever 430. The mechanical linkage 450 is attached to the finger clamp 4200 by inserting one end of the linkage 450 between the fingers 4220 and then passing a fastener through opening 4222 in one finger 4220, through an opening in the one end of the linkage 450 and then through the opening 4222 in the other finger 4220. A nut or the like can be used to securely attach the fastener (e.g., a pin or shaft) to the finger clamp 4200. In this manner, each finger clamp 4200 can be attached to the respective levers 430 which are themselves attached to biasing members 440 as described herein. The pivotable lever 430 can thus be raised by lifting the finger clamp 4200 that is directly attached thereto and conversely, the biasing member 440 creates a return force that lowers the lever 430 and the attached finger clamp 4200.

It will be appreciated that the linkage 450 can actually be more than one linkage that is attached between the finger clamp 4200 and the lever 430. For example, the linkage 450 can include a turnbuckle body 451 that is pivotally attached to the finger clamp 4200 and a clevis mount 453 for the turnbuckle body that is pivotally attached between the turnbuckle body and the lever 430.

The finger clamp 4200 can also be selectively coupled to the finger clamp frame 4100 that is pivotally mounted to the ends of the arms 340. In particular, when a respective finger clamp 4200 is to be coupled to the finger clamp frame 4100 a fastener, such as a rod or shaft is passed through the slot 4110 and then passes through the opening 4217 formed in the body of the finger clamp 4200 before then passing through the other slot 4110. In order for the rod (shaft) to be locked in place, a set screw is inserted into the thru bore 4260 and is tightened such that it intimately engages and applies a force against the rod that passes through the opening 4217. In addition, a nut or the like can be used to fasten (attach) the rod to the finger clamp frame 4100.

It will be appreciated that when at least one finger clamp 4200 is coupled to the finger clamp frame 4100, the movement of the finger contained within this finger clamp 4200 in one direction causes the entire frame 4100 to pivot in the same direction. For example, if the isolated finger within the finger clamp 4200 that is connected to the frame 4100 is raised, the frame 4100 will likewise be raised. The slots 4110 allow for some lateral movement of the finger clamp 4200 to better accommodate a particular patient.

It will also be understood that more than one finger clamp 4200 can be operatively coupled to the frame 4100.

In accordance with the present invention, the frame 4100 is coupled to a shaft 4300 that extends through one arm 340 (the innermost arm 340) such that when the frame 4100 pivots relative to and about the arms 340, the shaft 4300 rotates. In other words, when the frame 4100 is raised due to a raising action of at least one finger clamp 4200, the shaft 4300 rotates in a first direction and when the frame 4100 is lowered due to a lowering action of at least one finger clamp 4200, the shaft 4300 rotates in an opposite second direction.

The shaft 4300 that is coupled to one finger clamp frame 4100 is operatively connected to the shaft 4300 that is coupled to the other finger clamp frame 4100 such that rotation of one shaft 4300 is translated into rotation of the other shaft 4300. In this manner and similar to the mechanics of the device 200, the motion of one finger causes a mirror action or motion in the other corresponding finger. For example, if the index finger of the left hand is the healthy finger and the index finger of the right hand is the affected finger, at least one finger (such as the index finger) of the left hand is mounted to a finger clamp 4200 that is attached to the frame 4100. The affected finger (index finger) of the right hand is likewise mounted to a finger clamp 4200 that is attached to the other frame 4100. When the healthy finger is moved, the device 4000 is configured so that the affected finger moves in the same manner similar to the finger motions in the device 200.

In one embodiment, the two shafts 4300 are operatively coupled to one another by means of a gear arrangement that is constructed so that rotation of one shaft 4300 is translated into rotation of the other shaft 4300. In one embodiment, a gear box is used to couple the two shaft 4300 to one another.

Figure 34:
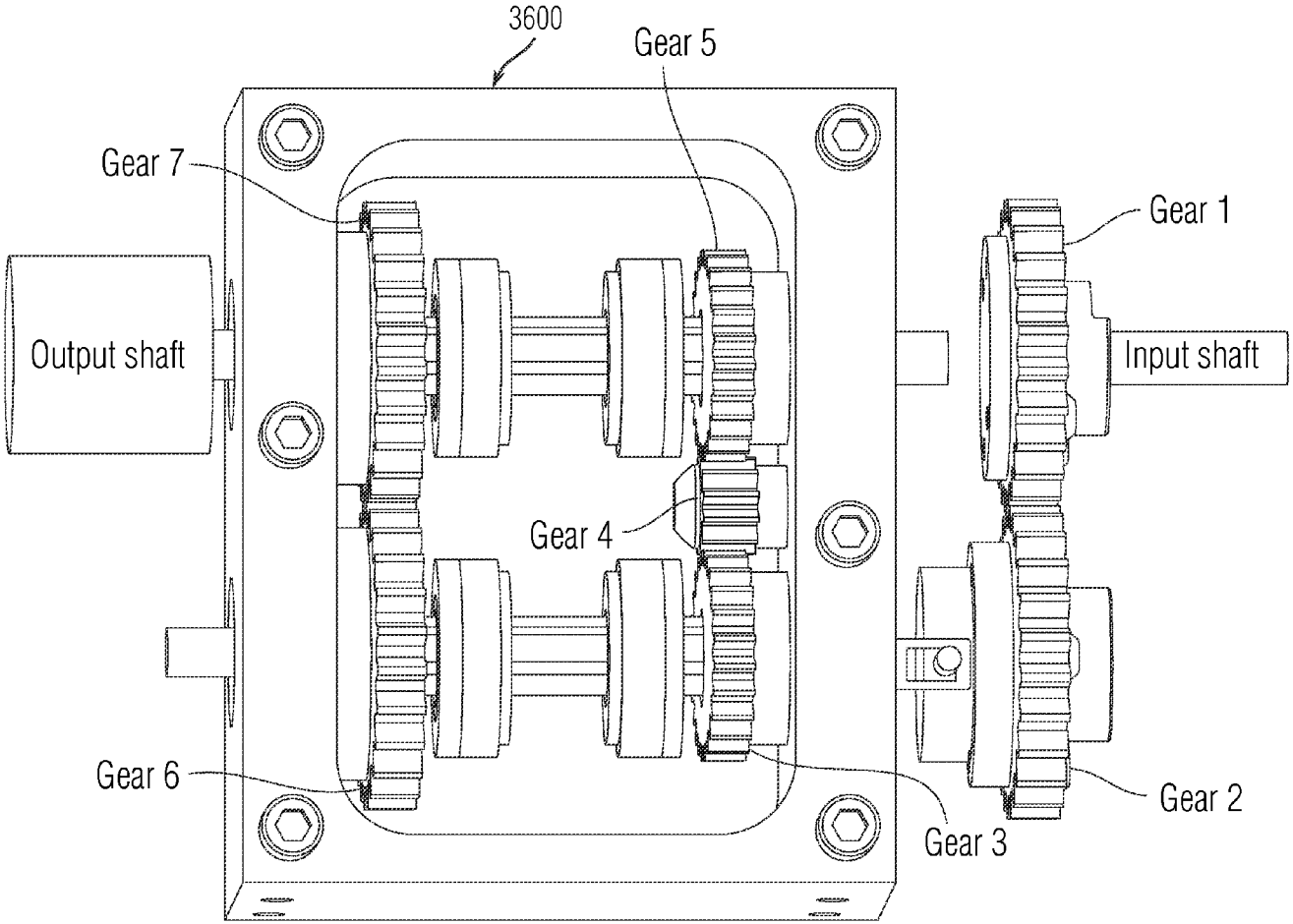
FIG. 34 is a top perspective view of an exemplary gear box.
Figure 35:
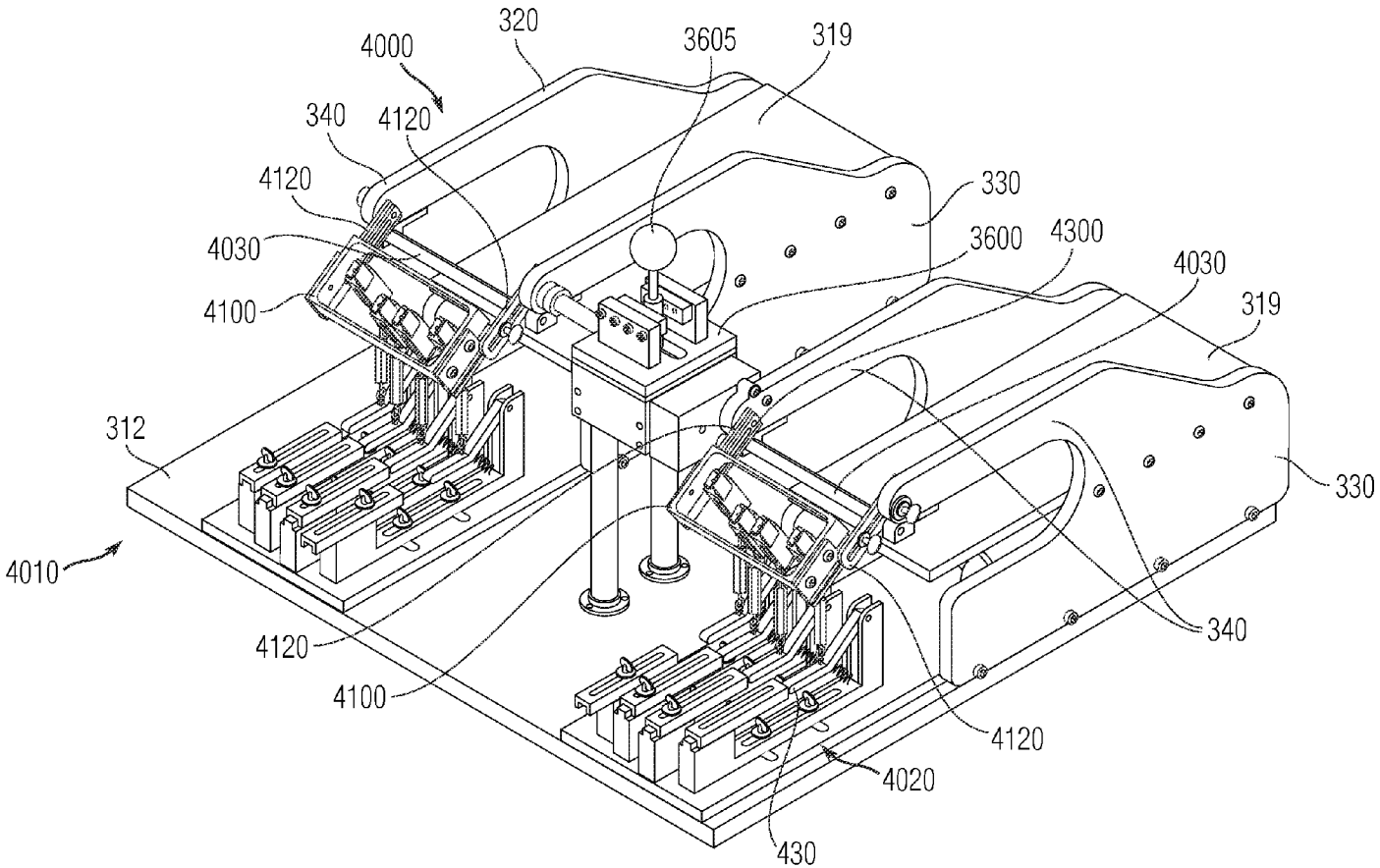
FIG. 35 is a front and top perspective view of a finger extension/flexion training device according to another embodiment of the present invention.
Figure 36:
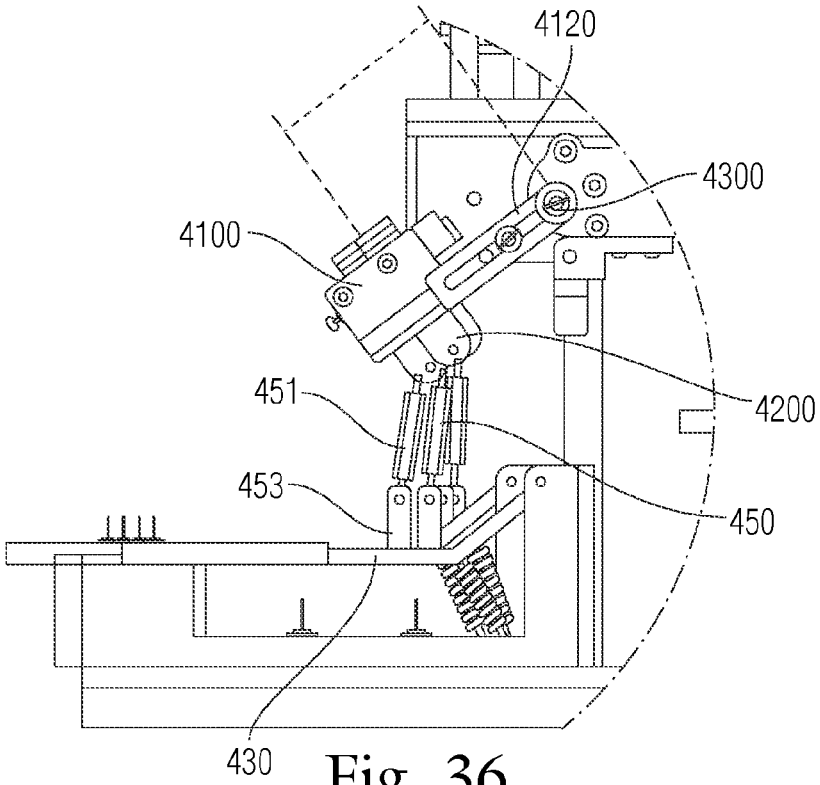
FIG. 36 is a side view of a portion of the training device of FIG. 35.
Figure 37:
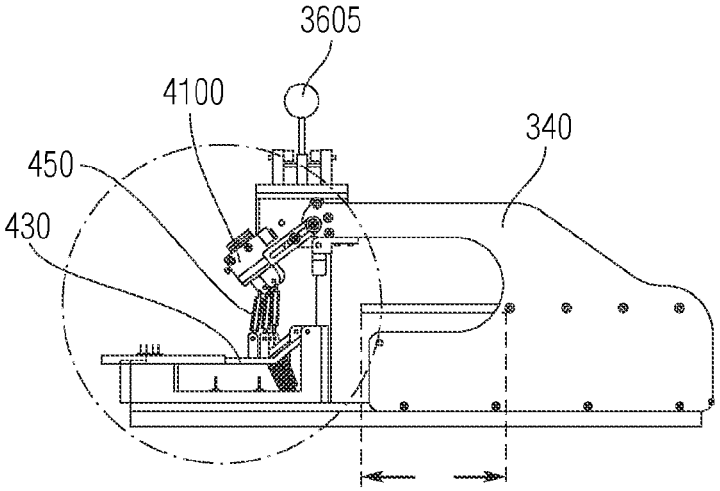
FIG. 37 is a side view of the training device of FIG. 35.

FIG. 34 shows one exemplary first gear box 3600 that includes multiple operating modes. In particular, there are three settings for the gear box 3600: synchronous (in-phase), synchronous (180 deg out-of-phase) (reverse), and independent. In the in-phase synchronous setting, the gear box transmits the rotational force applied by one side to the opposite side in the same direction and at the same time. In the out-of-phase synchronous setting, the gear box transmits the force applied by one side of the body to the opposite side of the body at the same time but in the exact opposite direction. In the independent setting, the two sides of the body perform independently.

There are many possible configurations of the gearing that will produce the three settings. One such configuration is illustrated in FIG. 34. In this configuration a series of either spur (shown in the drawing) or helical gears are arranged in such a manner that circular force applied at the INPUT SHAFT and therefore GEAR 1 can be transferred to GEAR 7 and therefore the OUTPUT SHAFT in one of two manners: in-phase or out-of-phase.

For an in-phase transfer, the gear box is shifted to a position that engages GEAR 3 and GEAR 6. In this gear box setting, GEAR 5 is disconnected from GEAR 7. A clockwise circular force applied at the INPUT SHAFT and therefore GEAR 1 turns GEAR 2 counterclockwise. The counterclockwise motion is maintained during the transfer to GEAR 3 and then GEAR 6. Counterclockwise motion of GEAR 6 then causes GEAR 7 to turn clockwise, which returns the force to the same clockwise direction as the initial input at the INPUT SHAFT.

For the out-of-phase transfer, the gear box is shifted to a position that engages GEAR 3, GEAR 4, GEAR 5, and GEAR 6. In the out-of-phase setting GEAR 3 is disconnected from GEAR 6, which now rotates freely with GEAR 7. A clockwise force at the INPUT SHAFT and therefore GEAR 1 causes GEAR 2 and therefore GEAR 3 to turn counterclockwise. GEAR 3 causes GEAR 4 to turn clockwise. GEAR 4 causes GEAR 5 and therefore GEAR 7 and the OUTPUT SHAFT to turn counter-clockwise, which is the reverse of the initial input at the INPUT SHAFT.

The gear box can also be shifted to a position that disconnects the INPUT SHAFT from the OUTPUT SHAFT.

The connection and disconnection of the various gears can also be achieved by the use of dog clutches, which are shifted to one of three positions depending on the setting (i.e. in-phase, out-of-phase, or independent).

The gear box 3600 can include a selector 3605 that permits the operating mode of the gear box 3600 to be changed into any one of the operating modes, such as the three operating modes. By using the gear box 3600, the rotation of the two shafts 4300 can be in synch or out of synch as described above. It will be appreciated that other mechanisms besides gear box 3600 can be used so long as the mechanism translates motion from one shaft 3400 to the other shaft 3400 in the manner described herein.

For a detailed discussion of the rehabilitative exercises and other features, such as the thumb guard, etc., see the discussion of the device 200.

Finger Abduction-Adduction Trainer

Now referring to FIGS. 20-22B, a finger abduction-adduction trainer (device) 2300 is illustrated. The device 2300 enables a patient with unilateral hand weakness to exercise muscles that adduct and abduct the fingers. Using this device, muscles in the palm of the unaffected hand adduct and abduct its fingers toward and away from the middle finger, and facilitate the same movements in the affected hand.

The device 2300 has two levels and in particular, the device 2300 includes a first base 2310 and a second base 2320 that is spaced above the first base 2310 such that a space is formed between the underside of the second base 2320 and the first base 2310. The bases 2310, 2320 are parallel to one another. The second base 2320 has a width that is less than a width of the first base 2310 and therefore, the second base 2320 only partially covers the first base 2310. The hands rest on the upper level (second base 2320) such that the fingers of both hands extend over the first base 2310.

Figure 20:
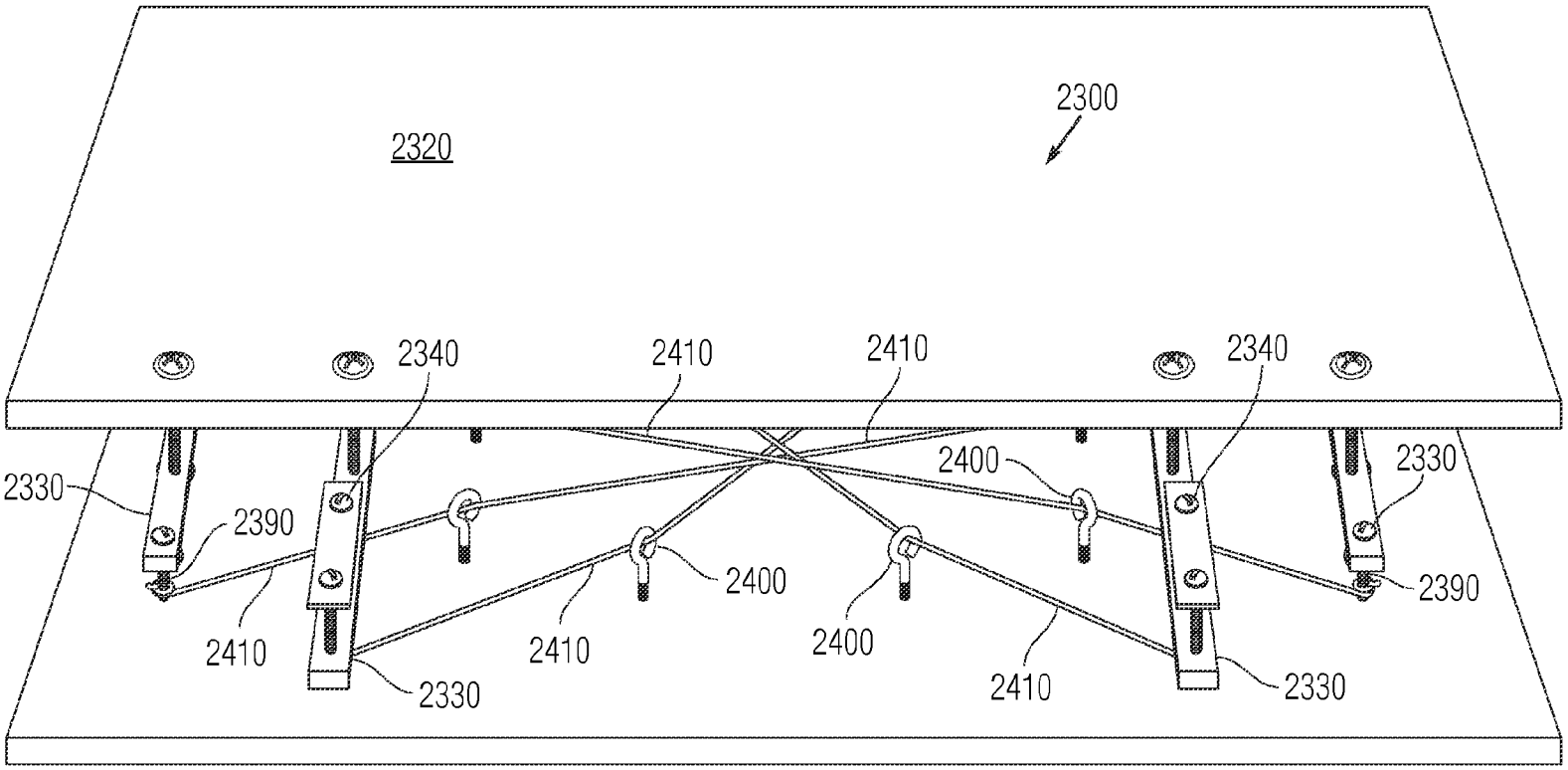
FIG. 20 is a front perspective view of a finger abduction-adduction trainer device according to one embodiment.
Figure 21:
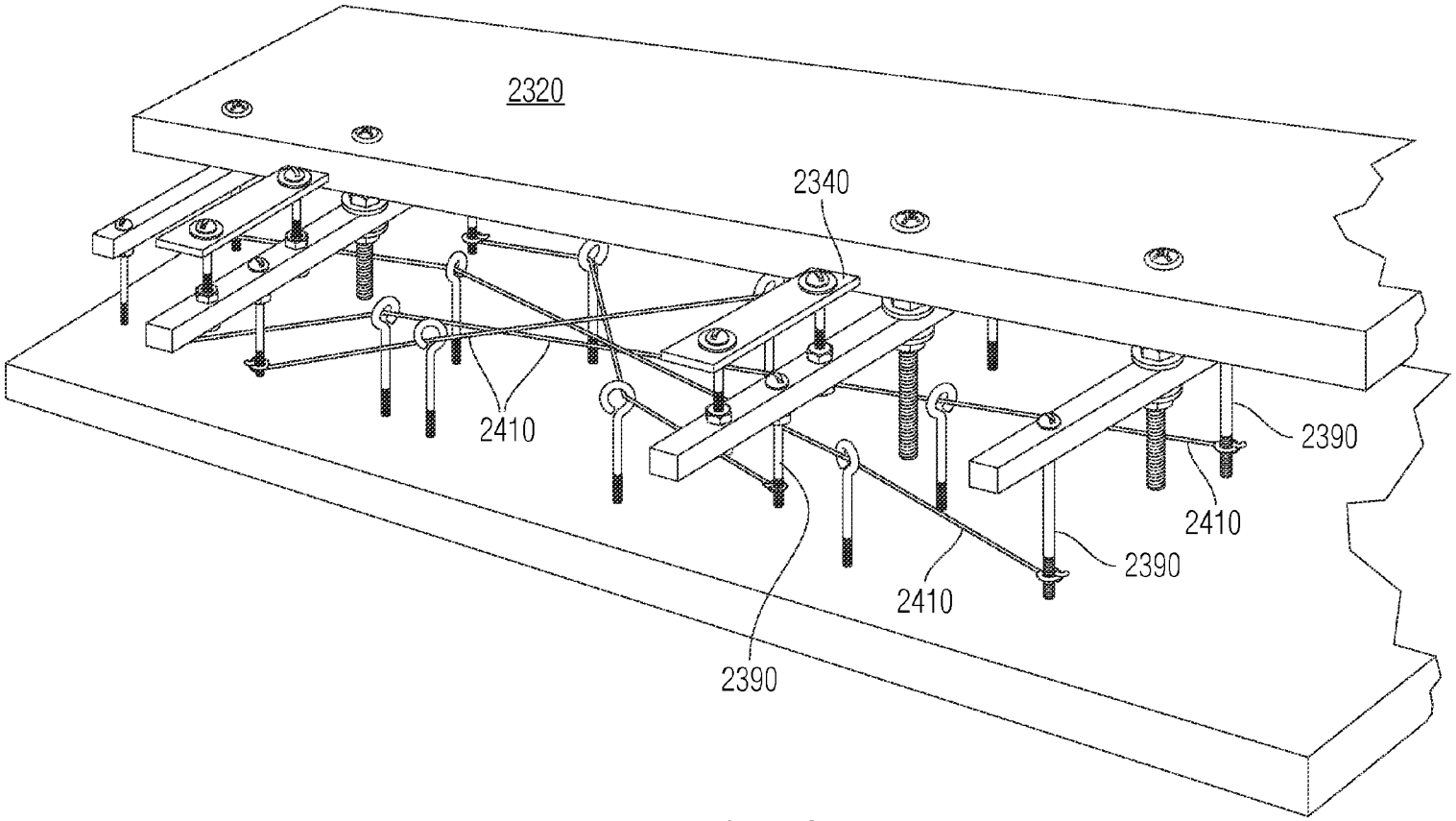
FIG. 21 is a front perspective view of the device of FIG. 20.

The working components of the device 2300 are disposed within the space 2330 and along the first base 2310 and similar to the other embodiments, the device 2300 is configured so that movement of the unaffected fingers by the user is mirrored in movement of the affected fingers. The working components includes a plurality of pivoting levers and in particular, there are eight total pivoting levers since each finger is coupled to a pivotable lever except for the middle fingers of each hand which are fixedly held. In FIGS. 20-21, there are only four pivoting levers 2330 for ease of illustration; however, it will be appreciated once again that there are a total of eight levers 2330 when the device 2300 is fully assembled. The levers 2330 are pivotally mounted at their distal ends to the second base 2320 to permit pivoting of the levers about a pivot point that is perpendicular to the first and second bases 2310, 2320.

The levers 2330 extend outwardly over the first base 2310. In order to support and hold a finger, each of the levers 2330 has a finger/thumb receiving member (not shown) that is contoured and constructed (e.g., concave shaped and can include padding) so that the user's finger is received and held therein. Securement features, such as straps formed of hook and loop material, hold each finger and thumb within their respective receiving member. Since the levers 2330 are located below the plane of the second base 2320, risers 2340 can be used to sufficiently support and elevate the receiving members (not shown) so that when the user' hands rest on the second base 2320, the fingers/thumbs rest comfortably within the receiving members. An upper surface of the risers 2340 lies approximately in the plane containing the upper surface of the second base 2320.

Each of the corresponding matching finger pairs (e.g., index fingers of both hands) are mechanically coupled to one another such that the abduction and adduction movements of the unaffected hand are mirrored in the affected hand. In other words, if the user abducts his/her index finger in the unaffected hand, then the index finger in the affected hand also undergoes an adduction movement due to the mechanical coupling mechanism.

The hand positions and the levers are adjustable to align the pivot point of each finger at the pivot point of its respective lever. In addition, each pivoting lever can be moved along a track 2370 (FIGS. 22-23) to permit accommodation of hands of different sizes. The lever can be locked in place within the track using conventional techniques including the use of a fastener.

Figure 22:
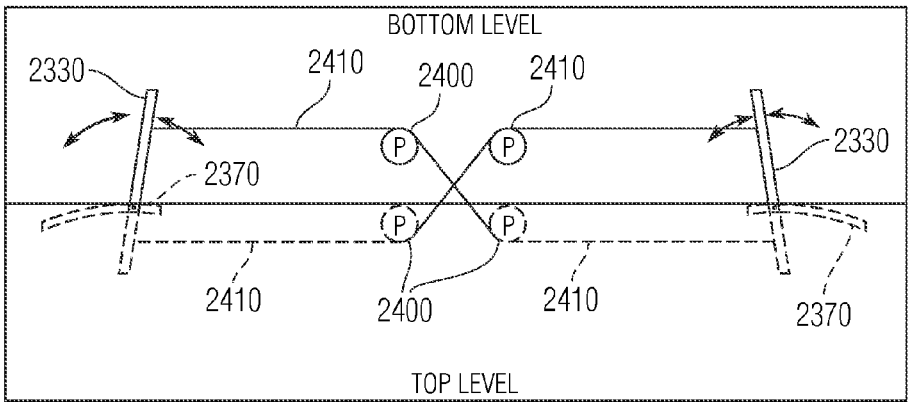
FIG. 22 is top plan view of the working components of a single finger lever of the device of FIG. 20.
Figure 23:
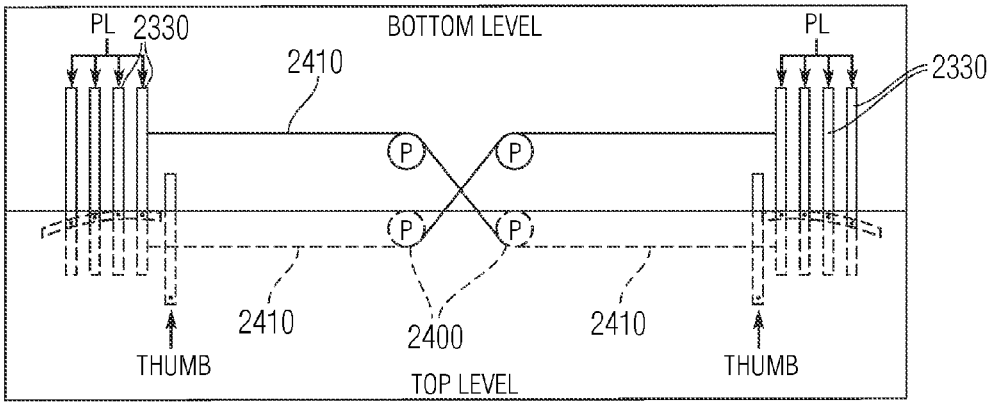
FIG. 23 is a top plan view of the working components of levers for the fingers and thumbs of both hands.

The mechanical coupling mechanism can be any number of different mechanisms including a cable/pulley system, an arrangement of gears, etc. FIGS. 22-23 illustrate a cable and pulley system and FIGS. 20-21 illustrate the groundwork for the cable/pulley system and in particular, in FIGS. 20-21, the eyelets 2400 that are secured to the first base 2310 and extend upwardly therefrom are representative of where pulleys are to be located. Cables 2410 are coupled to the pivoting levers such that each lever has two cables 2410 attached thereto and more specifically, there is a front cable 2410 and a rear cable 2410 for each lever as described below. A first cable is attached to the pivotable lever in front of the pivot point (away from the patient) and the second cable is attached to the pivotable lever in the rear of the pivot point (toward the patient). The attachments front and back are equidistant from the pivot points of each lever.

In FIGS. 20-21, the cables 2410 attach to vertical posts 2390 of the levers 2330. The vertical posts 2390 extend form the undersides of the levers 2330.

The front cable of each lever is routed via two pulleys 2400 to the back attachment point of the lever for the contralateral finger (e.g., the cable attached to the front of the right index finger is routed to and attaches to the back of the left index finger, etc.). The vertical distance of the cable attachment along posts 2390 depends on the location of that particular finger in the device 2300. The attachments for the pinkies are furthest from its levers 2330, while the attachments for the levers 2330 holding the index fingers are closest to the levers 2330. That is, the cable attachments for the most medially positioned homologous pair of fingers are the shortest, while the cables for most laterally positioned homologous pair are the longest.

The cables run parallel to the upper and lower bases 2310, 2320 on their routes to the opposite side. The cables remain parallel to each other and to the bases 2310, 2320. The stacked arrangement of the pulleys forces the cables to remain parallel. Cables from each pair of homologous fingers travel in their own level. The horizontal distance of each attachment from each lever's fulcrum is identical to that of each attachment for that pair of homologous fingers. For example, all cables for the index fingers attach 30 mm from the fulcrums of their respective levers. This ensures that equal movements of each finger results. For example, an abduction of 10° for the right index finger produces an equal abduction for the left index finger.

It will therefore also be appreciated that the pulleys are located within different planes so that the cables likewise lie in different planes to permit cable movement without cables crossing and interfering with one another.

The cables and pulleys are thus placed in such a manner to enable the index and little fingers of the unaffected hand to product identical movements of the index and little fingers of the affected hand.

The device 2300 is also configured for thumb abduction-adduction. The device 2300 enables the unaffected thumb to produce parallel abduction and adduction movements of the affected thumb. Two cables 2410 are attached on opposite sides of each thumb pivoting lever 2330, with one cable 2410 attached to the left side and one on the right side. The cable 2410 on the outside of the unaffected thumb is routed to a pulley 2400 that is horizontally mounted of the device. The pulley 2400 is mounted medially and posterior to the unaffected thumb. The cable 2410 is routed through the pulley 2400 away from the unaffected thumb and then through a narrow cylinder to a second pulley 2400 on the opposite side of the affected thumb. The cable 2410 is then routed through a third pulley and finally attached to the inner side of the pivoting lever on the affected thumb. The outer cable of the affected thumb is similarly connected to the inner side of the lever for the unaffected thumb.

As with the other devices disclosed herein, the device 2300 is cost effective to manufacture while providing the advantages discussed herein.

Figure 24:
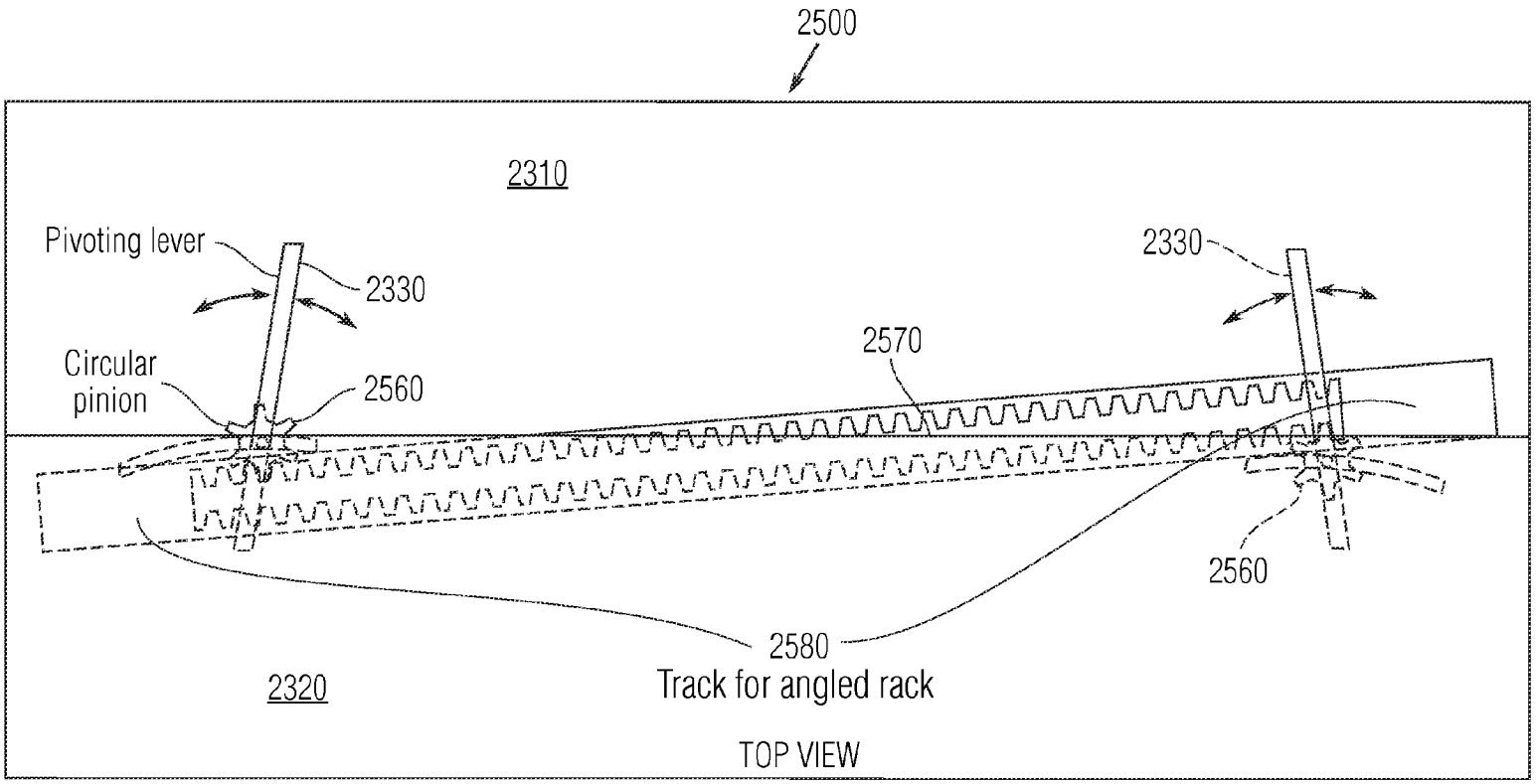
FIG. 24 is a top plan view a finger abduction-adduction trainer device according to another embodiment.
Figure 25:
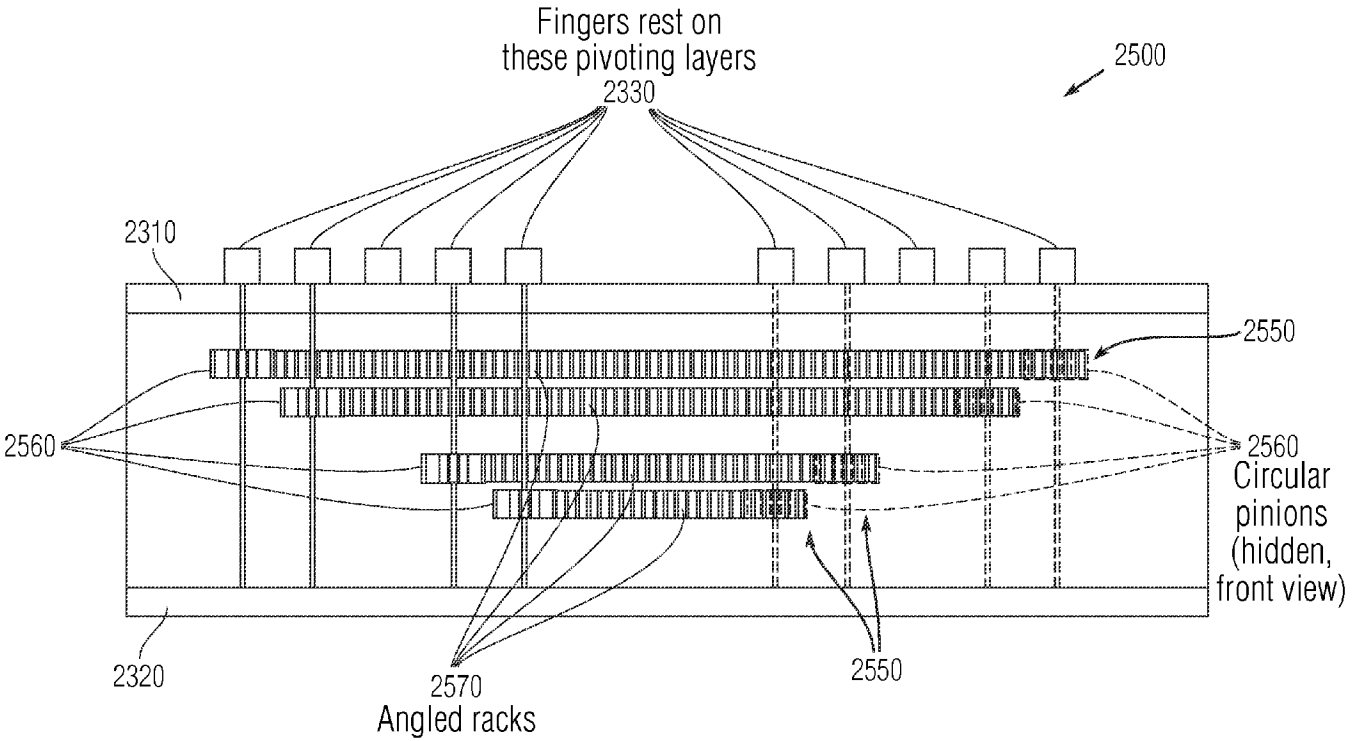
FIG. 25 is a front elevation view of the device of FIG. 24.

Now referring to FIGS. 24-25, a finger abduction-adduction trainer device 2500 according to another embodiment is illustrated. The device 2500 is similar to the device 2300 except for the mechanical means for moving the levers in the desired motions described above. More specifically, the device 2500 includes four rack and pinion gear systems 2550. Once again, the middle fingers of each hand are secured to finger-shaped extensions that extend out in front of the top level (base 2310). FIG. 24 illustrates a gear system 2550 for a pair of levers 2330, with it being understood that the device 2500 contains four such rack and pinion gear systems. The four gear systems 2550 are mounted at four different distances from the base 2310 to the base 2320. The gearing systems 2550 replace the entire pulley and cable systems shown in FIGS. 20-21.

Each gearing system 2550 for each finger includes a pair of pinions 2560 (circular pinions with teeth) and a rack 2570 that is disposed within a track 2580. The pinions 2560 are located at the pivot points of the levers 2330. Abducting the finger will cause one circular pinion 2560 to rotate in one direction and adducting the finger will cause the second circular pinion 2560 to rotate in the opposite direction. These two pinions 2560 are linked by rack 2570. The teeth of one circular pinion 2560 move along the top of the single rack 2570, while the teeth of the second circular pinion move along the bottom of the rack 2570. The rack 2570 is mounted on an angle in order to produce this arrangement. When the left circular pinion 2560 clockwise, the right circular pinion 2560 rotates counterclockwise and vice versa. Behaviorally, when a left finger either abducts (rotating clockwise), the homologous right finger also abducts (which moves it moves counterclockwise).

Forearm Pronation-Supination Rehabilitation Trainer

Now referring to FIGS. 11-14, a device 1000 is provided and is configured to function as a forearm pronation-supination rehabilitative trainer. The device 1000 operates in two modes, namely, a first mode in which the device enables a stroke patient to pronate and supinate the forearm of the unaffected arm in order to facilitate the same movements in the affected forearm and a second arm, in which the device enables a patient to pronate or supinate the unaffected arm in order to facilitate the opposite movement in the affected arm.

The device 1000 includes a housing 1010 that resembles a box in that it includes an interior compartment 1012 that contains the working components of the device 1000. The housing 1010 includes a front surface 1014. The housing 1010 contains a mechanism 1100 that effectuates the above-described movements as described in greater detail below.

Figure 12B:
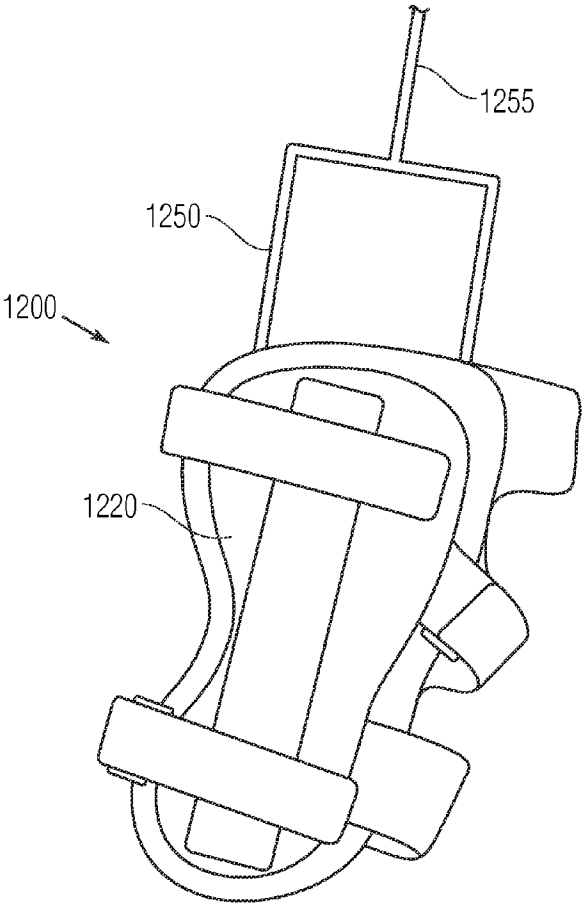
FIG. 12B is a bottom perspective view of the splint.
Figure 12A:
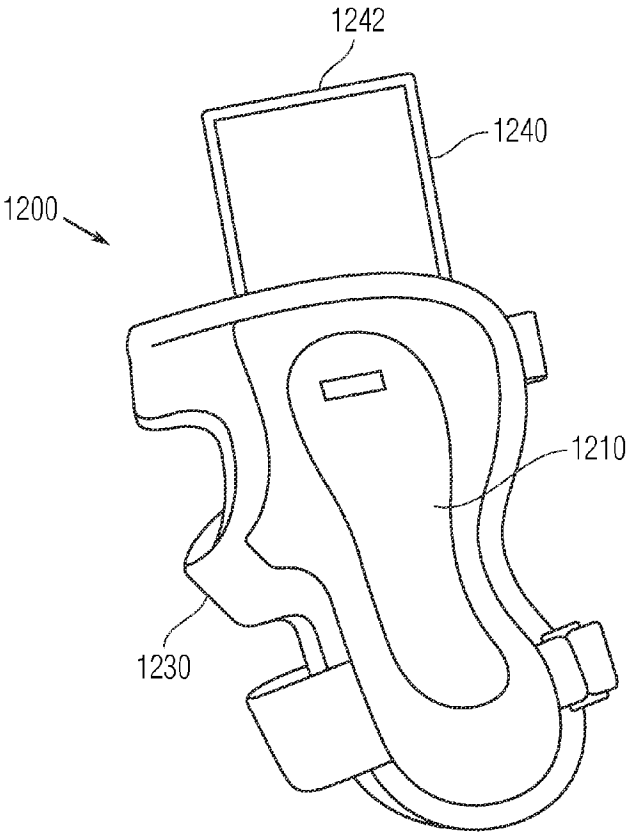
FIG. 12A is a top perspective view of a splint that is used with the device of FIG. 11.
Figure 13:
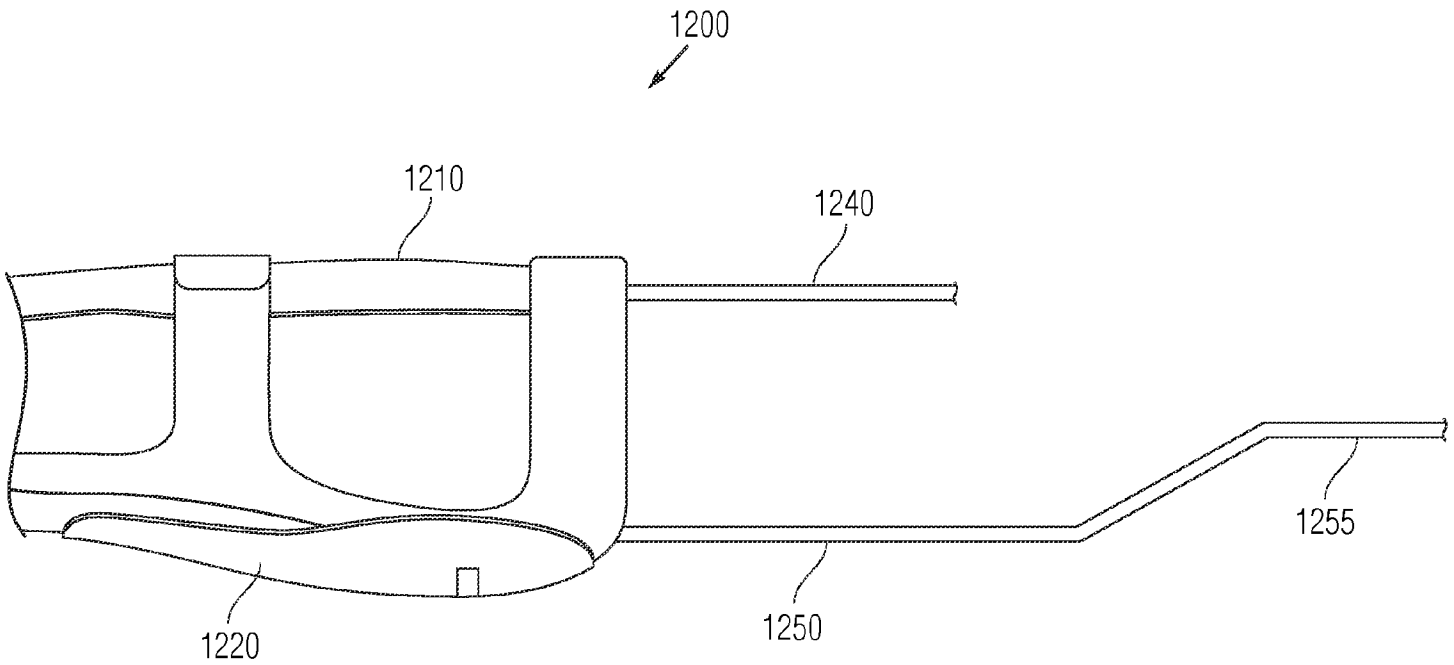
FIG. 13 is a side elevation view of the splint.

The device 1000 includes a pair of splints 1200 that are attached to the patient's arms and are designed to prevent the wrist from flexing and extending while permitting pronation and supination of the forearm. The two splints 1200 are mirror images of one another since one splint 1200 is intended for placement on the left hand, while the other splint 1200 is for placement on the right hand. As shown in FIGS. 12A and 12B, each splint 1200 includes a first part (top part) 1210 and a second part (bottom part) 1220 that together can be assembled in a clam shaped manner in that an attachment member 1230 connects the first part 1210 and the second part 1220. The top part 1210 is thus configured to be placed against the top portion of the hand, while the bottom part 1220 is configured to be placed against the bottom, palm portion of the hand. Each of the top part 1210 and the second part 1220 is open ended to permit reception of the patient's forearm and permit the fingers of the hand to extend beyond the front portions of the parts 1210, 1220.

The first and second parts 1210, 1220 can be releasably and adjustably attached to one another by any number of different means including but not limited to straps 1240 (hook and loop material) that permits the parts 1210, 1220 to attached to one another about the hand of the patient.

The first part 1210 includes a first bar 1240 that extends outwardly from a front end of the first part 1210. The first bar 1240 can have a U-shape and is designed to be grasped and held in the palm of the hand. The first bar 1240 can have a rounded bar 1242 that permits the patient to comfortably grasped in the palm of the hand. The second part 1220 has a second bar 1250 that extends outwardly from the front end of the second part 1220. The bars 1240, 1250 are maintained in a generally parallel manner.

The second bar 1250 includes a shaft component 1255 that extends outwardly from the front end. For example, the second bar 1250 can have T-shape and a more distal bar of the second bar 1250 is adjustable so that it can be adjusted to be just distal to the hand when the hand is in a clenched first position. At a distal end of the shaft 1255, a pinion 1260 is disposed and in particular, the pinion 1260 is in the form of circular pinion.

Figure 11:
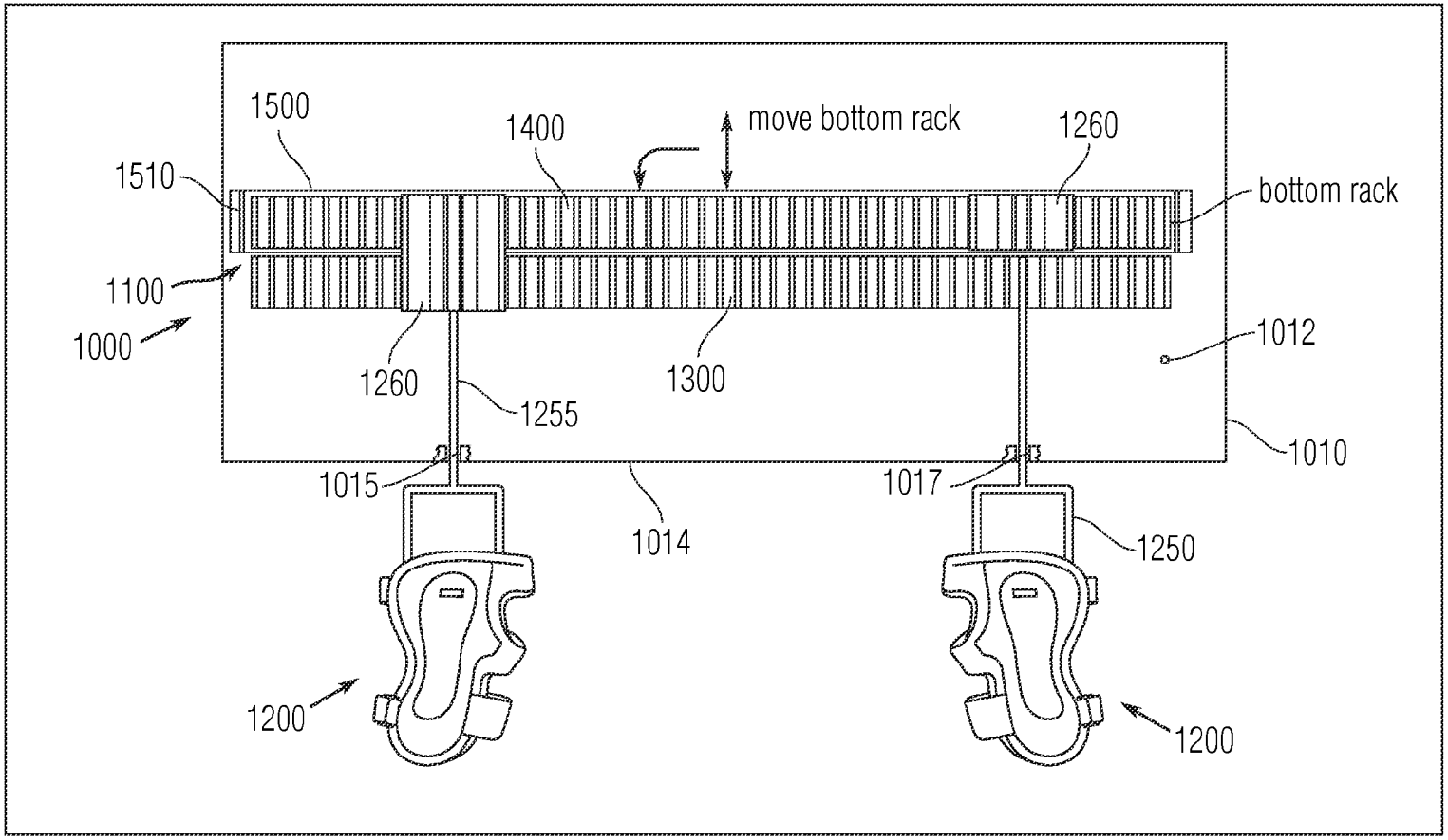
FIG. 11 is a top view, in cross-section, of a forearm pronation-supination rehabilitation trainer according to one embodiment of the present invention.
Figure 14:
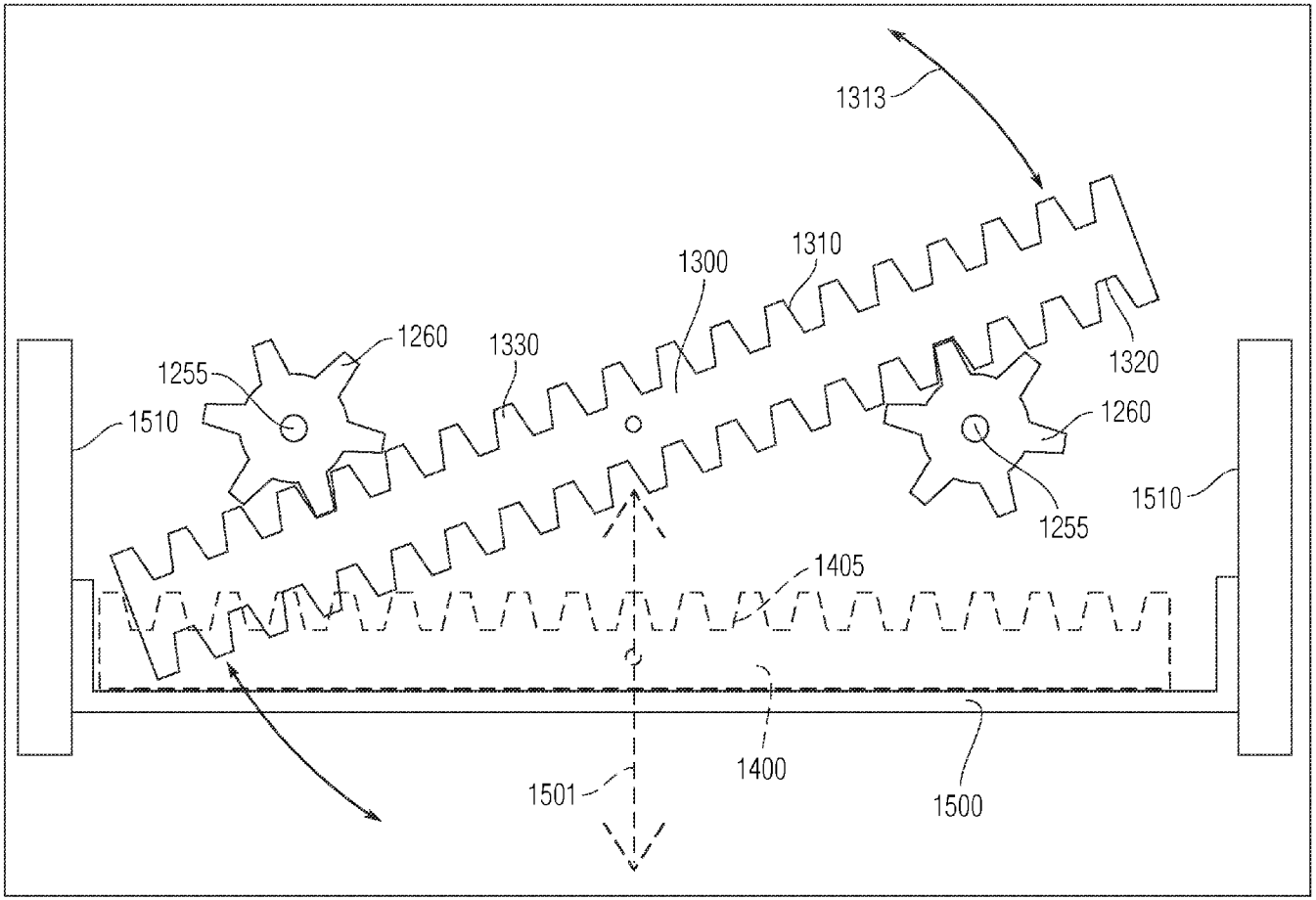
FIG. 14 is cross-sectional front view of a rack and pinion system of the device of FIG. 11.

As shown in FIG. 11, the splints 1200 are fixed laterally within the housing 1010. In particular, the front face 1014 includes a first opening 1015 for receiving the shaft 1255 associated with one splint 1200 and a second opening 1017 for receiving the shaft 1255 associated with the other splint 1200. As shown in FIGS. 11 and 14, the shafts 1255 are arranged parallel to one another and are located in a horizontal plane that is parallel to a ground plane.

The mechanism 1100 includes a first rack 1300 and a second rack 1400 which are associated with the two modes of operation. More specifically, the first rack 1300 is a rack that is disposed at an angle within the housing 1010 and includes a first (top) rack face or surface 1310 and a second (bottom) rack face or surface 1320. Thus, each of the surfaces 1310, 1320 includes a row of teeth 1330.

The first rack 1300 is used in the first mode for a pronation-pronation rehabilitative exercise. In the first mode, the angled rack 1300 extends at an angle between the two pinions 1260 of the two splints 1200 and as a result, the teeth of one pinion 1260 moves along the top surface 1310 of the rack 1300, while the teeth of the other pinion 1260 moves along the bottom surface 1320 of the rack 1300. When the left circular pinion 1260 rotates clockwise, the right circular pinion rotates counterclockwise. Behaviorally, when the left forearm pronates (producing clockwise motion), the right forearm also pronates (a counterclockwise motion).

Rest boxes can be provided for merely supporting the elbows of each arm. These boxes are oriented in front of the housing 1010 and can interlockingly be coupled thereto to prevent movement of the boxes relative to the housing.

As with the other devices, the device 1000, in the first mode, is designed so that pronation of an unaffected forearm causes an identical pronation motion in the affected arm. As with the other devices, one splint and one pinion act as a drive device, while the other splint and pinion are a slave device whose motion is dependent on the motion of the drive device.

In the second mode, the device 1000 enables a patient to pronate or supinate the unaffected arm in order to facilitate the opposite movement in the affected arm. For example, pronating the unaffected arm will aid supination in the affected arm. This is a functional movement in many tasks as for example during folding a towel.

The first rack 1300 is disposed within the housing 1012 such that it can pivot (rotate) within the housing 1012 as shown by arrow 1013. For example, a handle or the like (shaft) can be coupled to the first rack 1300 at the pivot point and be accessible along the front face 1014. Thus, in order to pivot the first rack 1300, the user simply grasps the handle (knob) and rotates the handle to cause rotation of the first rack 1300.

The second rack 1400 includes only one set of teeth 1405 formed along a top face (surface) thereof. In addition, the horizontal second rack 1400 is disposed within a trough or the like 1500 and in particular, the second rack 1400 can freely travel laterally within the trough 1500 (between the ends thereof). The trough 1500 is contained within vertical guide channels 1510 that are formed in opposing ends of the housing 1010.

The trough 1500 can be locked into at least a first position (retracted position) shown in FIG. 14 and a second position (an engaged position) where the trough 1500 moves upwardly in the guide channels 1510 until the second rack 1400 engages the pinions 1260. Similar to the first rack 1300, the second rack 1400 can be moved between and locked into one of the first and second positions. The trough 1500 can be coupled to a handle that is accessible along the front face 1014. The handle can include a knob that can be grasped and a shaft can be attached to the trough 1500. The shaft can pass through a vertical slot formed in the front face 1014 and include locking apertures along the vertical slot to permit the shaft to move vertically and be locked into one of the first and second positions. The arrow 1501 shows the motion of the trough 1500 and second rack 1400 between the two positions.

The second mode is achieved by rotating the angled rack 1300 out of engagement and then moving the second horizontal rack 1400 into position (engaged position) to intersect with the teeth of both circular pinions 1260. In this second mode, the circular pinions 1260 rotate in the same direction; that is, either both rotate clockwise or both rotate counterclockwise. This action is made possible since the second rack 1400 can freely move laterally within the trough 1500.

Once again and as with the other embodiments, the device 1000 can be used by patients in home settings. The device 1000 is simple to use and a family member or friend can assist in the setup. The device 1000 is very cost effective in terms of manufacturing costs compared to existing devices that use electrical stimulation to induce muscle contractions in the affected arm and when compared to costs associated with visits to a physical therapist.

Now referring to FIGS. 30-34, a device 3000 is provided and is configured to function as a forearm pronation-supination rehabilitative trainer. The device 3000 is similar to the device 1000 but includes additional operating modes and different comfort features to position the patient in a more optimal rehabilitative position. The device 3000 includes a base plate 3010 that includes a front edge 3012, an opposing rear edge 3014, a first side edge 3016, and a second side edge 3018. The base plate 3010 is part of the overall frame of the device 3000. The base plate 3010 includes an opening 3020 and a plurality of slots 3030 is formed therein. The slots 3030 are linear slots that are parallel to one another and terminate at one end proximate the first side edge 3016.

The frame of the device 3000 also includes a vertical wall 3040 that is coupled to the rear edge 3014 such that the wall 3040 extends vertically and is perpendicular to the base plate 3010. As shown, the wall 3040 can be a partially hollow structure and in the illustrated embodiment, the wall 3040 is a hollow rectangle frame member with a diagonal support member extending between two corners of the wall 3040. Any number of different fasteners can be used to attach the wall 3040 to the rear edge 3014.

The frame of the device 3000 also includes a pair of mounting vertical plates 3050. Each plate 3050 includes a bottom end 3052 that attaches to the opposing side edges 3016, 3018 and an opposite top end 3054. The plates 3050 are attached to the side edges 3016, 3018 at locations proximate the wall 3040.

The device 3000 also includes a pair of elbow support members and more specifically, the device 3000 includes a fixed elbow support member 3100 and a movable elbow support member 3200. The fixed elbow support member 3100 includes a base plate 3110 that has a pair of parallel tracks formed therein along side edges thereof. The base plate 3110 has a plurality of openings 3112 formed therein for receiving fasteners that pass therethrough and pass through openings 3015 that are formed in the base plate 3010 near and along the second side edge 3018. The multiple openings 3112, 3015 permit the base plate 3110 to be moved to adjust the degree or length of the base plate 3110 that extends beyond the front edge 3012 of the base plate 3010.

The elbow support member 3100 includes a lower elbow plate 3120 that has a C-channel member 3125 in the formed of a rail attached thereto along an upper surface of the plate 3120. The support member 3100 includes a second elbow plate 3130 that has at one end a bottom elbow pad plate 3132 and at an opposite end has a base plate 3134. In between the two plates 3132, 3134, a rail (slotted C-channel) 3136 is provided and is complementary to the C-channel member 3125 such that when the two members 3125, 3136 mate together, the second elbow plate 3130 can be adjusted linearly relative to the lower elbow plate 3120.

The bottom elbow pad plate 3132 receives a bottom elbow pad 3137 which is in the form of a cushion. In the illustrated embodiment, the plate 3132 and pad 3137 have a square or rectangular shape. The base plate 3134 provides a support surface for an adjustable elbow pad that angle of which can be varied. In particular, an upper elbow pad plate 3140 is pivotally attached to the base plate 3134 at one end thereof. For example, a hinge 3141 can be used to attach the pad plate 3140 to the base plate 3134. The upper elbow pad plate 3140 receives and is coupled to an upper elbow pad 3145 (cushion). In the illustrated embodiment, the plate 3140 and the pad 3145 are rectangular shape.

The angle of the upper elbow pad plate 3140 and the pad 3145 is adjusted relative the base plate 3134 using a height adjusting means and in particular, the means can include a block 3150 that is disposed between the pad plate 3140 and the base plate 3134 and therefore, the block 3150 prevents the upper elbow pad plate 3140 from seating flush against the base plate 3134. The block 3150 can be a tangent block that has a curved (convex) upper surface. The height adjusting means also includes a shaft 3160 (e.g., a jack shaft) and a hand nut 3170 or other structure to permit rotation of the shaft 3160. The shaft 3160 passes through an opening (e.g., threaded bore) formed in the plate 3134 and rotation of the hand nut 3170 causes the block 3150 either to be raised relative to the plate 3134 or lowered depending upon the direction of rotation. In order to increase the angle between the upper elbow pad 3145 and the base plate 3134, the hand nut 3170 is rotated in one direction to cause the block 3150 to be driven into contact and pivot the pad 3145 upward. Conversely, the pad 3145 is lowered by simply rotating the hand nut 3170 in the opposite direction.

It will therefore be appreciated that the elbow support member 3100 can be adjusted in several directions and in particular, the support member 3100 can be adjusted linearly so that it moves forward or rearward relative to the front edge 3012 of the base plate 3010. In addition, the angle of the upper elbow pad plate 3140 and the pad 3145 can be adjusted. Both of these adjustments are designed to accommodate different sized patients and permit the patient to be comfortable when using the device 3000. The patient will be in a seated position when using the device 3000.

The movable elbow support member 3200 is similar to the fixed elbow support member 3100 and therefore, like elements are numbered alike. However, the support member 3200 includes an additional degree of adjustment. More specifically, the lower elbow plate 3120 of the support member 3200 has an outwardly extending tab 3210 formed along one side thereof. The tab 3210 can have a rectangular shape. The tab 3210 includes a number of openings 3212 arranged linearly. Fasteners 3220 are received within at least some of these openings 3212 for coupling the member 3200 to the base plate 3010 in a manner in which lateral movement and lateral adjustment of the support member 3200 is possible.

The fasteners 3220 are received within different slots 3030 to permit the above described adjustment. The fasteners 3220 can include shafts (rods) and hand nuts. To fixedly attach the support member 3200 to the base plate 3010, the hand nuts are simply tightened. To adjust the support member 3200 in a lateral direction, the hand nuts are loosened and the support member 3200 is moved laterally (with the shafts riding within the slots 3030) until the proper location is reached at which time the hand nuts are tightened.

By permitting support member 3200 be adjustable relative to the support member 3100, the device 3000 accommodates different sized patients. For example, larger sized patients require the elbow support members 3100, 3200 to be spread apart a further distance compared to a smaller patient. In an optimal rehabilitative position, the elbows of the patient are separated a comfortable distance, such as the distance between the shoulders, resulting in the elbows and arms being comfortably separated.

The device 3000 also includes a pair of sliding side plates 3250. The side plate 3250 includes a plurality of slots 3252 formed therein. One or more of the slots 3252 can receive fasteners 3254.

The device 3000 further includes a top assembly 3300 that includes a number of the working components of the device 3000. As described herein and according to one embodiment, the top assembly 3300 includes a pair of handle assemblies 3400 that are operatively coupled to one another to permit a number of different operating modes to be selected during the rehabilitative exercise. In particular and as described below, a first operating mode is where one handle assembly 3400 moves in an opposite direction (opposite rotation) relative to the other; a second operating mode is a neutral position where one handle assembly 3400 can freely move (rotate) relative to the other handle assembly 3400 (i.e., the handle assemblies 3400 are detached from one another) and a third operating mode where one handle assembly 3400 moves (rotates) in the same direction as the other handle assembly 3400.

The top assembly 3300 includes a frame 3302 that contains the various working components and can be in the form of a rectangular box like structure that has a first end 3304 and an opposing second end 3306. The frame 3302 is thus a hollow structure that contains the working components as described below.

The handle assembly 3400 includes a handle back plate 3410 and a handle rod plate 3420 that is attached to one end of the back plate 3410 (e.g., attached at a right angle). A portion of the back plate 3410 includes an arm pad 3430. A handle grip assembly 3430 is attached to and extends outwardly from the handle rod plate 3420. The grip assembly 3430 includes a pair of spaced rods (shafts) 3435 that extend outwardly from the handle rod plate 3420 and a handle rod (shaft) 3450 that extends between the spaced rods 3435. A hand grip pad 3460 is disposed about the handle rod 3450. The hand grip pad 3460 is spaced from the plate 3420 by the rods 3435. In use, the patient's hand and forearm are placed into the handle assembly 3400 such that the forearm faces and contacts the arm pad 3430, with the patient's hand being disposed about the hand grip pad 3460.

On the backside of the handle rod plate 3420, a shaft 3500 is fixedly attached thereto and extends outwardly therefrom. The pair of handle assemblies 3400 can be thought of as a left hand assembly 3400 and a right hand assembly 3400. Each of the handle assemblies 3400 is coupled to the working components in the frame 3202 as described below. A front face of the frame 3202 includes an opening through which the shaft 3500 of the right hand assembly 3400 extends. As shown in the figures, the shaft 3500 can be thought of as an input shaft.

One of the working components that is contained within the frame 3202 is a first gearbox 3600 that translates motion of the shaft 3500 of the right hand assembly 3400 to the shaft 3500 of the left hand assembly 3400. The first gearbox 3600 is located proximate the second end 3306. The working components also include a rotatable cross shaft 3610 that is at least partially contained within a sleeve 3620. The cross shaft 3610 can be of a telescopic construction or another type of construction where the length of the cross shaft 3610 can be varied.

Within the interior of the frame 3202, a second gearbox 3615 is disposed at or proximate the opposing first end 3304. Unlike the first gearbox 3600, which is fixed in place in the interior of the frame 3202, the second gearbox 3615 is movable within the interior of the frame 3202. For example, a track or the like 3625 can be disposed within the frame 3202 and the second gearbox 3615 is coupled thereto and movable (linearly) along the track to permit the distance between the two gearboxes 3600, 3615 to be varied (closer or further apart). The cross shaft 3610 is received within an opening formed in the second gearbox 3615. This end of the cross shaft 3610 can be thought of as an input shaft. The cross shaft 3610 is coupled to the shaft 3500 of the left hand assembly 3400 through the second gear box 3615 such that rotation of the cross shaft 3610 is translated into rotation of the shaft 3500 of the left hand assembly 3400.

It will be appreciated that any number of different gear assemblies can be used so long as the rotation of the shaft 3500 of one of the left and right hand assemblies 3400 is translated into rotation of the other of the left and right hand assemblies 3400. For example, the second gear box 3615 can include several pinion gears to translate rotation of the cross shaft 3610 into rotation of the shaft 3500 of the left hand assembly 3400. The first gear box 3615 similarly includes gears that mesh with one another to translate rotation of the shaft 3500 of the right hand assembly 3400 into rotation of the cross shaft 3610.

FIG. 34 shows one exemplary first gear box 3600 that includes multiple operating modes. In particular, there are three settings for the gear box 3600: synchronous (in-phase), synchronous (180 deg out-of-phase) (reverse), and independent. In the in-phase synchronous setting, the gear box transmits the rotational force applied by one side to the opposite side in the same direction and at the same time. In the out-of-phase synchronous setting, the gear box transmits the force applied by one side of the body to the opposite side of the body at the same time but in the exact opposite direction. In the independent setting, the two sides of the body perform independently.

There are many possible configurations of the gearing that will produce the three settings. One such configuration is illustrated in FIG. 34. In this configuration a series of either spur (shown in the drawing) or helical gears are arranged in such a manner that circular force applied at the INPUT SHAFT and therefore GEAR 1 can be transferred to GEAR 7 and therefore the OUTPUT SHAFT in one of two manners: in-phase or out-of-phase.

For an in-phase transfer, the gear box is shifted to a position that engages GEAR 3 and GEAR 6. In this gear box setting, GEAR 5 is disconnected from GEAR 7. A clockwise circular force applied at the INPUT SHAFT and therefore GEAR 1 turns GEAR 2 counterclockwise. The counterclockwise motion is maintained during the transfer to GEAR 3 and then GEAR 6. Counterclockwise motion of GEAR 6 then causes GEAR 7 to turn clockwise, which returns the force to the same clockwise direction as the initial input at the INPUT SHAFT.

For the out-of-phase transfer, the gear box is shifted to a position that engages GEAR 3, GEAR 4, GEAR 5, and GEAR 6. In the out-of-phase setting GEAR 3 is disconnected from GEAR 6, which now rotates freely with GEAR 7. A clockwise force at the INPUT SHAFT and therefore GEAR 1 causes GEAR 2 and therefore GEAR 3 to turn counterclockwise. GEAR 3 causes GEAR 4 to turn clockwise. GEAR 4 causes GEAR 5 and therefore GEAR 7 and the OUTPUT SHAFT to turn counter-clockwise, which is the reverse of the initial input at the INPUT SHAFT.

The gear box can also be shifted to a position that disconnects the INPUT SHAFT from the OUTPUT SHAFT.

The connection and disconnection of the various gears can also be achieved by the use of dog clutches, which are shifted to one of three positions depending on the setting (i.e. in-phase, out-of-phase, or independent).

It will be appreciated that when there are different operating modes, different rehabilitative exercises can be performed (e.g., the hand assemblies 3400 rotate in same or opposite directions).

The top assembly 3300 is oriented at a particular degree relative to the base plate 3010 and in particular, the top assembly 3300 is oriented at 45 degrees relative to the base plate 3010.

As mentioned above, the device 3000 has a number of features that permit the adjustment of the movable elbow support member 3200 and the left handle assembly 3400 as when a smaller patient uses the device 3000. Since the left handle assembly 3400 moves laterally, a slide element or handle (e.g., a push rod) 3490 is provided and passes through an opening in one end of the frame 3202 and is fixedly attached to the movable second gear box 3615. This permits movement (linear movement) of the handle 3490 to be translated into movement of the second gear box 3615 along the track 3625 to permit the distance between the two gearboxes 3600, 3615 to be varied (closer or further apart). In order to allow for lateral movement of the shaft 3500 of the left hand assembly 3400, the shaft 3500 rides within a slot formed linearly across the front face of the frame 3202. In this way, all of the shafts and gears remain coupled to one another while permitting the device 3000 to be adjustable to accommodate different sized patients.

The operation of the device 3000 is similar to the device 1000 and is used in forearm pronation-supination rehabilitation. By maintaining the "box" (assembly 3300) at a 45 degree angle or some other angle, the arm is likewise held at the same or substantially the same angle (e.g., arm is at 45 degrees).

Wrist Trainer

Figure 15:
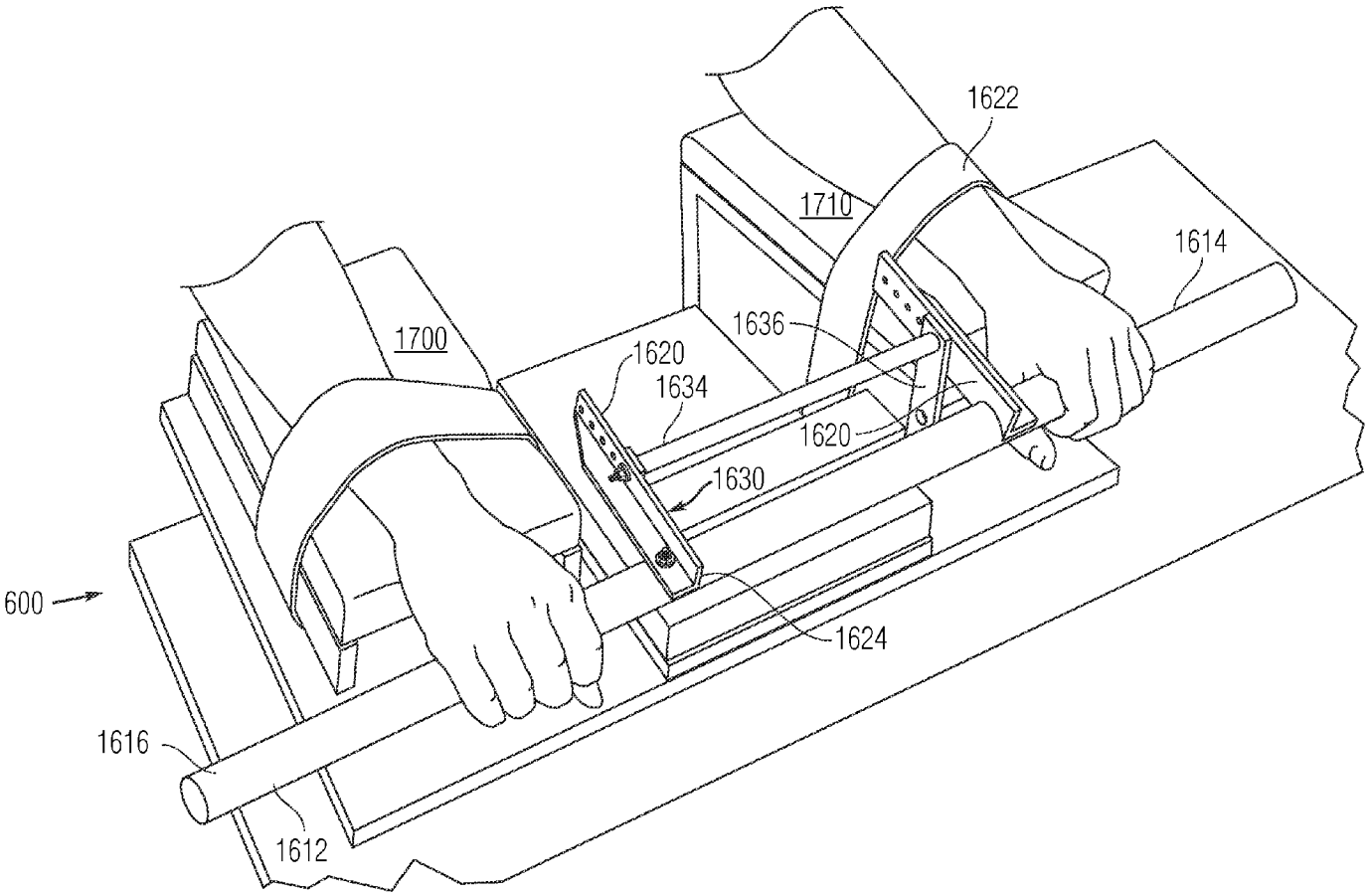
FIG. 15 is a front perspective view of a wrist training device according to a first embodiment.
Figure 16:
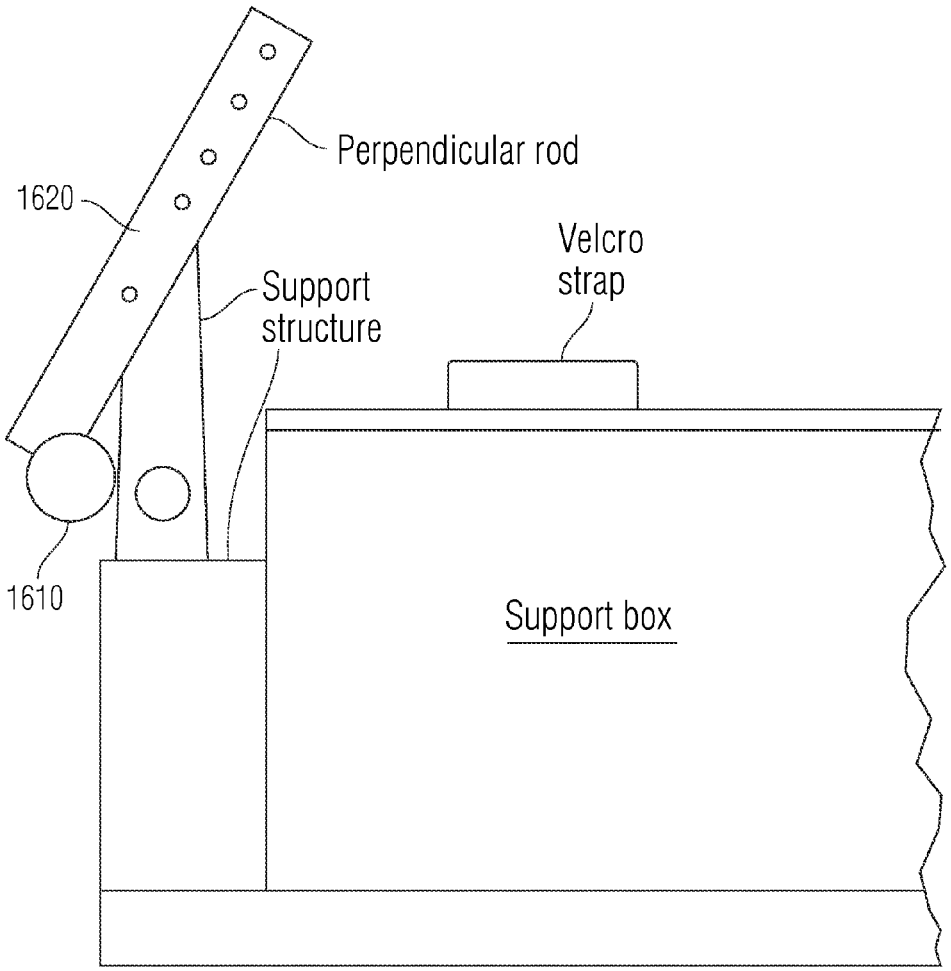
FIG. 16 is a side view of the wrist training device of FIG. 15.

Now referring to FIGS. 15-16, a wrist trainer 1600 is shown. The wrist trainer 1600 enables a stroke patient to use his/her unaffected wrist (and unaffected brain) to facilitate substantially symmetrical movements with the affected wrist. The underlying principle, as discussed hereinbefore, is that rehabilitation of an affected wrist can be facilitated by increasing the participation of the brain's intact motor systems in causing the affected wrist to move.

The wrist trainer 1600 enables alternating wrist flexion and extension. The wrist trainer 1600 includes a handle 1610 around which the patient grasps with their hands (shoulder width apart). As shown in FIG. 15, the handle 1610 can be a single member in which two end portions 1612, 1614 thereof represent the portions that are grasped by the patient. The handle 1610 can alternatively be two separate handle members. The trainer 1600 also includes a pair of connecting members 1620 that are attached to the handle 1610 in a perpendicular manner. The connecting members 1620 can be brackets, etc., and include distal free ends 1622. Opposite ends 1624 are fixed to the handle 1610.

The wrist trainer 1600 includes a center support structure 1630 to which the handle 1610 is pivotally attached. More specifically, the center support structure 1630 includes a pair of upstanding support members 1632 and a horizontal support member 1634 that extends between upper ends of the upstanding support members 1632. The connecting members 1620 are pivotally attached to the center support structure 1630. The connecting members 1620 are adjustable relative to the center support structure 1630 and in particular, each of the connecting members 1620 includes a series of openings through which a fastener is received for pivotally attaching the connecting members 1620 to the center support structure 1630.

The wrist trainer includes first and second forearm support members 1700, 1710 on which the forearms of the patient are placed. The forearms are secured to the support members 1700, 1710 using securing members, such as straps formed of hook and loop material). When the forearms are placed on the support members 1700, 1710, the patient's hands extend forward and grasp the handle 1610. In operation, the unaffected hand pivots (raises) the handle 1610 from a rest position to cause an extension/flexion motion in the wrist. Since the affected hand likewise grasps the same handle 1610, the affected hand and wrist undergoes extension/flexion.

Figure 17:
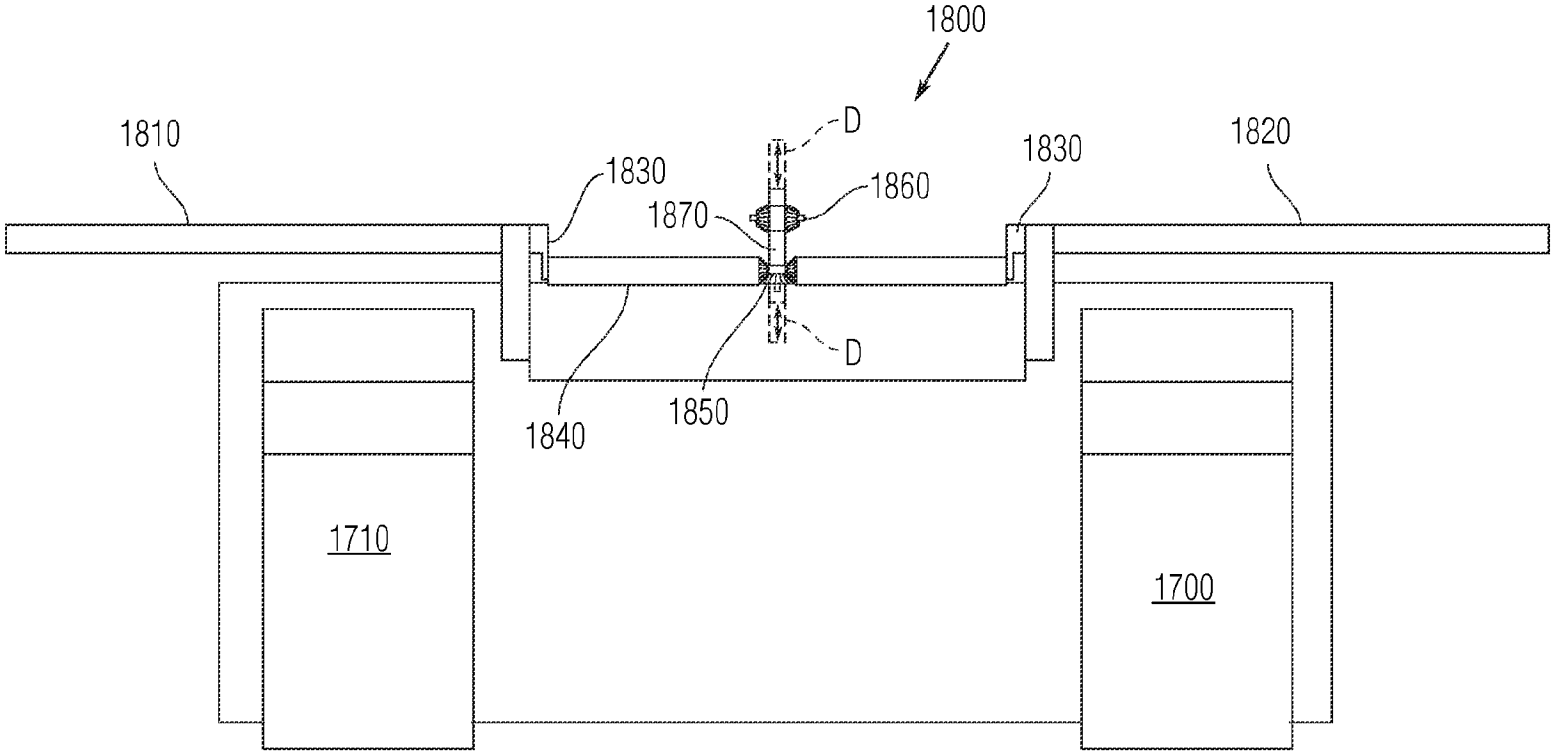
FIG. 17 is a top plan view of a wrist training device according to a second embodiment.

FIG. 17 shows a wrist trainer 1800 according to another embodiment. The wrist trainer 1800 is similar to the trainer 1600; however, it includes several differences. In particular, the trainer 1800 includes first and second handle segments 1810, 1820 (e.g., round handles). A pair of rods or the like 1830 are attached perpendicularly to the handle segments 1810, 1820 such that the handle segments 1810, 1820 can freely pivot (swing) in an arc. A pair of central horizontal connecting rods 1840 is attached to the perpendicular rods 1830 at the center of the arc. The trainer 1800 also includes first and second gears 1850, 1860, respectively, that that links the connecting rods 1840 one at a time.

The trainer 1800 includes the first and second forearm support members 1700, 1710 on which the forearms of the patient are placed and a support structure 1870 to which the connecting rods 1840 are attached. The attachments of the two perpendicular rods 1830 to the connecting rods 1840 are adjustable to permit differences in patient's hand and wrist size. The adjustability permits the center of the arc to be exactly between the pivot points of the left and right wrists as they extend and flex.

The first and second gears 1850, 1860 links the two connecting rods 1840 so that the motion of one control the motion of the other. The first gear 1850 (alternation gear) causes the two connecting rods 1840 to move in opposite directions, while the second gear 1860 (synchronous gear) causes the connecting rods 1840 to move in the same direction. At any time, only one of the two gears 1850, 1860 engages the connecting rods 1840. The movement of the connecting rods 1840 then causes the handle segments 1810, 1820 to move either alternative (if the first gear 1850 is engaged) or synchronous (if the second gear 1860 is engaged). The two gears 1850, 1860 are mounted on a track 1870 that adjusts to one of the two gear engagement positions.

Figure 41:
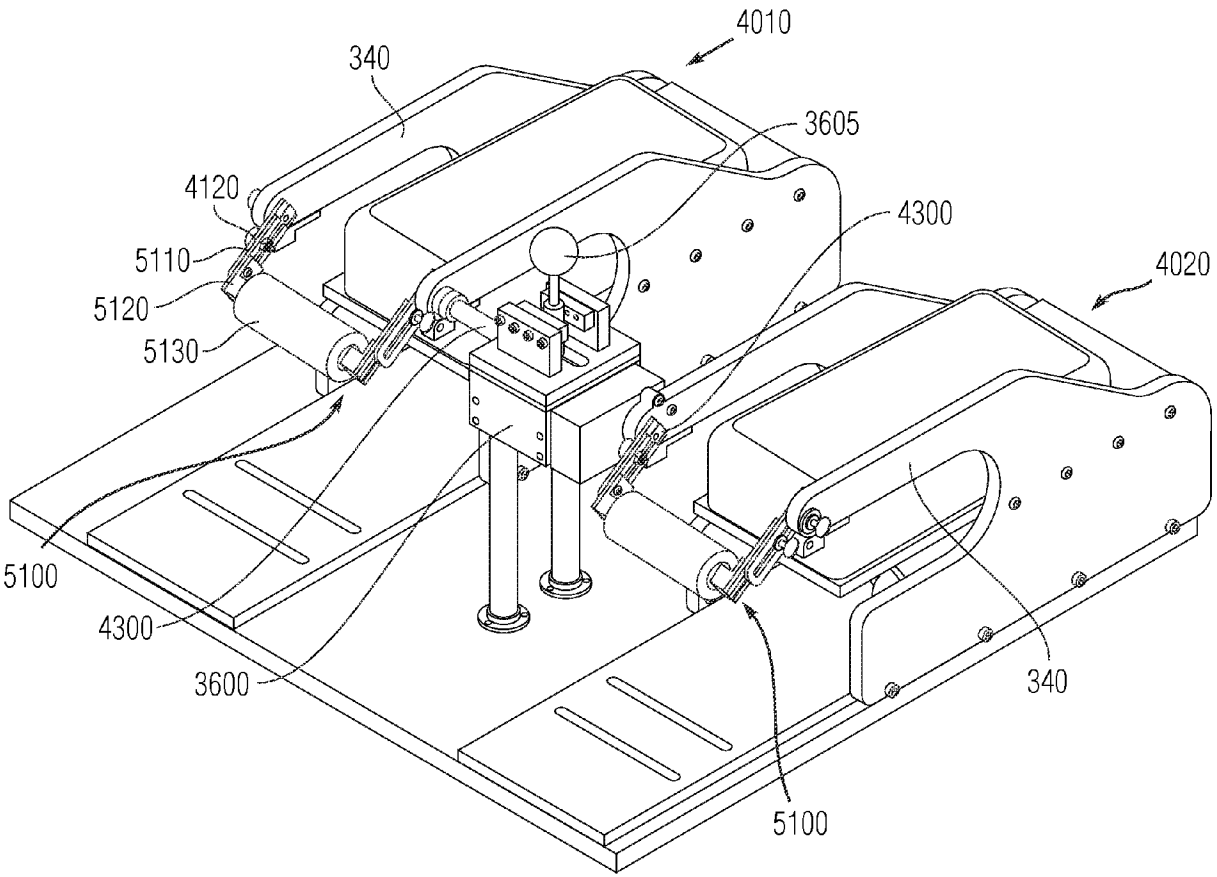
FIG. 41 is a top perspective view of a wrist training device according to another embodiment of the present invention.

Now referring to FIG. 41 a wrist trainer 5000 according to another embodiment is shown. The wrist trainer 500 shares many of the same components as the trainer 4000 and is of a modular design in that the base and the arm support platform structures are maintained. In this embodiment, the links or arms 4120 are not connected to the frame 4100 but instead the links 4120 are connected to a hand grip assembly 5100 that has a pair of side arms 5110 with a cross bar 5120 that extends therebetween. Hand grip padding 5130 is disposed over the cross bar 5120. The side arms 5110 can be easily attached to the links 4120 using conventional techniques, such as the use of fasteners (quick release fasteners) that permit the hand grip assembly 5100 to be attached to the links 4120. The hand bar 4030 is removed.

The device 5000 functions similar to how the device 4000 operates in that the patient grasps both cross bars 5120 (padding 5130) with his or her hands. The good hand of the patient is pivoted (wrist extends and flexes) and due to the coupling between the hand grip assemblies 5100 and the shafts 4300, the motion of the wrist in the good hand is translated into motion of the affected hand about the affected wrist. For example, if the patient pivots the hand upward and the gear box 3600 is set to a synchronized operating mode, then the other hand will likewise pivot upward. The other operating modes are possible, such as out of synchronized mode and neutral mode.

The coupling between the side arms 5110 and links 4120 is of a type that permits the hand assemblies 5100 to be adjusted in that the cross bar 5120 can be brought further from or closer to the arms 340 and platform. For example, a thumb screw (fasteners) can be used to attach the side arms 5110 and links 4120.

The modularity between the trainers 4000 and 5000 allows the gear box 3600 and shafts 4300 to be maintained while the operator simply swaps out the finger extension components or wrist components and places the desired components in place.

Shoulder Abduction-Adduction Trainer

Figure 18:
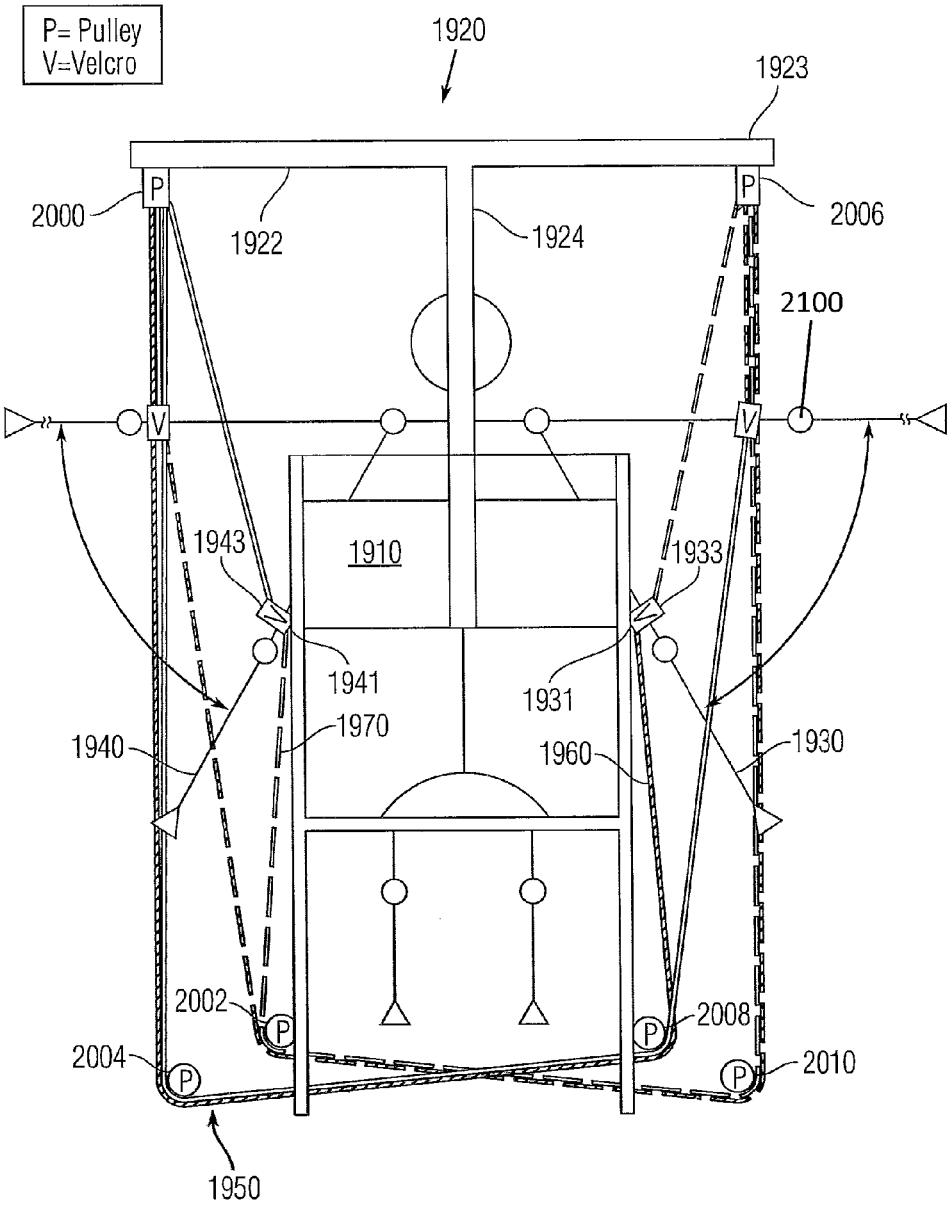
FIG. 18 is a rear elevation view of a shoulder abduction-adduction trainer according to one embodiment.

Now referring to FIG. 18, a shoulder abduction-adduction trainer (device) 1900 according to one embodiment is illustrated. The device 1900 enables a patient to abduct and adduct the unaffected shoulder by raising and lowering the arm from a vertical position to a horizontal position, thereby facilitating the same movements in the affected arm and shoulder.

The device 1900 includes a chair or the like 1910 in which the patient seats. The device 1900 includes a main support 1920 that is attached to the chair 1910 and is generally I-shaped (e.g., a metal I-shaped structure). The main support 1920 thus includes a pair of upper arms 1922, 1923 that extend outwardly from a vertical support member 1924.

The device 1900 includes first and second arm splints 1930, 1940 with each splint 1930, 1940 being configured to support a respective arm. For example, the splint 1930, 1940 is contoured (e.g., a concave arm receiving surface) to receive and support the arm. The splints 1930, 1940 are constructed so that elbow extension/flexion are prevented. Fasteners, such as straps formed of hook and loop material, can be used to hold the arm in place and prevent bending of the elbow.

The device 1900 includes a mechanism 1950 that is coupled to the splints 1930, 1940 to cause the controlled, mirrored abduction/adduction motions in both the unaffected shoulder and the affected shoulder. The mechanism 1950 can in one embodiment, as illustrated, be in the form of a cable/pulley system. The mechanism 1950 includes a first cable 1960, a second cable 1970, a first set of pulleys and a second set of pulleys.

The first set of pulleys includes a first pulley 2000, a second pulley 2002, a third pulley 2004, while the second set of pulleys includes a fourth pulley 2006, a fifth pulley 2008, and a sixth pulley 2010. The first pulley 2000 is mounted to the upper arm 1922 and the second pulley 2002 is mounted vertically to a floor or support 1995 that is disposed below the chair. The second pulley 2002 is mounted horizontally to the back legs of the chair. The third pulley 2004 is another vertically mounted pulley that is disposed approximately 12 inches lateral to the chair. The fourth pulley 2006 is mounted on the upper arm 1923 and the fifth pulley 2008 is mounted vertically to the floor or support 1995 that is disposed below the chair (opposite the second pulley 2002). The fifth pulley 2008 is mounted horizontally to the back legs of the chair. The sixth pulley 2010 is another vertically mounted pulley that is disposed approximately 12 inches lateral to the chair opposite the pulley 2004.

As described below, the cables 1960, 1970 are attached to each splint 1930, 1940, one on the inner aspect of the upper arm and one on the outer aspect of the upper arm. The first cable 1960 is attached to an inner aspect (edge) 1931 of the splint 1930 and is routed to the pulley 2008 before being passed underneath the chair to the pulley 2004 where it is then routed to the pulley 2000 before being routed and attached to an outer aspect (edge) 1943 of the other splint 1940. The cable 1960 is thus routed through three pulleys before being attached to the opposite aspect of the opposite splint. Similarly, the second cable 1970 is attached to an inner aspect (edge) 1941 of the splint 1940 and is routed to the pulley 2002 before being passed underneath the chair to the pulley 2010 where it is then routed to the pulley 2006 before being routed and attached to an outer aspect (edge) 1933 of the other splint 1930. The cable 1970 is thus routed through three pulleys before being attached to the opposite aspect of the opposite splint. The cables 1960, 1970 attached the inner aspects 1931, 1941 of the splints 1930, 1940 travel toward the floor at a generally 90 degree angle.

In operation, the patient is seated in the chair with arms at his/her sides. The cables 1960, 1970 are attached and the patient is then instructed to lift his/her arms to shoulder height. The arrows in FIG. 18 illustrate this motion. The device permits the unaffected arm to assist the affected arm in the abduction and adduction of the shoulders. The cable attachment points are such that as the unaffected arm is raised, the cable attachment to the inner aspect causes a pulling of the cable and since the cable is attached to the outer aspect of the other splint, the other splint is raised in a motion that mirrors the motion of the unaffected arm.

It will be appreciated that cable routing members (e.g., eyelets) can be provided proximate to the pulleys to assist cable routing. In addition, a cable limiter 2100 can be provided to limit the degree of travel of a respective cable so as to prevent the patient from overextending his/her arms. The limiter 2100 can be in the form of a ball that is fixedly attached to the cable at a specific location of the cable and at a set distance from the pulley. As the cable is pulled, the ball will travel toward the cable routing member (e.g., eyelet) and since the diameter of the ball is greater than the opening in the eyelet, the engagement of the ball to the eyelet prevents further movement of the cable.

As with the other devices, the device may be used by patients in the home, health/fitness clubs or in a therapeutic setting. The device is simple to use and a family member or friend can assist in the setup.

Ankle Rehabilitative Trainer

Figure 26:
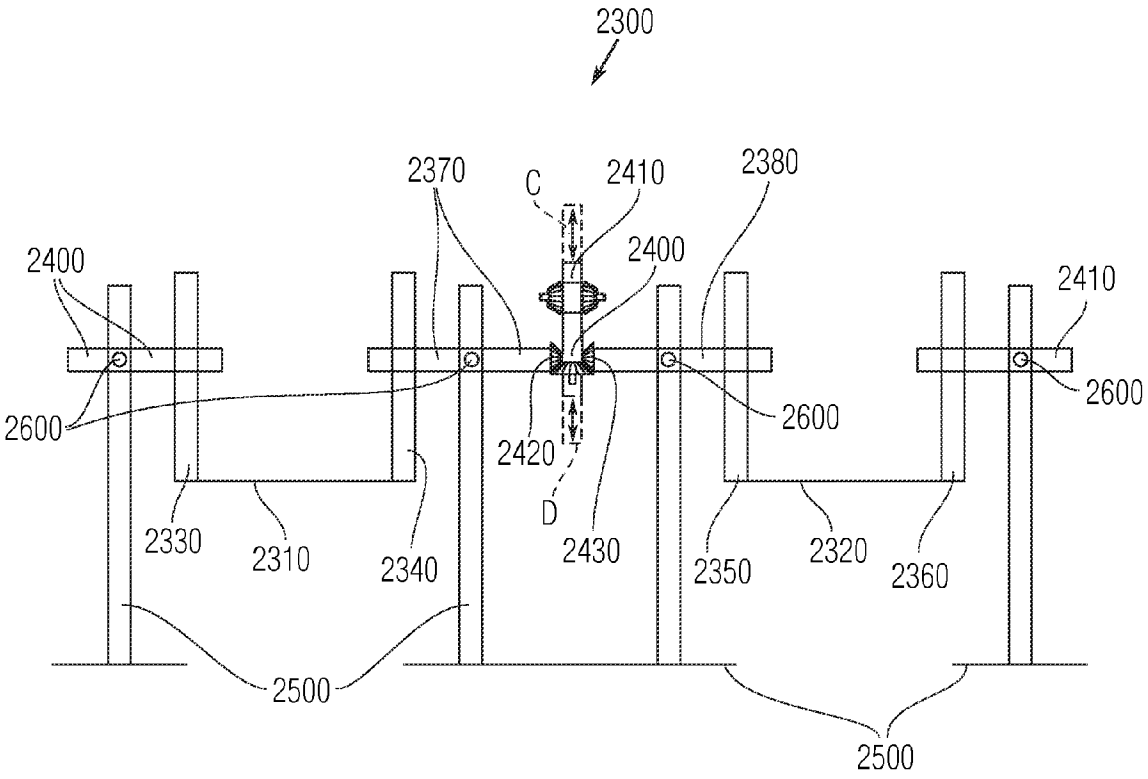
FIG. 26 is a front view of an ankle rehabilitative trainer device according to one embodiment of the present invention.
Figure 27:
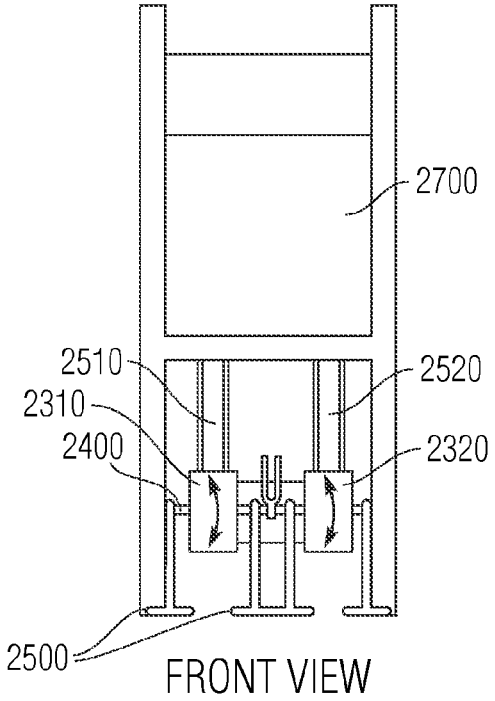
FIG. 27 is a front view of the ankle rehabilitative device of FIG. 26 in combination with a seat.
Figure 28:
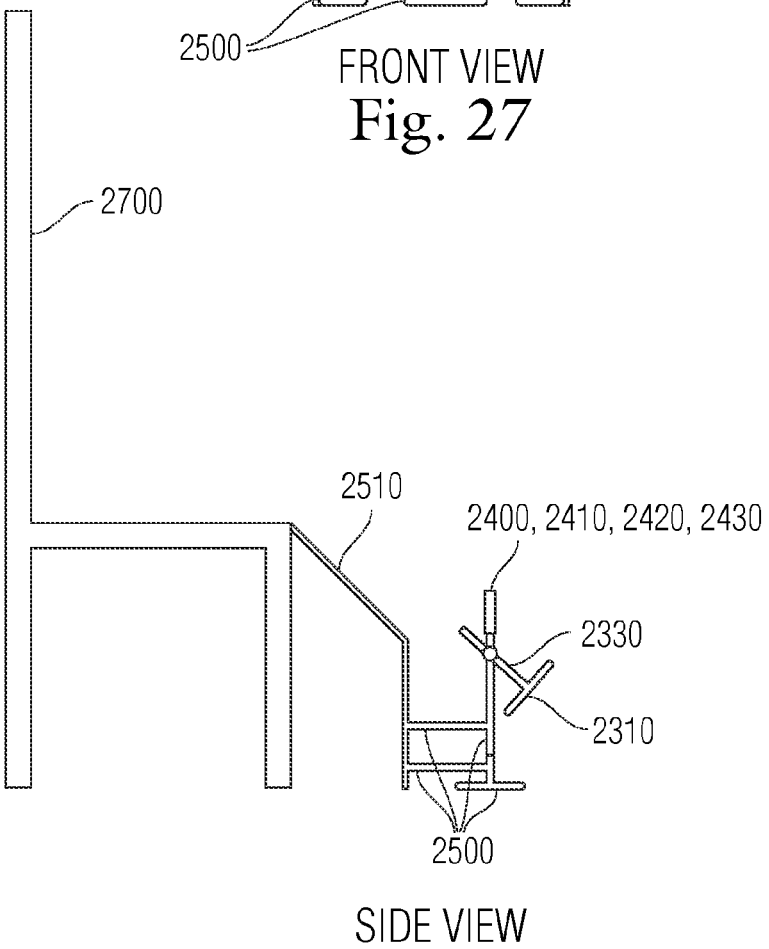
FIG. 28 is a side view of the combination shown in FIG. 27.

Now referring to FIGS. 26-28, an ankle rehabilitative trainer device 2300 (ART) is illustrated that enables a stroke patient to use her/his unaffected ankle (and unaffected brain) to facilitate almost symmetrical movements with the affected ankle. The underlying principle for the design of this device and several other devices in this series is that rehabilitation of an affected joint can be facilitated by increasing the participation of the brain's intact motor systems in causing the affected joint to move. By using the unaffected brain to move both ankles in the same manner, the hypothesis is that recovery from stroke will be facilitated either by increasing the participation of any surviving neurons on the affected brain or by increasing control of the muscles by the ipsilateral brain. Foot drop, which is the result of weak dorsiflexion, is a very common symptom of stroke patients. The trainer device 2300 enables the unaffected foot and ankle to train alternating dorsiflexion and plantar flexion in the affected foot and ankle.

The device 2300 includes two adjustable flat pedals 2310, 2320 on which the soles of the patient's shoes rest, four adjustable crank arms 2330, 2340, 2350, 2360 to which the pedals 2310, 2320 are secured (one each for the lateral and medial sides of the pedals 2310, 2320), and two adjustable horizontal medial connecting rods 2370, 2380 that are attached to the two crank arms 2340, 2350, respectively. In addition, the device 2300 includes two lateral connecting rods 2400, 2410, two lateral gears 2420, 2430 that link the two connecting rods 2370, 2380, and two medial gears 2400, 2410 one of which will link the connecting rods 2370, 2380.

The device 2300 also includes a floor stand 2500 that provides a solid base for the crank arms 2330, 2340, 2350, 2360, and two leg and knee support structures 2510, 2520 extending from the patient to the floor on which the patient's legs rest. The medial and lateral connecting rods 2370, 2380, 2400, 2410 insert into sleeve bearings 2600 or similar parts mounted in the vertical component of the support structure (stand 2500). The sleeve bearings 2600 permit the lateral and medial connecting rods, the pedals, and the crank arms to rotate as one unit around the center of an arc made when the patient performs dorsiflexion and plantar flexion of his/her foot. The device 2300 is attached to the front of a chair 2700 on which the patient sits. All of the various components are adjustable by the use of set screws and rods whose length can be varied according to the patient's size. The adjustability enables the optimum positioning of the pedals, connecting rods, and gears. The optimum position is achieved when the gears and connecting rods are exactly in the center of the pivot points of the left and right ankles as they dorsiflex and plantar flex. Therefore the device 2300 pivots only at one point which is at the center of the arc made by the patient's ankles as they alternately dorsiflex and plantar flex. The center of the arc is typically at the medial malleolus. The patient's feet are positioned on the pedals and a band (formed of hook and loop material) is placed around the foot to secure it to the pedal. The patient's legs rest on diagonal supports. Bands, formed of hook and loop material, secure the legs to diagonal supports.

Two different gears can link the two horizontal connecting rods so that the motion of one controls the motion of the other. One gear, the alternation gear, causes the two connecting rods to move in opposite directions, while the second, the synchronous gear, causes the connecting rods to move in the same direction. At any time only one of the two gears engages the connecting rods. The movement of the connecting rods then causes the pedals to move—either alternating (if the alternating gear is engaged) or synchronously (if the synchronous gear is engaged). The gears are mounted on a track that adjusts to one of the two positions.

Figure 29:
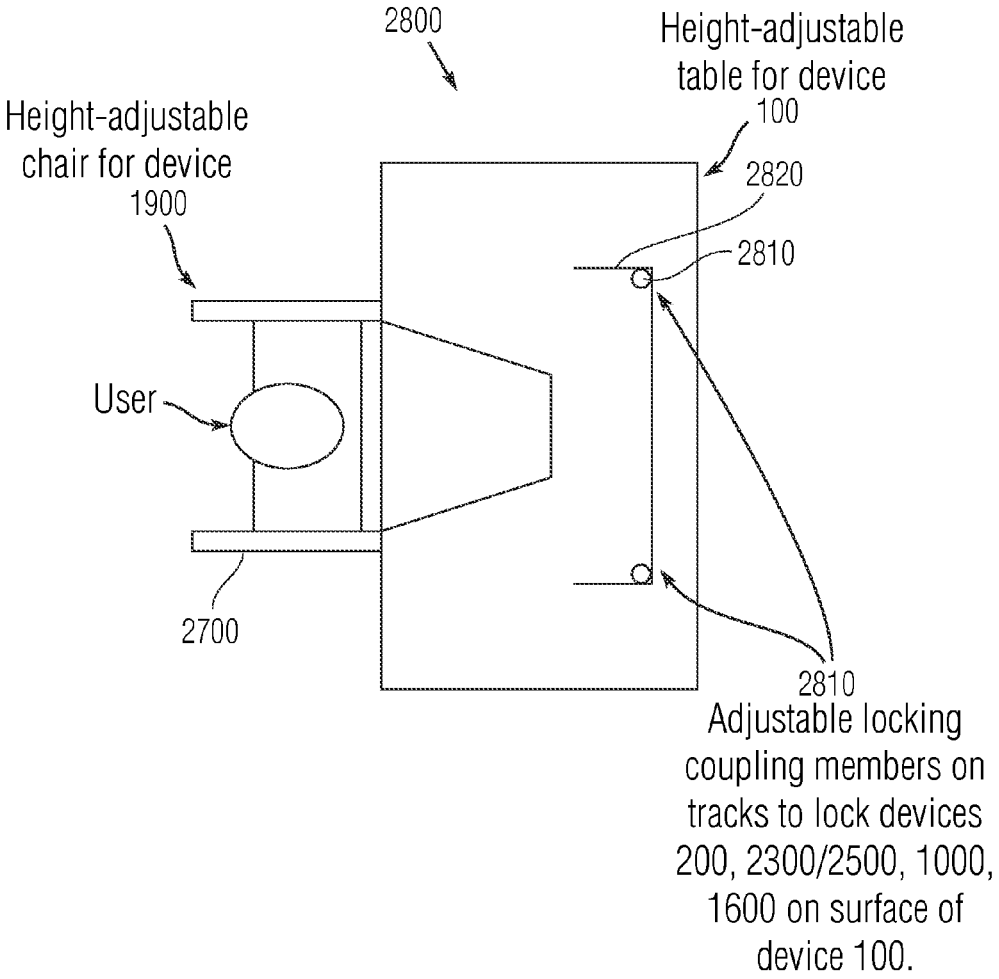
FIG. 29 is a top view of a base for modular assembly of multiple training devices disclosed herein.
Figure 30:
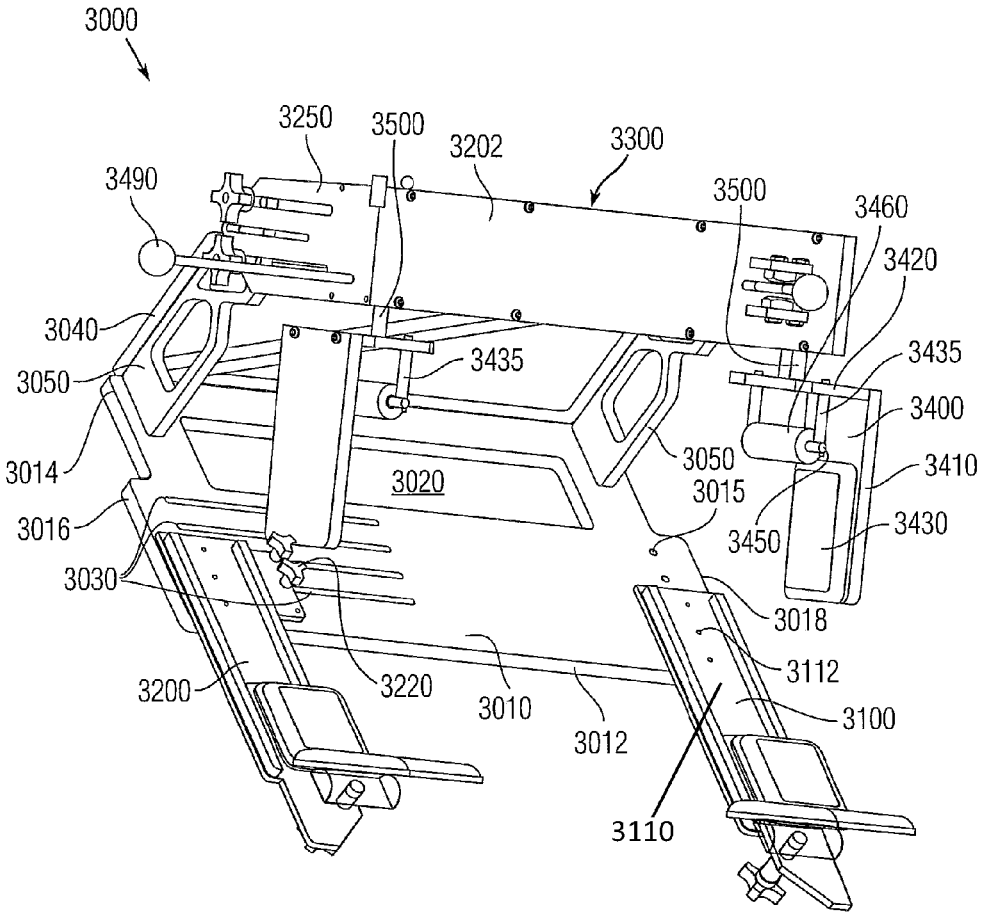
FIG. 30 is a front perspective view of a forearm pronation-supination rehabilitative trainer according to another embodiment of the present invention.
Figure 31:
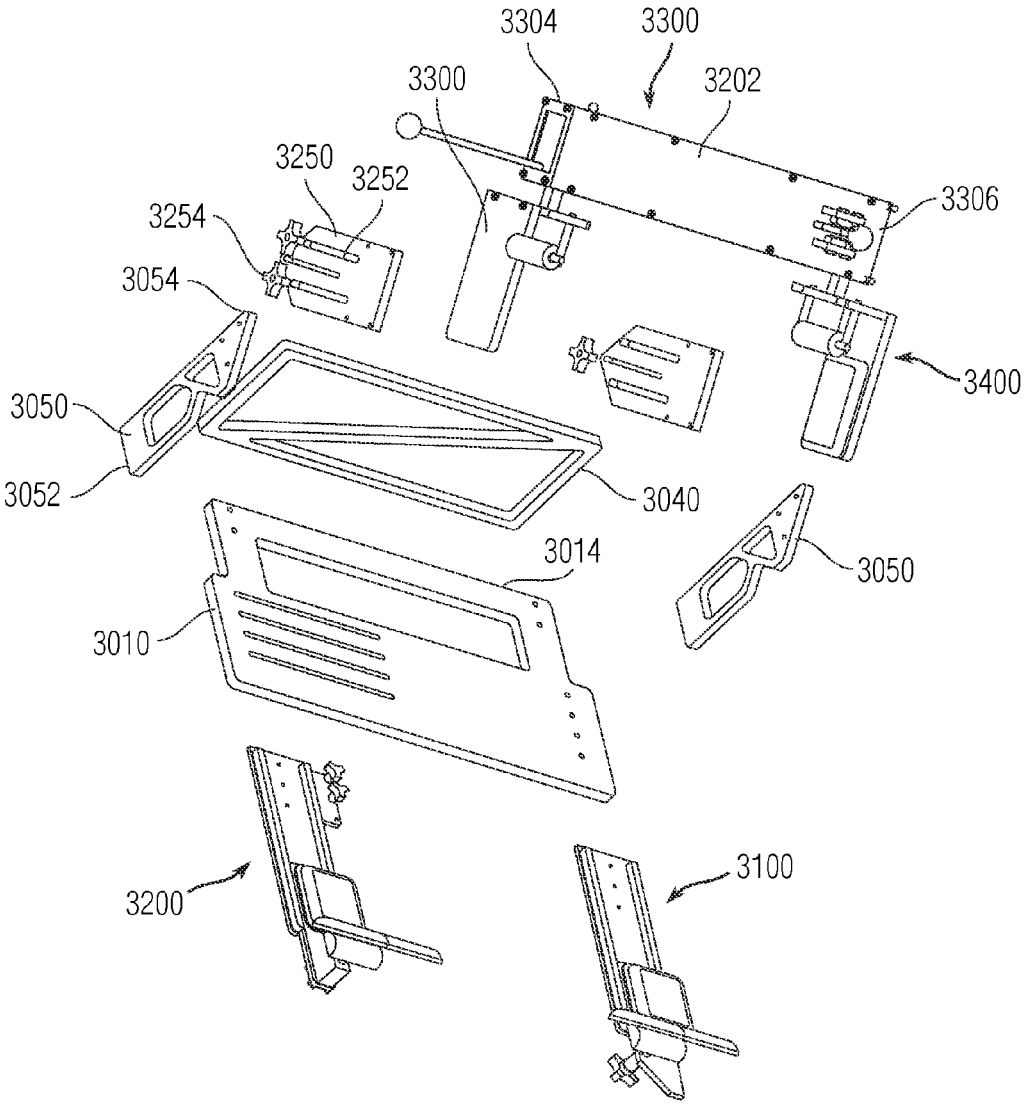
FIG. 31 is an exploded front perspective view of the trainer of FIG. 30.
Figure 32:
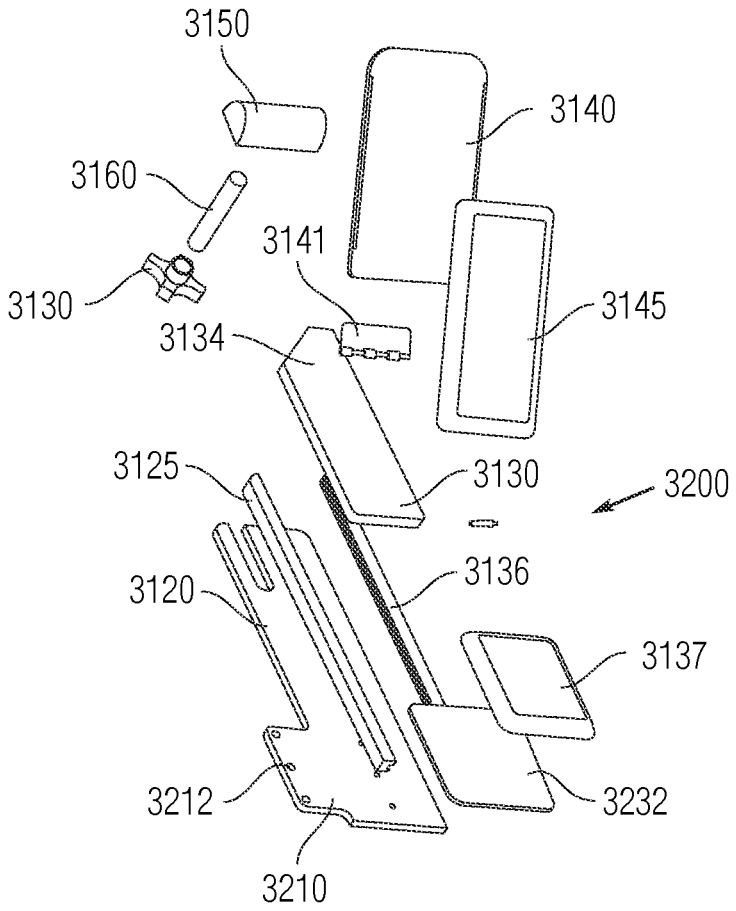
FIG. 32 is an exploded perspective view of an elbow support member.
Figure 33:
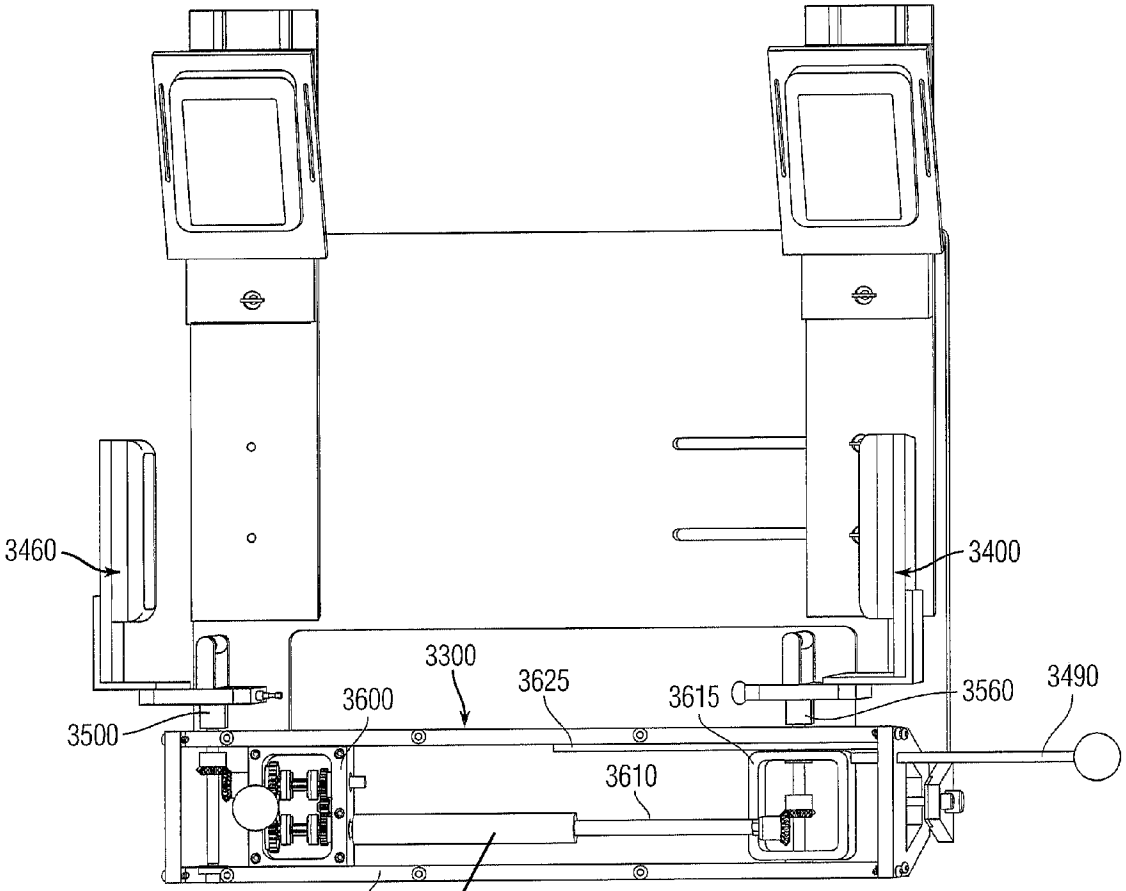
FIG. 33 is a top view of the trainer of FIG. 30 with a top wall of the working components being removed to show gear assemblies.

The device 2300 attaches in a modular fashion to the front of the "height-adjustable" chair 2700 that is also shown in FIG. 29 and is for use also with device 1900.

Modular Assembly

In accordance with one embodiment of the present invention, the devices disclosed herein can be part of a modular assembly where two or more devices are coupled to one another to provide a multi-limb (multi-body) part rehabilitative system.

In one embodiment of such a system, the modular assembly will be focused around a seating system where the user (patient) will be seated on a height adjustable chair which forms the base for the shoulder abduction-adduction trainer (device 1900). The base for the bilateral arm trainer (device 100) will be the height-adjustable table, which will be configured so that other training devices, such as the wrist trainer 1600, the finger and thumb extension/flexion training device (trainer) 200, etc. can be easily and lockingly coupled to the device 100. For example, a front edge of the base of the device 100 can include coupling members that permit the direct attachment of the other devices (200, 2300, 1000 and 1600) to the base of the device 100. The coupling members will be on a right angled track so that both the vertical distance from the front edge of the table and the horizontal distance between the two arms can be adjusted to the dimensions of the user.

All devices can have coupling members at their base so that a mechanical releasable coupling between the devices is achieved. For example, a device can be snap-lockingly coupled to the base of the device 100 and since the devices are designed to be conveniently stored, the devices can simply be detached and then placed in their storage positions.

FIG. 29 is a top view of a base 2800 for modular assembly of various training devices disclosed herein. The base 2800 is in the form of a height-adjustable table for device 100 (FIG. 1). The table 2800 has adjustable locking coupling members 2810 on tracks 2820 to lock various trainer devices disclosed herein, including devices 200, 2300/2500, 1000, 1600 on the surface of the device 100. The user is shown sitting in the chair 2700.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A forearm pronation-supination rehabilitative trainer that is configured to operate in a first mode in which the trainer enables a patient to pronate and supinate a forearm of an unaffected first arm in order to facilitate a same movement in a forearm of an affected second arm, and a second mode in which the trainer enables the patient to pronate or supinate the unaffected arm in order to facilitate an opposite movement in the affected arm, comprising:

a housing having a hollow interior;

a first splint configured to receive the first arm and prevent a wrist of the first arm from flexing and extending while permitting pronation and supination of the forearm;

a second splint configured to receive the second arm and prevent a wrist of the first arm from flexing and extending while permitting pronation and supination of the forearm, wherein the first and second splints are arranged side-by-side but spaced from one another; and a mechanism disposed within the hollow interior, the first and second splints being operatively coupled to the mechanism, the mechanism being configured to perform the first and second modes since the mechanism is configured to translate movement of the first splint into movement of the second splint.

2. The trainer of claim 1, wherein each of the first and second splints has a clam shell construction and is formed of first and second parts that are openable and closeable, wherein a distal end of each of the first and second splints is open permit fingers of the respective arm to extend forward beyond the distal end.

3. The trainer of claim 2, wherein the first part includes a first bar that extends distal to the distal end and has a transverse portion configured to be grasped and held in a palm of the respective hand, the second part including a second bar that extends distal to the distal end and includes a shaft that extends distally from the second bar and the second part, the shaft including a pinion at or near a distal end thereof, wherein the shafts of the first and second splints are disposed through holes formed in a front wall of the housing.

4. The trainer of claim 3, wherein the mechanism includes a first rack that is operative in the first mode and a second rack that is operative in the second mode, the first rack having a first set of teeth formed along a top surface and second set of teeth formed along a bottom surface, wherein the pinion associated with the first splint engages the first set of teeth and the pinion associate with the second splint engages the second set of teeth, the first rack being disposed at an angle between the pinions of the first and second splints, where teeth of the pinion of the first splint move along the first set of teeth and teeth of the pinion of the second splint move along the second set of teeth, whereby when the forearm of the first arm contained in the first splint pronates producing clockwise movement, the forearm of the second arm contained in the second splint also pronated in a counterclockwise movement.

5. The trainer of claim 4, wherein the pinion associated with the first splint acts as a drive device and the pinion associated with the second splint acts as a slave device whose motion is dependent on the motion of the drive device.

6. The trainer of claim 1, wherein the first rack is pivotally mounted within the housing.

7. The trainer of claim 6, wherein the first rack is connected to a handle at a pivot point about which the first rack rotates, wherein rotation of the handle causes the first rack to pivot.

8. The trainer of claim 1, wherein the second includes only one set of teeth formed along a top surface thereof.

9. The trainer of claim 8, wherein the second rack comprises a horizontal rack that is disposed within a movable trough formed in the housing, the second rack freely traveling laterally within the trough, the trough being in communication with a pair of vertical guide channels that are formed at opposite of the housing.

10. The trainer of claim 9, wherein the trough is configured to lock in a retracted position and an engaged position in which the second track moves upward in a vertical direction until the second rack engages the pinions of the first and second splints.

11. The trainer of claim 9, wherein the trough is coupled to a handle that is accessible along a front face of the housing.

12. The trainer of claim 11, wherein the handle is attached to a shaft that is also attached to the trough, the shaft can passing through a vertical slot formed in the front face of the housing, the front face including locking apertures along the vertical slot to permit the shaft to move vertically and be locked into one of the first and second positions.

13. The trainer of claim 12, wherein the second mode is achieved by rotating the angled first rack out of engagement with the pinions of the first and second splints and then moving the horizontal second rack into the engaged position to engage with the teeth of both pinions, wherein in the second mode, the pinions of the first and second splints rotate in the same direction either clockwise or counterclockwise since the second rack can freely move laterally within the trough.

* * * * *